US009834832B2

(12) United States Patent
Branagan et al.

(10) Patent No.: US 9,834,832 B2
(45) Date of Patent: Dec. 5, 2017

(54) CLASSES OF STEELS FOR TUBULAR PRODUCTS

(71) Applicants: Daniel James Branagan, Idaho Falls, ID (US); Sheng Cheng, Idaho Falls, ID (US); Longzhou Ma, Idaho Falls, ID (US); Jason K. Walleser, Idaho Falls, ID (US); Grant G. Justice, Idaho Falls, ID (US); Andrew T. Ball, Ammon, ID (US); Kurtis Clark, Idaho Falls, ID (US); Scott Larish, Idaho Falls, ID (US); Alissa Peterson, Providence, RI (US); Patrick E. Mack, Idaho Falls, ID (US); Brian D. Merkle, Idaho Falls, ID (US); Brian D. Meacham, Idaho Falls, ID (US); Alla V. Sergueeva, Idaho Falls, ID (US)

(72) Inventors: Daniel James Branagan, Idaho Falls, ID (US); Sheng Cheng, Idaho Falls, ID (US); Longzhou Ma, Idaho Falls, ID (US); Jason K. Walleser, Idaho Falls, ID (US); Grant G. Justice, Idaho Falls, ID (US); Andrew T. Ball, Ammon, ID (US); Kurtis Clark, Idaho Falls, ID (US); Scott Larish, Idaho Falls, ID (US); Alissa Peterson, Providence, RI (US); Patrick E. Mack, Idaho Falls, ID (US); Brian D. Merkle, Idaho Falls, ID (US); Brian D. Meacham, Idaho Falls, ID (US); Alla V. Sergueeva, Idaho Falls, ID (US)

(73) Assignee: The NanoSteel Company, Inc., Providence, RI (US)

( * ) Notice: Subject to any disclaimer, the term of this patent is extended or adjusted under 35 U.S.C. 154(b) by 428 days.

(21) Appl. No.: 14/151,310

(22) Filed: Jan. 9, 2014

(65) Prior Publication Data

US 2014/0190594 A1 Jul. 10, 2014

Related U.S. Application Data

(60) Provisional application No. 61/750,606, filed on Jan. 9, 2013.

(51) Int. Cl.
*C22C 38/58* (2006.01)
*C21D 8/10* (2006.01)
(Continued)

(52) U.S. Cl.
CPC ..... *C22C 38/58* (2013.01); *B22D 13/023* (2013.01); *B22F 5/106* (2013.01); *C21D 6/002* (2013.01);
(Continued)

(58) Field of Classification Search
CPC ..... C22C 38/54; C21D 8/105
See application file for complete search history.

(56) References Cited

U.S. PATENT DOCUMENTS 6,298,702 B1 10/2001 Korte
8,257,512 B1 * 9/2012 Branagan ..... C21D 8/02 148/325
8,479,549 B1 * 7/2013 Fonte ..... B21C 37/06 148/519

FOREIGN PATENT DOCUMENTS

WO 2013119334 8/2013
WO 2015051162 4/2015

OTHER PUBLICATIONS

Extended European Search Report dated Jun. 1, 2016 issued in related European Patent Application No. 14737581.0.
(Continued)

*Primary Examiner* — Jessee Roe
(74) *Attorney, Agent, or Firm* — Grossman, Tucker, Perreault & Pfleger, PLLC

(57) ABSTRACT

The present disclosure is directed and formulations and methods to provide alloys having relative high strength and
(Continued)

ductility. The alloys may be provided in seamless tubular form and characterized by their particular alloy chemistries and identifiable crystalline grain size morphology. The alloys are such that they include boride pinning phases. In what is termed a Class 1 Steel the alloys indicate tensile strengths of 700 MPa to 1400 MPa and elongations of 10-70%. Class 2 Steel indicates tensile strengths of 800 MPa to 1800 MPa and elongations of 5-65%. Class 3 Steel indicates tensile strengths of 1000 MPa to 2000 MPa and elongations of 0.5-15%.

16 Claims, 28 Drawing Sheets

(51) Int. Cl.

| | |
|---|---|
| ***C22C 38/34*** | (2006.01) |
| ***C22C 38/46*** | (2006.01) |
| ***C22C 38/50*** | (2006.01) |
| ***C22C 38/54*** | (2006.01) |
| ***C21D 6/00*** | (2006.01) |
| ***C21D 9/08*** | (2006.01) |
| ***C22C 33/00*** | (2006.01) |
| ***C22C 38/00*** | (2006.01) |
| ***C22C 38/02*** | (2006.01) |
| ***C22C 38/04*** | (2006.01) |
| ***C22C 38/08*** | (2006.01) |
| ***C22C 38/12*** | (2006.01) |
| ***C22C 38/14*** | (2006.01) |
| ***C22C 38/40*** | (2006.01) |
| ***C22C 38/42*** | (2006.01) |
| ***C22C 38/44*** | (2006.01) |
| ***C22C 45/02*** | (2006.01) |
| ***B22D 13/02*** | (2006.01) |
| ***B22F 5/10*** | (2006.01) |
| ***C22C 32/00*** | (2006.01) |

(52) U.S. Cl.

CPC ..... *C21D 6/004* (2013.01); *C21D 6/005* (2013.01); *C21D 6/008* (2013.01); *C21D 8/105* (2013.01); *C21D 9/08* (2013.01); *C21D 9/085* (2013.01); *C22C 32/0073* (2013.01); *C22C 33/003* (2013.01); *C22C 38/002* (2013.01); *C22C 38/02* (2013.01); *C22C 38/04* (2013.01); *C22C 38/08* (2013.01); *C22C 38/12* (2013.01); *C22C 38/14* (2013.01); *C22C 38/34* (2013.01); *C22C 38/40* (2013.01); *C22C 38/42* (2013.01); *C22C 38/44* (2013.01); *C22C 38/46* (2013.01); *C22C 38/50* (2013.01); *C22C 38/54* (2013.01); *C22C 45/02* (2013.01); *B22F 2998/10* (2013.01); *C21D 2211/004* (2013.01)

(56) References Cited

OTHER PUBLICATIONS

International Search Report dated Apr. 24, 2014 issued in related International Patent Application No. PCT/US2014/010873.

* cited by examiner (1): Inner; (2): near inner; (3): center; (4): near outer; (5) outer

CLASSES OF STEELS FOR TUBULAR PRODUCTS

CROSS REFERENCE TO RELATED APPLICATION

This application claims the benefit of U.S. Provisional Application Ser. No. 61/750,606 filed Jan. 9, 2013.

FIELD OF INVENTION

This application deals with new classes of advanced steel alloys which may be used for tubular product production. The new classes of advanced steel have unique chemistries and operable mechanisms leading to advanced mechanical properties.

BACKGROUND

Steels have been used by mankind for at least 3,000 years and are widely utilized in industry comprising over 80% by weight of all metallic alloys in industrial use. Existing steel technology is based on manipulating the eutectoid transformation. The first step is to heat up the alloy into the single phase region (austenite) and then cool or quench the steel at various cooling rates to form multiphase structures which are often combinations of ferrite, austenite, and cementite. Depending on the cooling rate of the steel at solidification or thermal treatment, a wide variety of characteristic microstructures (i.e. pearlite, bainite, and martensite) can be obtained with a wide range of properties. This manipulation of the eutectoid transformation has resulted in the wide variety of steels available nowadays.

Non-stainless steels may be understood herein to contain less than 10.5% of chromium and are typically represented by plain carbon steel which is by far the most widely used kind of steel. The properties of carbon steel depend primarily on the amount of carbon it contains. With very low carbon content (below 0.05% C), these steels are relatively ductile and have properties similar to pure iron. They cannot be modified by heat treatment. They are inexpensive, but engineering applications may be restricted to non-critical components and general paneling work.

Pearlite structure formation in most alloy steels requires less carbon than in ordinary carbon steels. The majority of these alloy steels is low carbon material and alloyed with a variety of elements in total amounts of between 1.0% and 50% by weight to improve its mechanical properties. Lowering the carbon content to the range of 0.10% to 0.30%, along with some reduction in alloying elements increases the weldability and formability of the steel while maintaining its strength. Such alloys are classed as a high-strength low-alloy steels (HSLA) exhibiting tensile strengths from 270 to 700 MPa.

Advanced High-Strength Steels (AHSS) steels may have tensile strengths greater than 700 MPa and include types such as martensitic steels (MS), dual phase (DP) steels, transformation induced plasticity (TRIP) steels, and complex phase (CP) steels. As the strength level increases, the ductility of the steel generally decreases. For example, low-strength steel (LSS), high-strength steel (HSS) and AHSS may indicate tensile elongations at levels of 25% to 55%, 10% to 45% and 4% to 30%, respectively.

Much higher strength (up to 2500 MPa) has been achieved in maraging steels which are carbon free iron-nickel alloys with additions of cobalt, molybdenum, titanium and aluminum. The term maraging is derived from the strengthening mechanism, which is transforming the alloy to martensite with subsequent age hardening. The common, non stainless grades of maraging steels contain 17% to 18% nickel, 8% to 12% cobalt, 3% to 5% molybdenum and 0.2% to 1.6% titanium. The relatively high price of maraging steels (they are several times more expensive than the high alloy tool steels produced by standard methods) significantly restricts their application in many areas (for example, automotive industry). They are highly sensitive to nonmetallic inclusions, which act as stress raisers and promote nucleation of voids and microcracks leading to a decrease in ductility and fracture toughness of the steel. To minimize the content of nonmetallic inclusions, the maraging steels are typically melted under vacuum resulting in high cost processing.

SUMMARY

The present disclosure relates to a method for producing metallic alloys of selected elemental composition. The alloys may include: (1) Fe—Cr—Ni—B—Si alloys which optionally may include one or more of V, Zr, Mn, W, Ti, Mo, Nb, Al, Cu, V and C; (2) Fe—Ni—B—Si alloys which optionally include Cu or Mn; (3) Fe—Cr—B—Si alloys which optionally include Cu, C or Mn; and (4) Fe—B—Si—Mn alloys which optionally include Cu or C. The atomic ratios of the identified elements may add up to 100. Impurities may be present at levels up to 10 atomic percent.

BRIEF DESCRIPTION OF THE DRAWINGS

The detailed description below may be better understood with reference to the accompanying FIGS. which are provided for illustrative purposes and are not to be considered as limiting any aspect of this invention.

DETAILED DESCRIPTION

Figure 1:
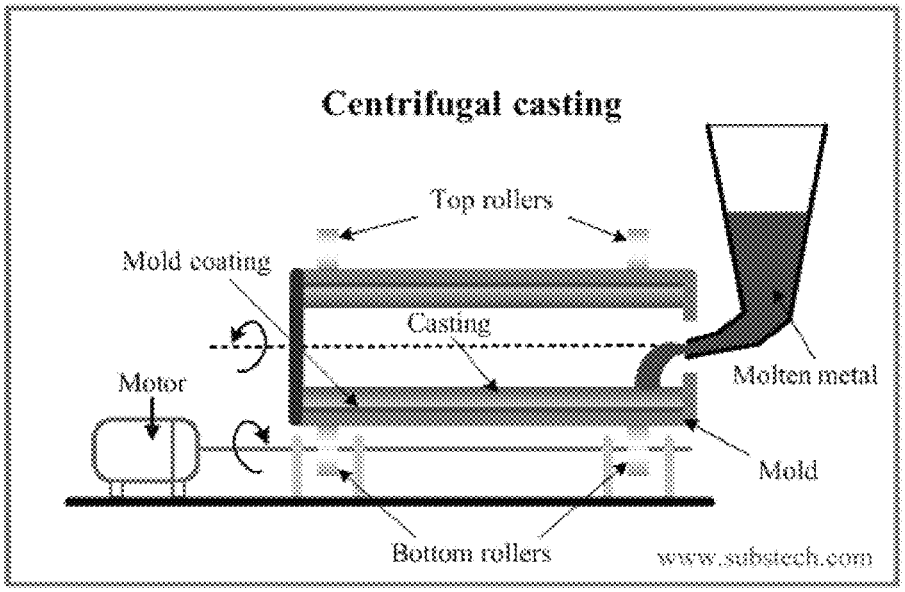
FIG. 1 illustrates a centrifugal casting process.

The alloys described herein may be employed for use in tubular products for different applications, such as pipes, tubes, casings, and rods with different profiles. They can be directly cast into tubular products by centrifugal casting or used in a powder form for further production steps including but not limited to cold/hot extrusion, pressing, forging towards final products. The alloys herein in powder form can be used as initial precursor or may be pre-compacted into billets (preforms).

Tubular products for drilling applications may include use as a drill collars (a component that provides weight on a bit for drilling), drill pipe (hollow wall pipe used on drilling rigs to facilitate drilling), tool joints (i.e. the threaded ends of drill pipe), protective well casings, and wellheads (i.e. the component of a surface or an oil or gas well that provides the structural and pressure-containing interface for drilling and production equipment) including but not limited to ultra-deep and ultra-deep water and extended reach (ERD) well exploration. The alloys herein may also be produced in a tubular form for the automotive industry, for example, as air bag tubes.

A number of production methods are envisioned for seamless tubular products. Centrifugal casting can be used to produce a pipe form directly from a liquid melt. The as-cast pipe can be post processed by various methods including hot extrusion, cold extrusion, hot pilgering, and/or cold pilgering in order to eliminate defects, change metallurgical structure, reduce surface or internal porosity, and increase pipe uniformity and quality. Another route is to utilize a powder metallurgy compact which involves atomization by several methods including gas, water, or centrifugal atomization etc. followed by compacting into a billet. Compacting can be done by several methods including powder extrusion, cold isostatic processing (CIP), hot isostatic pressing (HIP), etc. The compacts can then be processed through a number of different post processing strategies to yield a tubular form including piercing, pierce and roll, hot extrusion, cold extrusion, hot pilgering, cold pilgering, etc. The tubes produced are envisioned to be seamless but can be welded consistent with the good weld properties of the Class 1, Class 2, and Class 3 steel characteristics. However, the greatest usage of the new steel classes would be envisioned to be in the production of seamless tubes which have homogenous walls without any weld or joint along its length. The homogenous wall and smooth inner surface of the tube is not subjected to weaknesses caused by welding and the potential deleterious effects of the heat affected zone. The largest benefit to using seamless steel pipe is the increased pressure ratings that significantly broadening up the areas of application for ultra-deep and ultra-deep water and extended reach (ERD) well exploration. Seamless pipes are also in high demand for industrial boilers including power industry. Seamless tubes find application in the manufacture of bearings, automobile parts, drill pipes, hydraulic cylinders, gas cylinders, etc.

Production Routes

Centrifugal Casting

Centrifugal casting is a commercially available manufacturing process for producing a wide variety of cylindrically symmetrical parts from simple shapes such as pipes, tubes and tubular components to complex shapes such as valve balls or flanges. The process consists of pouring a molten metal liquid into a rapidly rotating cylindrical mold. The centripetal acceleration of the cylindrical mold causes the metal liquid to be pushed radially outward against the inner surface of the mold. The apparent centrifugal force acting on the metal liquid is proportional to the radius of rotation and to the square of the rotational speed along with the mass.

Thus the pressure applied to the liquid can be significant because of the rapid rotation and larger diameter molds will have a greater pressure exerted on the liquid. The pressure can be engineered for the process in order for the produced part to be fully dense and thus defect free. This gives centrifugal casting an advantage over other casting techniques in which porosity can routinely occur and cannot be avoided. In addition any metal oxide material or slag entrained in the molten liquid will be separated from the metal liquid because of the oxide material or slag has lower density than the metal alloy and these impurities will "float" to the center of the rotation where there is minimal pressure. If the casting shape is a tube or pipe then any oxide material will segregate to the inner diameter surface of the tube or pipe where it can be easily removed by post casting boring or machining.

The mold is water quenched on the outside, which causes the molten metal to be rapidly solidified on the inner diameter of the mold where the pressure is the greatest because it is at the maximum radius and the solidification propagates radially towards the center axis of rotation. The result is that there is refined grain size microstructure on the outer surface, which will provide higher strength in the material. Also because the mold is spun rapidly until solidification is complete therefore the pressure is continuously applied and there is no possibility of any shrinkage during the solidification process, which occurs in other casting techniques.

The design of the part to be cast determines the amount of molten liquid metal to be poured into the mold. For pipes or tubes the molten metal volume is less than the total volume of the mold and is carefully regulated in the manufacturing process to ensure part reproducibility. There is therefore insufficient molten metal to fill up the mold completely. Consequently, a symmetrical bore hole forms in the center along the axis of symmetry. The amount of liquid metal controls the diameter of the bore hole. For low volumes the bore hole will have a large diameter meaning that the part has a thin wall. Thus the same mold can produce different thicknesses simply by changing the volume of metal liquid used to cast the pipe, which means that a range of pipe thicknesses can easily be produced with the same mold. Centrifugal casting production begins with weighing out commercial grade feedstock constituents that are then alloyed together in a furnace. The molten liquid metal is then transferred to a tundish that is moved to the casting location. The mold is rotated at a fixed speed and the tundish is poured into a spout that feeds the liquid metal into one end of the mold. The liquid metal flows along the mold because of the hydrostatic pressure of the fluid reservoir in the spout while simultaneously fans out on the inner diameter surface of the mold because of the rotation of the mold. Once the liquid metal has flowed to the desired length cooling water is applied to the outside of the mold causing the molten metal to solidify. Centrifugal casting is conducted with either vertical or horizontal oriented molds. The choice of orientation used in the manufacturing process is mainly dictated by the length of the mold along its axis of symmetry. For short mold lengths, the mold is vertical while for tubes or pipes for which the length of the axis of symmetry is significantly longer than the diameter then the mold is oriented horizontally. A major driving factor for mold orientation is the mechanical method used to rotate the mold with most casting done with horizontal molds. This allows for mechanical drive wheels to be contact on the outside of the mold in order to precisely control the rotational speed. A centrifugal casting machine is schematically presented in FIG. 1.

Powder Metallurgy Method

Conventional processing of pipe would involve continuous casting into thick rods which will be cut as preforms or billets to be used as feedstock for the pipe making process. Due to the unique metallurgy including the chemistry, operable mechanisms and targeted structures, the Class 1, 2, and 3 steels described in this application cannot be made by continuous casting of thick blocks or rods. However, there are a number of methods envisioned to produce pipe using a powder metallurgy process and one of the methods is described in FIG. 2. The first step is to atomize to produce powder which can be done by various techniques including but not limited to gas, water, and centrifugal atomization. The next step is to consolidate the powder into a near full density billet. As shown this can be done using HIPing but alternate methods can also be used such as CIPing, powder extrusion, powder forging etc. The consolidated billet can then be produced into a pipe using hot extrusion processes which would be Step #3.

Extrusion is a process used to create objects of a fixed, cross-sectional profile and is widely used for seamless pipe and tube production. The main goal in tube extrusion is to manufacture consistent products with minimal dimensional variation. A material is pushed or drawn through a die of the desired cross-section. Extrusion is in most cases a hot working operation but can also be carried out in cold mode. The working temperatures in hot extrusion are typically 0.7-0.9 $T_m$, where $T_m$ is the melting temperature. In steel extrusion, glass lubrication is commonly used when a layer of glass between the billet and the container, between the billet and the mandrel, and between the billet and the die is applied. Each billet is heated to the extrusion temperature and then rolled in a powder of glass during transportation to the extrusion chamber. Glass powder is also applied inside the billet to assure good lubrication between billet and mandrel. Lubrication through the die is provided by a thick disc of compacted glass, the glass pad, which is placed between the billet and the die. During extrusion, the glass pad is pressed against the die by the hot metal. The glass pad will deform with the billet and melt progressively to surround the extrusion with a lubricant glass film. The billet heating is an important stage in the manufacturing of steel tubes and pipes. The aim is to heat the material to a specified temperature that is suitable for hot forming. It is often desired to have a uniform temperature distribution within the heated billet. Heating prior to extrusion is carried out in gas-fueled rotary hearth furnaces, in induction furnaces, or in a combination of both.

Figure 2:
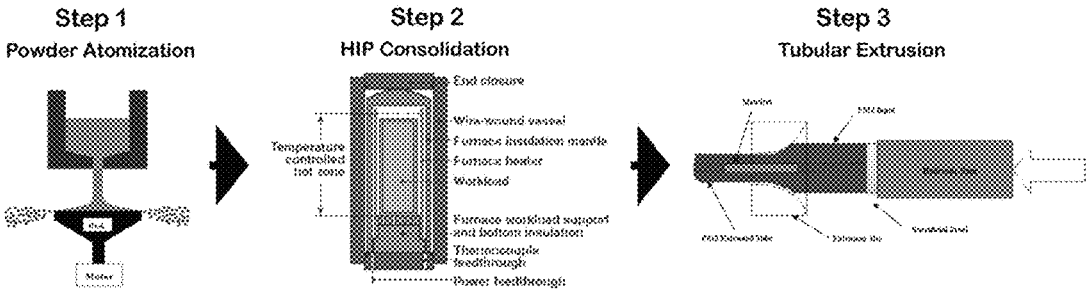
FIG. 2 illustrates one production method of seamless tubular products by extrusion of pre-consolidated billets from powder.
Figure 2A:
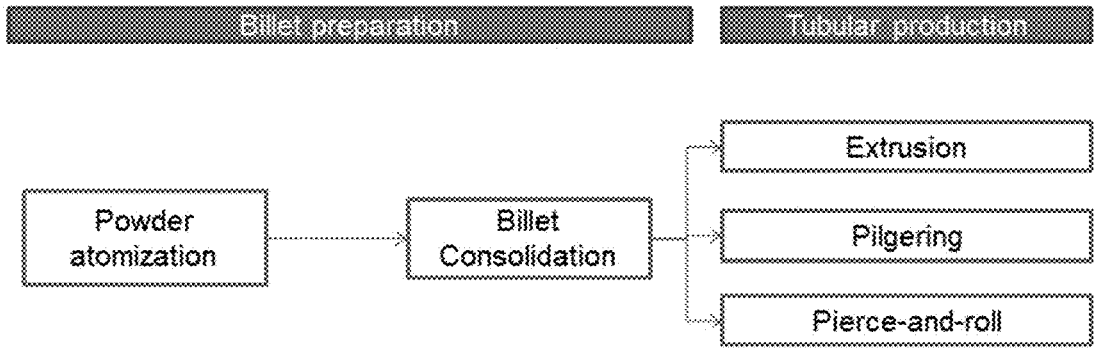
FIG. 2*a* illustrates additional production methods of using powder metallurgy to produce seamless tubular products.

FIG. 2*a* describes additional alternate powder metallurgy approaches to produce seamless pipe. After billet preparation, the billet can be extruded, pilgered or processed through a pierce-and-roll process. The extrusion process was described previously and can be done hot or cold. In the pilgering process, the preform billet, which can be heated up to a target process temperature, is forced through a die which generally results in reduction of both the outside and inner diameters. In the pierce and roll process, seamless pipe is produced in a typical four step process. The heated ingot/billet is first pierced to create room for the insertion of the mandrel and pipe is produced through what has been termed the Mannesman effect. Next a mandrel is inserted which maintains the inner diameter of the tube while it goes through the mandrel mill, which forms the outer diameter through a series of perpendicular orientated pairs of rolling mills. Next the pipe is further reheated and then goes through a stretching/finishing mill where pairs of rollers offset by 120 degrees are utilized to achieve final finishing/tolerances. Afterward, the pipe is often heat treated by various processes to hit the targeted structures and final properties and then is straightened.

New Classes of Steel Alloys

The alloys herein are such that they are capable of formation of what is described as Class 1, Class 2 Steel or Class 3 Steel which are preferably crystalline (non-glassy) with identifiable crystalline grain size morphology. The ability of the alloys to form Class 1, Class 2 or Class 3 Steels herein is described in detail. However, it is useful to first consider a description of the general features of Class 1, Class 2 and Class 3 Steels, which is initially provided below.

Class 1 Steel

Figure 3:
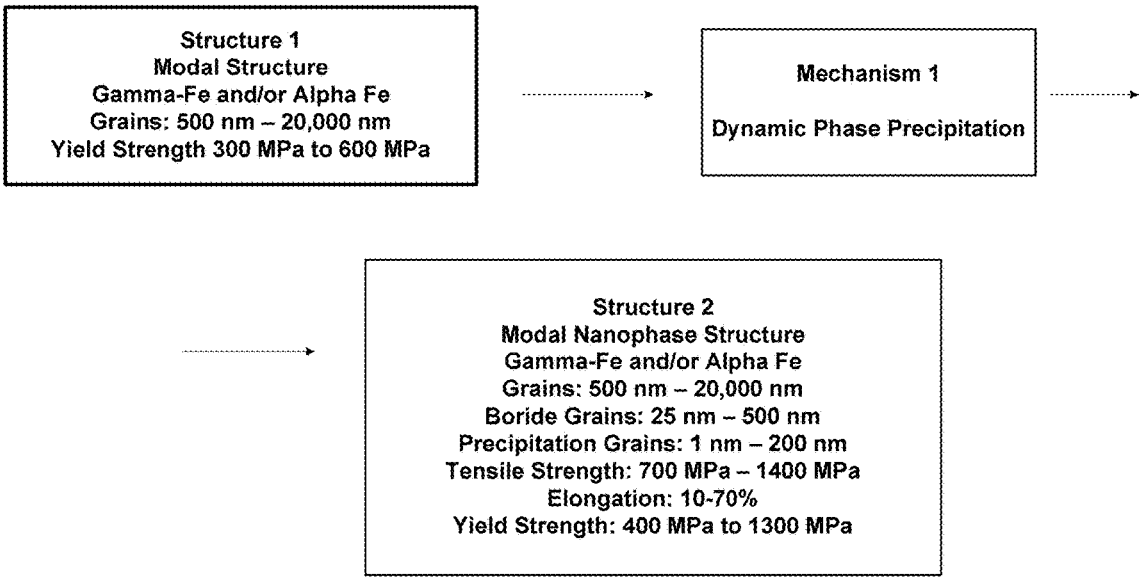
FIG. 3 illustrates structures and mechanisms regarding the formation of Class 1 Steel herein.

The formation of Class 1 Steel herein is illustrated in FIG. 3. As shown therein, a Modal structure is initially formed which modal structure is the result of starting with a liquid melt of the alloy and solidifying by cooling, which provides nucleation and growth of particular phases having particular grain sizes. Reference herein to modal may therefore be understood as a structure having at least two grain size distributions. Grain size herein may be understood as the size of a single crystal of a specific particular phase preferably identifiable by methods such as scanning electron microscopy or transmission electron microscopy. Accordingly, Structure #1 of the Class 1 Steel may be preferably achieved by processing through either laboratory scale procedures and/or through industrial scale methods such as powder atomization or alloy casting.

The Modal Structure of Class 1 Steel will therefore initially indicate, when cooled from the melt, the following grain sizes: (1) matrix grain size of 500 nm to 20,000 nm containing austenite and/or ferrite; (2) boride grain size of 25 nm to 500 nm (i.e. non-metallic grains such as $M_2B$ where M is the metal and is covalently bonded to B). The boride grains may also preferably be "pinning" type phases which is reference to the feature that the matrix grains will effectively be stabilized by the pinning phases which resist coarsening at elevated temperature. Note that the metal boride grains have been identified as exhibiting the $M_2B$ stoichiometry but other stoichiometries are possible and may provide pinning including $M_3B$, MB ($M_1B_1$), $M_{23}B_6$, and $M_7B_3$.

The Modal Structure of Class 1 Steel may be subjected to thermomechanical deformation and/or heat treatment, resulting in some variation in properties, but the Modal Structure may be maintained.

Figure 4:
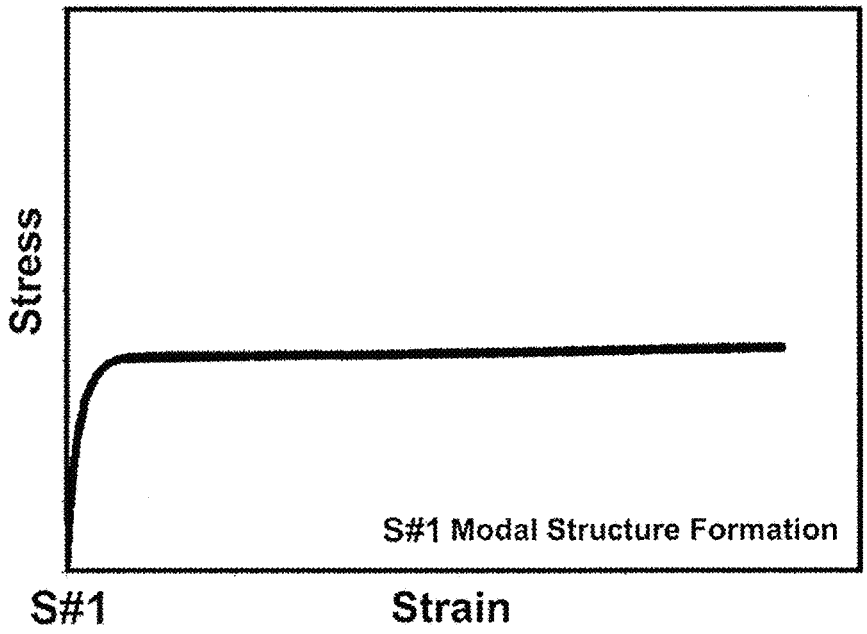
FIG. 4 illustrates a representative stress-strain curve of a material with Modal Structure.

When the Class 1 Steel noted above is exposed to a mechanical stress, the observed stress versus strain diagram is illustrated in FIG. 4. It is therefore observed that the Modal Structure undergoes what is identified as Dynamic Nanophase Precipitation leading to a second type structure for the Class 1 Steel which is Modal Nanophase Structure. Such Dynamic Nanophase Precipitation is therefore triggered when the alloy experiences a yield under stress, and it has been found that the yield strength of Class 1 Steels which undergo Dynamic Nanophase Precipitation may preferably occur at 400 MPa to 1300 MPa. Accordingly, it may be appreciated that Dynamic Nanophase Precipitation occurs due to the application of mechanical stress that exceeds such indicated yield strength. Dynamic Nanophase Precipitation itself may be understood as the formation of a further identifiable phase in the Class 1 Steel which is termed a precipitation phase with an associated grain size. That is, the result of such Dynamic Nanophase Precipitation is to form an alloy which still indicates identifiable matrix grain size of 500 nm to 20,000 nm, boride pinning grain size of 25 nm to 500 nm, along with the formation of precipitation grains which contain hexagonal phases and grains of 1.0 nm to 200 nm. As noted above, the grain sizes therefore do not coarsen when the alloy is stressed, but does lead to the development of the precipitation grains as noted.

Reference to the hexagonal phases may be understood as a dihexagonal pyramidal class hexagonal phase with a $P6_3mc$ space group (#186) and/or a ditrigonal dipyramidal class with a hexagonal P6bar2C space group (#190). In addition, the mechanical properties of such second type structure of the Class 1 Steel are such that the tensile strength is observed to fall in the range of 700 MPa to 1400 MPa, with an elongation of 10-50%. Furthermore, the second type structure of the Class 1 Steel is such that it exhibits a strain hardening coefficient from 0.1 to 0.4 that is nearly flat after undergoing the indicated yield. The strain hardening coefficient is reference to the n-value in the formula $\sigma=K\epsilon^n$, where $\sigma$ represents the applied stress on the material, $\epsilon$ is the strain and K is the strength coefficient. The value of the strain hardening exponent n lies between 0 and 1. A value of 0 means that the alloy is a perfectly plastic solid (i.e. the material undergoes non-reversible changes to applied force), while a value of 1 represents a 100% elastic solid (i.e. the material undergoes reversible changes to an applied force).

Table 1A below provides a comparison and performance summary for Class 1 Steel herein.

TABLE 1A

Comparison of Structure and Performance for Class 1 Steel

| | Class 1 Steel | |
|---|---|---|
| Property/ Mechanism | Structure Type #1 Modal Structure | Structure Type #2 Modal Nanophase Structure |
| Structure Formation | Starting with a liquid melt, solidifying this liquid melt and forming directly | Dynamic Nanophase Precipitation occurring through the application of mechanical stress |
| Transformations | Liquid solidification followed by nucleation and growth | Stress induced transformation involving phase formation and precipitation |
| Enabling Phases | Austenite and/or ferrite with boride pinning | Austenite, optionally ferrite, boride pinning phases, and hexagonal phase(s) precipitation |

TABLE 1A-continued

| Comparison of Structure and Performance for Class 1 Steel | | |
|---|---|---|
| | Class 1 Steel | |
| Property/ Mechanism | Structure Type #1 Modal Structure | Structure Type #2 Modal Nanophase Structure |
| Matrix Grain Size | 500 to 20,000 nm Austenite and/or ferrite | 500 to 20,000 nm Austenite optionally ferrite |
| Boride Grain Size | 25 to 500 nm Non metallic (e.g. metal boride) | 25 to 500 nm Non-metallic (e.g. metal boride) |
| Precipitation Grain Sizes | — | 1 nm to 200 nm Hexagonal phase(s) |
| Tensile Response | Intermediate structure; transforms into Structure #2 when undergoing yield | Actual with properties achieved based on structure type #2 |
| Yield Strength | 300 to 600 MPa | 400 to 1300 MPa |
| Tensile Strength | — | 700 to 1400 MPa |
| Total Elongation | — | 10 to 70% |
| Strain Hardening Response | — | Exhibits a strain hardening coefficient between 0.1 to 0.4 and a strain hardening coefficient as a function of strain which is nearly flat or experiencing a slow increase until failure |

Class 2 Steel

Figure 5:
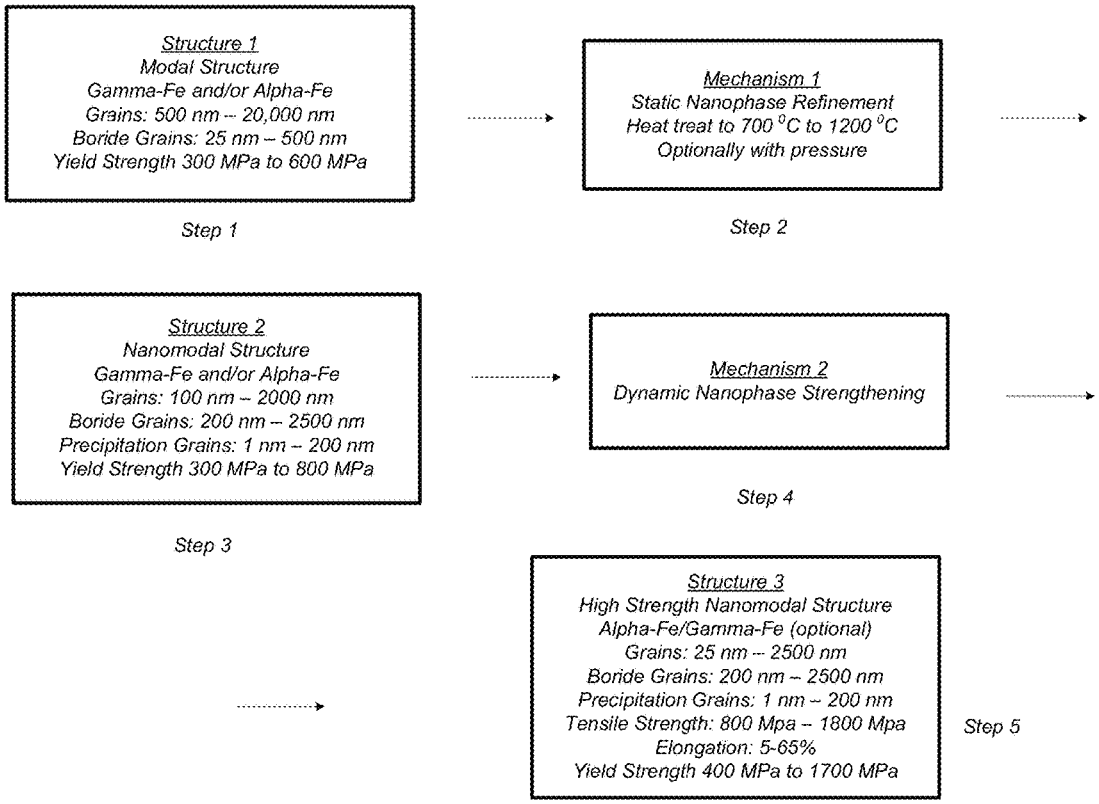
FIG. 5 illustrates structures and mechanism regarding the formation of Class 2 steel alloys herein.

The formation of Class 2 Steel herein is illustrated in FIG. 5. Class 2 steel may also be formed herein from the identified alloys, which involves two new structure types after starting with Structure type #1, Modal Structure, followed by two new mechanisms identified herein as Static Nanophase Refinement and Dynamic Nanophase Strengthening. The new structure types for Class 2 Steel are described herein as Nanomodal Structure and High Strength Nanomodal Structure. Accordingly, Class 2 Steel herein may be characterized as follows: Structure #1—Modal Structure (Step #1), Mechanism #1—Static Nanophase Refinement (Step #2), Structure #2—Nanomodal Structure (Step #3), Mechanism #2—Dynamic Nanophase Strengthening (Step #4), and Structure #3—High Strength Nanomodal Structure (Step #5).

As shown therein, Structure #1 is initially formed in which Modal Structure is the result of starting with a liquid melt of the alloy and solidifying by cooling, which provides nucleation and growth of particular phases having particular grain sizes. Grain size herein may again be understood as the size of a single crystal of a specific particular phase preferably identifiable by methods such as scanning electron microscopy or transmission electron microscopy. Accordingly, Structure #1 of the Class 2 Steel may be preferably achieved by processing through either laboratory scale procedures and/or through industrial scale methods such as powder atomization or alloy casting.

The Modal Structure of Class 2 Steel will therefore initially indicate, when cooled from the melt, the following grain sizes: (1) matrix grain size of 500 nm to 20,000 nm containing austenite and/or ferrite; (2) boride grain size of 25 nm to 500 nm (i.e. non-metallic grains such as $M_2B$ where M is the metal and is covalently bonded to B). The boride grains may also preferably be "pinning" type phases which are referenced to the feature that the matrix grains will effectively be stabilized by the pinning phases which resist coarsening at elevated temperature. Note that the metal boride grains have been identified as exhibiting the $M_2B$ stoichiometry but other stoichiometries are possible and may provide pinning including $M_3B$, MB ($M_1B_1$), $M_{23}B_6$, and $M_7B_3$ and which are unaffected by Mechanisms #1 or #2 noted above). Reference to grain size is again to be understood as the size of a single crystal of a specific particular phase preferably identifiable by methods such as scanning electron microscopy or transmission electron microscopy. Furthermore, Structure #1 of Class 2 steel herein includes austenite and/or ferrite along with such boride phases.

Figure 6:
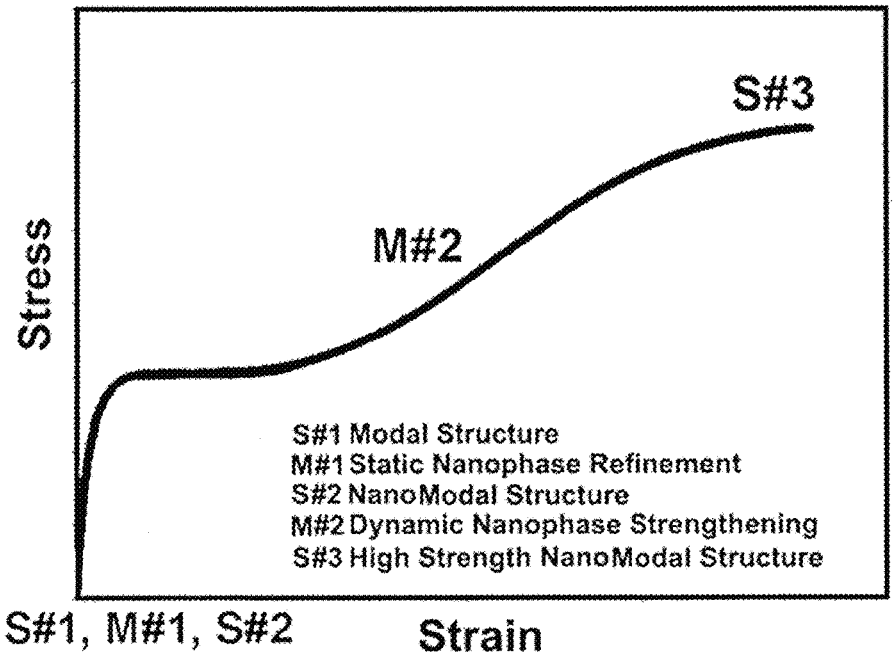
FIG. 6 illustrates a stress-strain curve for the indicated structures and associated mechanisms in Class 2 alloys.

In FIG. 6, a stress strain curve is shown that represents the non-stainless steel alloys herein which undergo a deformation behavior of Class 2 steel. The Modal Structure is preferably first created (Structure #1) and then after the creation, the Modal Structure may now be uniquely refined through Mechanism #1, which is a Static Nanophase Refinement mechanism, leading to Structure #2. Static Nanophase Refinement is reference to the feature that the matrix grain sizes of Structure 1 which initially fall in the range of 500 nm to 20,000 nm are reduced in size to provide Structure 2 which has matrix grain sizes that typically fall in the range of 100 nm to 2000 nm. Note that the boride pinning phase can change size significantly in some alloys, while it is designed to resist matrix grain coarsening during the heat treatments. Due to the presence of these boride pinning sites, the motion of a grain boundaries leading to coarsening would be expected to be retarded by a process called Zener pinning or Zener drag. Thus, while grain growth of the matrix may be energetically favorable due to the reduction of total interfacial area, the presence of the boride pinning phase will counteract this driving force of coarsening due to the high interfacial energies of these phases.

Characteristic of the Static Nanophase Refinement Mechanism #1 in Class 2 steel, the micron scale austenite phase (gamma-Fe) which was noted as falling in the range of 500 nm to 20,000 nm is partially or completely transformed into new phases (e.g. ferrite or alpha-Fe). The volume fraction of ferrite (alpha-iron) initially present in the Modal Structure (Structure 1) of Class 2 steel is 0 to 45%. The volume fraction of ferrite (alpha-iron) in Structure #2 as a result of Static Nanophase Refinement Mechanism #2 is typically from 20 to 80%. The static transformation preferably occurs during elevated temperature heat treatment and thus involves a unique refinement mechanism since grain coarsening rather than grain refinement is the conventional material response at elevated temperature.

Accordingly, grain coarsening does not occur with the alloys of Class 2 Steel herein during the Static Nanophase Refinement mechanism. Structure #2 is uniquely able to transform to Structure #3 during Dynamic Nanophase Strengthening and as a result Structure #3 is formed and indicates tensile strength values in the range from 800 to 1800 MPa with 5 to 65% total elongation.

Depending on alloy chemistries, nano-scale precipitates can form during Static Nanophase Refinement and the subsequent thermal process in some of the non-stainless high-strength steels. The nano-precipitates are in the range of 1 nm to 200 nm, with the majority (>50%) of these phases 10~20 nm in size, which are much smaller than the boride pinning phase formed in Structure #1 for retarding matrix grain coarsening. Also, during Static Nanophase Refinement, the boride grain sizes grow larger to a range from 200 to 2500 nm in size.

Expanding upon the above, in the case of the alloys herein that provide Class 2 Steel, when such alloys exceed their yield point, plastic deformation at constant stress occurs followed by a dynamic phase transformation leading toward the creation of Structure #3. More specifically, after enough strain is induced, an inflection point occurs where the slope of the stress versus strain curve changes and increases (FIG. 6) and the strength increases with strain indicating an activation of Mechanism #2 (Dynamic Nanophase Strengthening).

With further straining during Dynamic Nanophase Strengthening, the strength continues to increase but with a gradual decrease in strain hardening coefficient value up to nearly failure. Some strain softening occurs but only near the breaking point which may be due to reductions in localized cross sectional area at necking. Note that the strengthening transformation that occurs at the material straining under the stress generally defines Mechanism #2 as a dynamic process, leading to Structure #3. By dynamic, it is meant that the process may occur through the application of a stress which exceeds the yield point of the material. The tensile properties that can be achieved for alloys that achieve Structure 3 include tensile strength values in the range from 800 to 1800 MPa and 5 to 65% total elongation. The level of tensile properties achieved is also dependent on the amount of transformation occurring as the strain increases corresponding to the characteristic stress strain curve for a Class 2 steel.

Thus, depending on the level of transformation, tunable yield strength may also now be developed in Class 2 Steel herein depending on the level of deformation and in Structure #3 the yield strength can ultimately vary from 400 MPa to 1700 MPa. That is, conventional steels outside the scope of the alloys here exhibit only relatively low levels of strain hardening, thus their yield strengths can be varied only over small ranges (e.g., 100 to 200 MPa) depending on the prior deformation history. In Class 2 steels herein, the yield strength can be varied over a wide range (e.g. 400 to 1700 MPa) as applied to Structure #2 transformation into Structure #3, allowing tunable variations to enable both the designer and end users in a variety of applications, and utilize Structure #3 in various applications such as crash management in automobile body structures.

With regards to this dynamic mechanism shown in FIG. 5, new and/or additional precipitation phase or phases are observed that indicates identifiable grain sizes of 1 nm to 200 nm. In addition, there is the further identification in said precipitation phase a dihexagonal pyramidal class hexagonal phase with a $P6_3mc$ space group (#186), a ditrigonal dipyramidal class with a hexagonal P6bar2C space group (#190), and/or a $M_3Si$ cubic phase with a Fm3m space group (#225). Accordingly, the dynamic transformation can occur partially or completely and results in the formation of a microstructure with novel nanoscale/near nanoscale phases providing relatively high strength in the material. That is, Structure #3 may be understood as a microstructure having matrix grains sized generally from 100 nm to 2000 nm which are pinned by boride phases which are in the range of 200 to 2500 nm and with precipitate phases which are in the range of 1 nm to 200 nm. The initial formation of the above referenced precipitation phase with grain sizes of 1 nm to 200 nm starts at Static Nanophase Refinement and continues during Dynamic Nanophase Strengthening leading to Structure 3 formation. The volume fraction of the precipitation phase with grain size from 1 nm to 200 nm in Structure 2 increases in Structure 3 and assists with the identified strengthening mechanism. It should also be noted that in Structure 3, the level of gamma-iron is optional and may be eliminated depending on the specific alloy chemistry and austenite stability.

Note that dynamic recrystallization is a known process but differs from Mechanism #2 (FIG. 5) since it involves the formation of large grains from small grains so that it is not a refinement mechanism but a coarsening mechanism. Additionally, as new undeformed grains are replaced by deformed grains no phase changes occur in contrast to the mechanisms presented here and this also results in a corresponding reduction in strength in contrast to the strengthening mechanism here. Note also that metastable austenite in steels is known to transform to martensite under mechanical stress but, preferably, no evidence for martensite or body centered tetragonal iron phases are found in the new steel alloys described in this application. Table 1B below provides a comparison of the structure and performance features of Class 2 Steel herein.

TABLE 1B

Comparison Of Structure and Performance of Class 2 Steel

| | Class 2 Steel | | |
|---|---|---|---|
| Property/ Mechanism | Structure Type #1 Modal Structure | Structure Type #2 Nanomodal Structure | Structure Type #3 High Strength Nanomodal Structure |
| Structure Formation | Starting with a liquid melt, solidifying this liquid melt and forming directly | Static Nanophase Refinement mechanism occurring during heat treatment | Dynamic Nanophase Strengthening mechanism occurring through application of mechanical stress |
| Transformations | Liquid solidification followed by nucleation and growth | Solid state phase transformation of supersaturated gamma iron | Stress induced transformation involving phase formation and precipitation |

TABLE 1B-continued

| Comparison Of Structure and Performance of Class 2 Steel | | | |
|---|---|---|---|
| | Class 2 Steel | | |
| Property/ Mechanism | Structure Type #1 Modal Structure | Structure Type #2 Nanomodal Structure | Structure Type #3 High Strength Nanomodal Structure |
| Enabling Phases | Austenite and/or ferrite with boride pinning phases | Ferrite, austenite, boride pinning phases, and hexagonal phase precipitation | Ferrite, optionally austenite, boride pinning phases, hexagonal and additional phases precipitation |
| Matrix Grain Size | 500 to 20000 nm Austenite | Grain Refinement (100 nm to 2000 nm) Austenite to ferrite and precipitation phase transformation | Grain size remains refined at 100 nm to 2000 nm/ Additional precipitation formation |
| Boride Grain Size | 25 to 500 nm borides (e.g. metal boride) | 200 to 2500 nm borides (e.g. metal boride) | 200 to 2500 nm borides (e.g. metal boride) |
| Precipitation Grain Sizes | — | 1 nm to 200 nm | 1 nm to 200 nm |
| Tensile Response | Actual with properties achieved based on structure type #1 | Intermediate structure; transforms into Structure #3 when undergoing yield | Actual with properties achieved based on formation of structure type #3 and fraction of transformation. |
| Yield Strength | 300 to 600 MPa | 300 to 800 MPa | 400 to 1700 MPa |
| Tensile Strength | — | — | 800 to 1800 MPa |
| Total Elongation | — | — | 5 to 65% |
| Strain Hardening Response | — | After yield point, exhibit a strain softening at initial straining as a result of phase transformation, followed by a significant strain hardening effect leading to a distinct maxima | Strain hardening coefficient may vary from 0.2 to 1.0 depending on amount of deformation and transformation |

Class 3 Steel

Class 3 steel is associated with formation of a High Strength Lamellae Nanomodal Structure through a multi-step process as now described herein.

Figure 7:
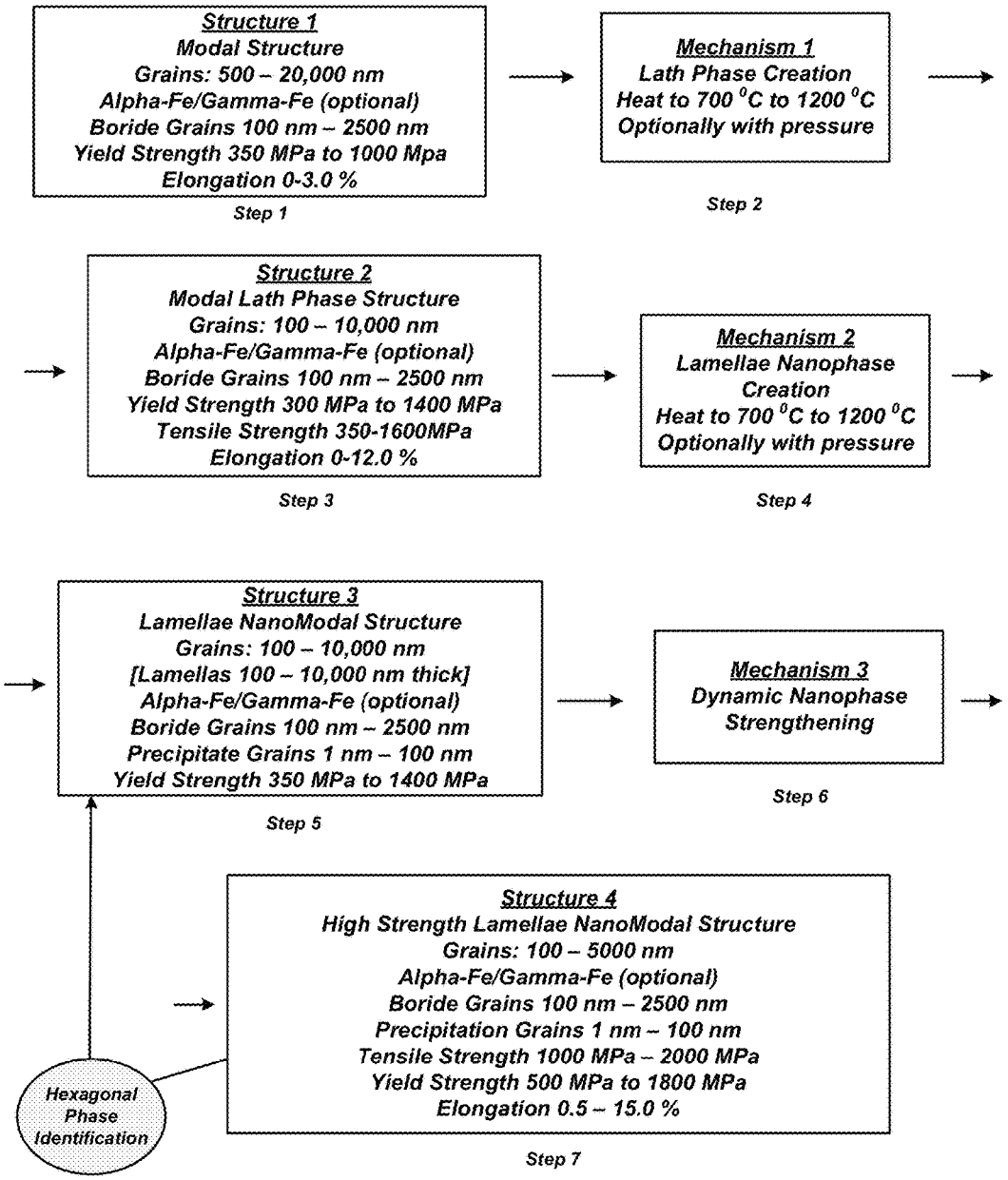
FIG. 7 illustrates structures and mechanism regarding the formation of Class 3 steel alloys herein.

In order to achieve a tensile response involving high strength with adequate ductility in non-stainless carbon-free steel alloys, a preferred seven-step process is now disclosed and shown in FIG. 7. Structure development starts from the Structure #1—Modal Structure (Step #1). However, Mechanism #1 in Class 3 steel is now related to Lath Phase Creation (Step #2) that leads to Structure #2—Modal Lath Phase Structure (Step #3), which through Mechanism #2—Lamellae Nanophase Creation (Step #4) transforms into Structure #3—Lamellae Nanomodal Structure (Step #5). Deformation of Structure #3 results in activation of Mechanism #3—Dynamic Nanophase Strengthening (Step #6) which leads to formation of Structure #4—High Strength Lamellae Nanomodal Structure (Step #7). Reference is also made to Table 1C below.

Structure #1 involving the formation of the Modal Structures (i.e. bi, tri, and higher order) may be achieved in the alloys with the referenced chemistries in this application by processing through the laboratory scale as shown and/or through industrial scale methods involving chill surface processing such as twin roll casting or thin slab casting. The Modal Structure of Class 3 Steel will therefore initially indicate, when cooled from the melt, the following grain sizes: (1) matrix grain size of 500 nm to 20,000 nm containing ferrite or alpha-Fe (required) and optionally austenite or gamma-Fe; and (2) boride grain size of 100 nm to 2500 nm (i.e. non-metallic grains such as $M_2B$ where M is the metal and is covalently bonded to B); (3) yield strengths of 350 to 1000 MPa; (4) tensile strengths of 200 to 1200 MPa; and total elongation of 0-3.0%. It will also indicate dendritic growth morphology of the matrix grains. The boride grains may also preferably be "pinning" type phases which is reference to the feature that the matrix grains will effectively be stabilized by the pinning phases which resist coarsening at elevated temperature. Note that the metal boride grains have been identified as exhibiting the $M_2B$ stoichiometry but other stoichiometries are possible and may provide pinning including $M_3B$, MB ($M_1B_1$), $M_{23}B_6$, and $M_7B_3$ and which are unaffected by Mechanism #1, #2 or #3 noted above). Reference to grain size is again to be understood as the size of a single crystal of a specific particular phase preferably identifiable by methods such as scanning electron microscopy or transmission electron microscopy. Accordingly, Structure #1 of Class 3 steel herein includes ferrite along with such boride phases.

Structure #2 involves the formation of the Modal Lath Phase Structure with uniformly distributed precipitates from Modal Structure (Structure 1) with dendritic morphology though Mechanism #1. Lath phase structure may be generally understood as a structure composed from plate-shaped crystal grains. Reference to "dendritic morphology" may be understood as tree-like and reference to "plate shaped" may be understood as sheet like. Lath structure formation preferably occurs at elevated temperature (e.g. at temperatures of 700° C. to 1200° C.) through plate-like crystal grain formation with: (1) lath structural grain sizes typically from 100 to 10,000 nm; (2) boride grain size of 100 nm to 2,500 nm; (3) yield strengths of 350 MPa to 1400 MPa; (4) tensile strengths of 350 MPa to 1600 MPa; (5) elongation of 0-12%. Structure #2 also contains alpha-Fe and gamma-Fe remains optional.

A second phase of boride precipitates with a size typically from 100 to 1000 nm may be found distributed in the lath matrix as isolated particles. The second phase of boride precipitates may be understood as non-metallic grains of different stoichiometry ($M_2B$, $M_3B$, MB ($M_1B_1$), $M_{23}B_6$, and $M_7B_3$) where M is the metal and is covalently bonded to Boron. These boride precipitates are distinguished from the boride grains in Structure #1 with little or no change in size.

Figure 8:
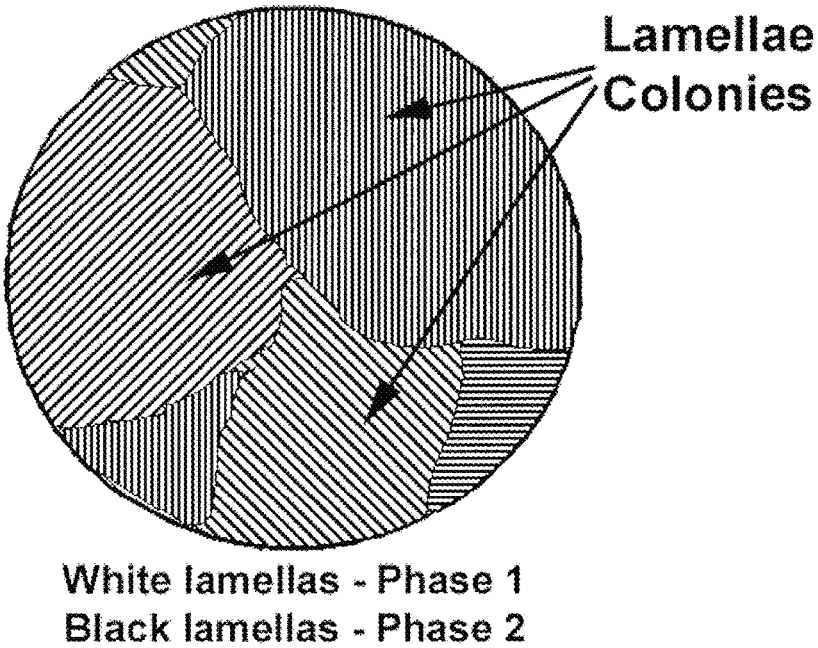
FIG. 8 illustrates a schematic representation of a lamellae structure.

Structure #3 (Lamellae Nanomodal Structure) involves the formation of the lamellae morphology as a result of static transformation of ferrite into one or several phases through Mechanism #2 identified as Lamellae Nanophase Creation. Static transformation is a decomposition of the parent phase into new phase or several new phases due to alloying elements distribution by diffusion during elevated temperature heat treatment, which may preferably occur in the temperature range from 700° C. to 1200° C. Lamellae (or layered) structure is composed of alternating layers of two phases whereby individual lamellae exist within a colony connected in three dimensions. A schematic illustration of lamellae structure is shown in FIG. 8 to illustrate the structural make-up of this structure type. White lamellae are arbitrarily identified as Phase 1 and black lamellas are arbitrarily identified as Phase 2. In Class 3 alloys, Lamellae Nanomodal Structure contains: (1) lamellas of 100 nm to 1000 nm wide with a thickness in the range of 100 nm to 10,000 nm and with a length of 0.1 to 5 microns; (2) boride grains of 100 nm to 2500 nm of different stoichiometry ($M_2B$, $M_3B$, MB ($M_1B_1$), $M_{23}B_6$, and $M_7B_3$) where M is the metal and is covalently bonded to Boron, (3) precipitation grains of 1 nm to 100 nm; (4) yield strength of 350 MPa to 1400 MPa. The Lamellae Nanomodal Structure continues to contain alpha-Fe and gamma-Fe remains optional.

Figure 9:
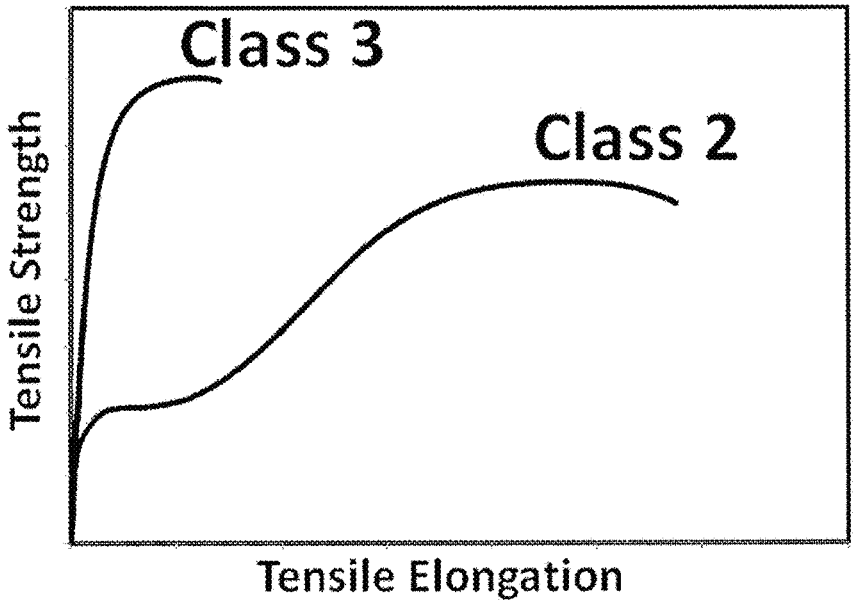
FIG. 9 illustrates mechanical response of Class 3 steel upon tension at room temperature as compared to Class 2 steel.

Lamellae Nanomodal Structure (Structure #3) transforms into Structure #4 through Dynamic Nanophase Strengthening (Mechanism #3, exposure to mechanical stress) during plastic deformation (i.e. exceeding the yield stress for the material) displaying relatively high tensile strengths in the range of 1000 MPa to 2000 MPa. In FIG. 9, a stress-strain curve is shown that represents the alloys with Structure #3 herein which undergo a deformation behavior of Class 3 steel as compared to that of Class 2. As illustrated in FIG. 9, Structure #3, upon application of stress, provides the indicated curve, resulting in Structure #4 of Class 3 steel.

The strengthening during deformation is related to phase transformation that occurs as the material strains under stress and defines Mechanism #3 as a dynamic process. For the alloy to display high strength at the level described in this application, lamellae structure is preferably formed prior to deformation. Specific to this mechanism, the micron scale austenite phase is transformed into new phases with reductions in microstructural feature scales generally down to the nanoscale regime. Some fraction of austenite may initially form in some Class 3 alloys during casting and then may remain present in Structure #1 and Structure #2. During straining when stress is applied, new or additional phases are formed with nanograins typically in a range from 1 to 100 nm.

In the post-deformed Structure #4 (High Strength Lamellae Nanomodal Structure), the ferrite grains contain alternating layers with nanostructure composed from new phases formed during deformation. Depending on the specific chemistry and the stability of the austenite, some austenite may be additionally present. In contrast with layers in Structure #3 where each layer represents a single or just few grains, in Structure #4, a large number of nanograins of different phases are present as a result of Dynamic Nanophase Strengthening. Since nanoscale phase formation occurs during alloy deformation, it represents a stress induced transformation and defined as a dynamic process. Nanoscale phase precipitations during deformation are responsible for extensive strain hardening of the alloys. The dynamic transformation can occur partially or completely and results in the formation of a microstructure with novel nanoscale/near nanoscale phases specified as High Strength Lamellae Nanomodal Structure (Structure #4) that provides high strength in the material. Thus the Structure #4 can be formed with various levels of strengthening depending on specific chemistry and the amount of strengthening achieved by Mechanism #3. Table 1C below provides a comparison of the structure and performance features of Class 3 Steel herein.

TABLE 1C

Comparison of Structure and Performance of New Structure Types

| | Class 3 Steel | | | |
|---|---|---|---|---|
| Property/ Mechanism | Structure Type #1 Modal Structure | Structure Type #2 Modal Lath Phase Structure | Structure Type #3 Lamellae Nanomodal Structure | Structure Type #4 High Strength Lamellae Nanomodal Structure |
| Structure Formation | Starting with a liquid melt, solidifying on a chill surface | As-cast structural homogenization and lath phase formation during high temperature heat treatment optionally with pressure | Lath phase dissolution and Lamellae Nanomodal Structure creation during heat treatment | Nanoprecipitate phase formation and high strength structure formation through application of stress |
| Transformations | Liquid solidification followed by nucleation and growth | Morphology change (dendrites to laths) | Solid state phase transformation of supersaturated alpha iron | Stress induced transformation involving phase formation and precipitation |
| Enabling Phases | Ferrite, optionally austenite with boride pinning phases | Ferrite, optionally austenite with boride pinning phases | Ferrite, optionally austenite, boride, and additional phase precipitations | Ferrite, optionally austenite, boride, and additional phase precipitations |

TABLE 1C-continued

| Comparison of Structure and Performance of New Structure Types | | | | |
|---|---|---|---|---|
| | Class 3 Steel | | | |
| Property/ Mechanism | Structure Type #1 Modal Structure | Structure Type #2 Modal Lath Phase Structure | Structure Type #3 Lamellae Nanomodal Structure | Structure Type #4 High Strength Lamellae Nanomodal Structure |
| Matrix Grain Size | 500 to 20,000 nm | 100 to 10,000 nm | 100 to 10,000 nm thick lamellae, 0.1-5.0 microns in length and 100 nm-1000 nm in width | 100 to 5000 nm, non-uniform grains |
| Boride Grain Size | 100 to 2,500 nm | 100 to 2,500 nm | 100 to 2,500 nm | 100 to 2,500 nm |
| Precipitate Grains | N/A | N/A | 1 to 100 nm | 1 to 100 nm |
| Tensile Response | Actual with properties achieved based on structure type #1 | Actual with properties achieved based on structure type #2 | Intermediate structure; transforms into Structure #4 during tensile testing | Actual with properties achieved based on formation of structure type #3 and fraction of transformation |
| Yield Strength | 350 to 1000 MPa | 300 to 1400 MPa | 350 to 1400 MPa | 500 to 1800 MPa |
| Tensile Strength | 200 to 1200 MPa | 350 to 1600 MPa | — | 1000 to 2000 MPa |
| Total Elongation | 0 to 3% | 0 to 12% | — | 0.5 to 15% |
| Strain Hardening Response | Exhibits limited hardening resulted in low ductility | Strain hardening coefficient may vary from 0.09 to 0.73 depending on alloy chemistry and level of structural formation | After yield point, exhibit a high strain hardening coefficient at initial straining and a strain hardening coefficient as a function of strain which is experiencing a decrease until failure | Strain hardening coefficient may vary from 0.1 to 0.9 depending on amount of deformation and transformation |

Mechanisms During Production

Figure 10:
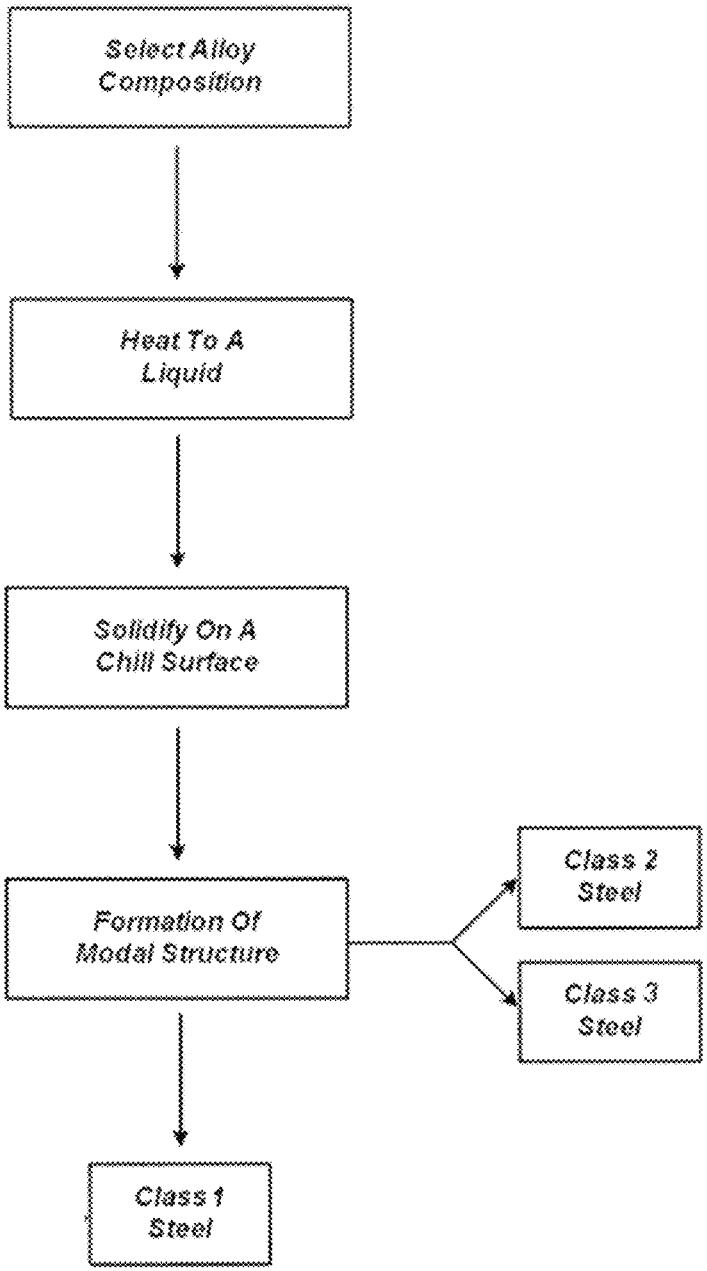
FIG. 10 illustrates a Modal Structure formation as an initial step for Class 1, Class 2 or Class 3 steel development depending of alloy chemistry and thermal mechanical treatment.

The formation of Modal Structure (MS) in either Class 1, Class 2 or Class 3 Steel herein can be made to occur at various stages of the production process. Accordingly, the formation of MS may depend specifically on the solidification sequence and thermal cycles (i.e. temperatures and times) that the alloy is exposed to during the production process. The MS may be preferably formed by heating the alloys herein at temperatures in the range of above their melting point and in a range of 1100° C. to 2000° C. and cooling below the melting temperature of the alloy, which corresponds to preferably cooling in the range of $11\times10^{3}$ to $4\times10^{-2}$ K/s. FIG. 9 illustrates in general that starting with a particular chemical composition for the alloys herein, and heating to a liquid, and solidifying on a chill surface, and forming Modal Structure, one may then convert to either Class 1 Steel, Class 2 Steel or Class 3 Steel as noted herein (FIG. 10).

Subsequent thermal cycles and/or deformation at production including but not limited to HIP consolidation of powder into billets, hot extrusion, hot pressing, forging, as well as, post-production heat treatment will lead to Modal Nanophase structure formation in Class 1 alloys, Nanomodal or High Strength Nanomodal Structure formation in Class 2 alloys, and Lamellae Nanomodal or High Strength Lamellae Nanomodal Structure in Class 3 alloys. Depending on the Class of the alloy, its chemical composition and type of the microstructure formed at the production cycle, tubular products with wide variety of properties can be produced.

EXAMPLES

Preferred Alloy Chemistries and Sample Preparation

The chemical composition of the alloys studied is shown in Table 2 which provides the preferred atomic ratios utilized. In Case Examples below, the processability of the alloys in Table 2 by different technological methods and advanced property combinations can be achieved in the tubular products.

TABLE 2

| Chemical Composition of the Alloys (atomic %) | | | | | | | | | | | | | | | |
|---|---|---|---|---|---|---|---|---|---|---|---|---|---|---|---|
| Alloy | Fe | Cr | Ni | B | Si | W | Mo | Nb | Ti | Al | Cu | V | Zr | Mn | C |
| Alloy 1 | 59.35 | 17.43 | 14.05 | 4.77 | 4.40 | — | — | — | — | — | — | — | — | — | — |
| Alloy 2 | 58.35 | 17.43 | 14.05 | 4.77 | 4.40 | — | — | — | — | — | — | 1.00 | — | — | — |
| Alloy 3 | 54.52 | 17.43 | 14.05 | 7.00 | 7.00 | — | — | — | — | — | — | — | — | — | — |
| Alloy 4 | 53.52 | 17.43 | 14.05 | 7.00 | 5.00 | — | — | — | — | — | — | 3.00 | — | — | — |
| Alloy 5 | 55.52 | 17.43 | 14.05 | 7.00 | 5.00 | — | — | — | — | — | — | — | 1.00 | — | — |
| Alloy 6 | 60.22 | 17.43 | 11.05 | 5.00 | 6.30 | — | — | — | — | — | — | — | — | — | — |
| Alloy 7 | 77.05 | 0.00 | 11.05 | 5.30 | 6.60 | — | — | — | — | — | — | — | — | — | — |
| Alloy 8 | 58.92 | 17.43 | 11.05 | 5.60 | 7.00 | — | — | — | — | — | — | — | — | — | — |
| Alloy 9 | 58.27 | 17.43 | 11.05 | 5.90 | 7.35 | — | — | — | — | — | — | — | — | — | — |
| Alloy 10 | 59.25 | 17.43 | 11.05 | 5.45 | 6.82 | — | — | — | — | — | — | — | — | — | — |

TABLE 2-continued

| Chemical Composition of the Alloys (atomic %) | | | | | | | | | | | | | | | |
|---|---|---|---|---|---|---|---|---|---|---|---|---|---|---|---|
| Alloy | Fe | Cr | Ni | B | Si | W | Mo | Nb | Ti | Al | Cu | V | Zr | Mn | C |
| Alloy 11 | 59.25 | 17.43 | 8.29 | 5.45 | 6.82 | — | — | — | — | — | — | — | — | 2.76 | — |
| Alloy 12 | 61.25 | 15.43 | 5.53 | 5.45 | 6.82 | — | — | — | — | — | — | — | — | 5.52 | — |
| Alloy 13 | 63.62 | 17.43 | 7.05 | 5.30 | 6.60 | — | — | — | — | — | — | — | — | — | — |
| Alloy 14 | 63.22 | 17.43 | 7.05 | 5.00 | 6.30 | 1.00 | — | — | — | — | — | — | — | — | — |
| Alloy 15 | 66.35 | 17.43 | 7.05 | 4.77 | 4.40 | — | — | — | — | — | — | — | — | — | — |
| Alloy 16 | 62.22 | 19.43 | 7.05 | 5.00 | 6.30 | — | — | — | — | — | — | — | — | — | — |
| Alloy 17 | 59.90 | 22.03 | 6.17 | 5.30 | 6.60 | — | — | — | — | — | — | — | — | — | — |
| Alloy 18 | 61.67 | 19.21 | 7.22 | 5.30 | 6.60 | — | — | — | — | — | — | — | — | — | — |
| Alloy 19 | 66.95 | 10.75 | 10.40 | 5.30 | 6.60 | — | — | — | — | — | — | — | — | — | — |
| Alloy 20 | 60.97 | 18.99 | 7.14 | 6.05 | 6.85 | — | — | — | — | — | — | — | — | — | — |
| Alloy 21 | 61.67 | 18.21 | 7.22 | 5.30 | 6.60 | 1.00 | — | — | — | — | — | — | — | — | — |
| Alloy 22 | 61.67 | 18.21 | 7.22 | 5.30 | 6.60 | — | 1.00 | — | — | — | — | — | — | — | — |
| Alloy 23 | 61.67 | 18.21 | 7.22 | 5.30 | 6.60 | — | — | 1.00 | — | — | — | — | — | — | — |
| Alloy 24 | 61.67 | 18.21 | 7.22 | 5.30 | 6.60 | — | — | — | — | — | — | 1.00 | — | — | — |
| Alloy 25 | 61.67 | 19.21 | 6.22 | 5.30 | 6.60 | — | — | — | — | 1.00 | — | — | — | — | — |
| Alloy 26 | 61.67 | 18.21 | 7.22 | 5.30 | 6.60 | — | — | — | 1.00 | | | | | | — |
| Alloy 27 | 61.67 | 19.21 | 6.22 | 5.30 | 6.60 | — | — | — | — | — | 1.00 | — | — | — | — |
| Alloy 28 | 63.08 | 15.95 | 4.54 | 5.30 | 6.60 | — | — | — | — | — | — | — | — | 4.53 | — |
| Alloy 29 | 61.10 | 19.21 | 5.85 | 5.30 | 6.60 | — | — | — | — | — | — | — | — | 1.94 | — |
| Alloy 30 | 62.11 | 20.31 | 4.26 | 5.30 | 6.60 | — | — | — | — | — | — | — | — | 1.42 | — |
| Alloy 31 | 68.70 | 15.00 | 5.00 | 5.00 | 6.30 | — | — | — | — | — | — | — | — | — | — |
| Alloy 32 | 77.05 | — | 11.05 | 5.30 | 6.60 | — | — | — | — | — | — | — | — | — | — |
| Alloy 33 | 68.72 | 7.93 | 11.45 | 5.30 | 6.60 | — | — | — | — | — | — | — | — | — | — |
| Alloy 34 | 61.67 | 19.21 | 7.22 | 5.30 | 6.60 | — | — | — | — | — | — | — | — | — | — |
| Alloy 35 | 76.45 | — | 11.05 | 4.70 | 7.80 | — | — | — | — | — | — | — | — | — | — |
| Alloy 36 | 75.05 | — | 11.05 | 5.30 | 6.60 | — | — | — | — | — | 2.00 | — | — | — | — |
| Alloy 37 | 72.45 | — | 15.05 | 4.70 | 7.80 | — | — | — | — | — | — | — | — | — | — |
| Alloy 38 | 72.45 | — | 13.05 | 4.70 | 7.80 | — | — | — | — | — | 2.00 | — | — | — | — |
| Alloy 39 | 73.05 | — | 7.53 | 5.30 | 6.60 | — | — | — | — | — | — | — | — | 7.52 | — |
| Alloy 40 | 72.45 | — | 7.53 | 4.70 | 7.80 | — | — | — | — | — | — | — | — | 7.52 | — |
| Alloy 41 | 76.45 | — | 8.29 | 4.70 | 7.80 | — | — | — | — | — | — | — | — | 2.76 | — |
| Alloy 42 | 64.42 | 15.99 | 6.24 | 5.30 | 6.60 | — | — | — | — | — | — | — | — | 1.45 | — |
| Alloy 43 | 63.53 | 17.06 | 6.09 | 5.30 | 6.60 | — | — | — | — | — | — | — | — | 1.42 | — |
| Alloy 44 | 62.64 | 18.14 | 5.94 | 5.30 | 6.60 | — | — | — | — | — | — | 1.00 | — | 1.38 | — |
| Alloy 45 | 61.74 | 19.21 | 5.80 | 5.30 | 6.60 | — | — | — | — | — | — | — | — | 1.35 | — |
| Alloy 46 | 62.91 | 16.89 | 6.90 | 5.30 | 6.60 | — | — | — | — | — | — | — | — | 1.40 | — |
| Alloy 47 | 62.02 | 17.96 | 6.75 | 5.30 | 6.60 | — | — | — | — | — | — | 1.00 | — | 1.37 | — |
| Alloy 48 | 61.14 | 19.03 | 6.60 | 5.30 | 6.60 | — | — | — | — | — | — | 3.00 | — | 1.33 | — |
| Alloy 49 | 61.44 | 19.27 | 6.69 | 4.97 | 6.28 | — | — | — | — | — | — | 1.00 | — | 1.35 | — |
| Alloy 50 | 60.95 | 18.89 | 6.55 | 5.44 | 6.85 | — | — | — | — | — | — | — | 1.00 | 1.32 | — |
| Alloy 51 | 64.08 | 15.81 | 6.17 | 5.20 | 7.30 | — | — | — | — | — | — | — | — | 1.44 | |
| Alloy 52 | 76.53 | — | 6.18 | 5.25 | 6.71 | — | — | — | — | — | — | — | — | 5.33 | — |
| Alloy 53 | 72.98 | 3.66 | 6.16 | 5.24 | 6.71 | — | — | — | — | — | — | — | — | 5.25 | — |
| Alloy 54 | 77.23 | 3.66 | 3.52 | 5.23 | 6.73 | — | — | — | — | — | — | | | 3.63 | |
| Alloy 55 | 76.89 | 1.83 | 4.84 | 5.24 | 6.72 | — | — | — | — | — | — | — | — | 4.48 | — |
| Alloy 56 | 80.85 | 0.00 | 2.64 | 5.24 | 6.73 | — | — | — | — | — | — | — | — | 4.54 | — |
| Alloy 57 | 79.42 | 1.47 | 2.64 | 5.23 | 6.73 | — | — | — | — | — | — | — | — | 4.51 | — |
| Alloy 58 | 77.93 | 2.34 | 2.63 | 5.21 | 7.42 | — | — | — | — | — | — | — | — | 4.47 | — |
| Alloy 59 | 77.06 | 2.34 | 3.51 | 5.21 | 7.42 | — | — | — | — | — | — | — | — | 4.46 | — |
| Alloy 60 | 77.13 | 2.18 | 3.50 | 5.80 | 6.95 | — | — | — | — | — | — | — | — | 4.44 | — |
| Alloy 61 | 76.88 | 1.09 | 4.82 | 5.81 | 6.95 | — | — | — | — | — | — | — | — | 4.45 | — |
| Alloy 62 | 76.64 | — | 6.14 | 5.82 | 6.94 | — | — | — | — | — | — | — | — | 4.46 | — |
| Alloy 63 | 74.93 | — | 6.14 | 5.81 | 6.94 | — | — | — | — | — | — | — | — | 6.18 | — |
| Alloy 64 | 73.54 | 5.08 | 2.53 | 5.78 | 6.96 | — | — | — | — | — | — | — | — | 6.11 | — |
| Alloy 65 | 60.74 | 19.43 | 6.60 | 5.30 | 6.60 | — | — | — | — | — | — | — | — | 1.33 | — |
| Alloy 66 | 61.44 | 18.73 | 6.60 | 5.30 | 6.60 | — | — | — | — | — | — | — | — | 1.33 | — |
| Alloy 67 | 60.79 | 19.03 | 6.95 | 5.30 | 6.60 | — | — | — | — | — | — | — | — | 1.33 | — |
| Alloy 68 | 61.49 | 19.03 | 6.25 | 5.30 | 6.60 | — | — | — | — | — | — | — | — | 1.33 | — |
| Alloy 69 | 61.44 | 19.03 | 6.60 | 5.30 | 6.60 | — | — | — | — | — | — | — | — | 1.03 | — |
| Alloy 70 | 60.74 | 19.03 | 6.60 | 5.30 | 6.60 | — | — | — | — | — | — | — | — | 1.73 | — |
| Alloy 71 | 61.64 | 19.03 | 6.60 | 4.80 | 6.60 | — | — | — | — | — | — | — | — | 1.33 | — |
| Alloy 72 | 60.49 | 19.03 | 6.60 | 5.95 | 6.60 | — | — | — | — | — | — | — | — | 1.33 | — |
| Alloy 73 | 61.64 | 19.03 | 6.60 | 5.30 | 6.10 | — | — | — | — | — | — | — | — | 1.33 | — |
| Alloy 74 | 60.74 | 19.03 | 6.60 | 5.30 | 7.00 | — | — | — | — | — | — | — | — | 1.33 | — |
| Alloy 75 | 72.45 | — | 8.29 | 4.70 | 7.80 | — | — | — | — | — | — | — | — | 6.76 | — |
| Alloy 76 | 72.45 | — | 9.79 | 4.70 | 7.80 | — | — | — | — | — | — | — | — | 5.26 | — |
| Alloy 77 | 76.45 | — | 8.29 | 4.70 | 7.80 | — | — | — | — | — | — | — | — | 2.76 | — |
| Alloy 78 | 77.05 | — | 8.29 | 5.30 | 6.60 | — | — | — | — | — | — | — | — | 2.76 | — |
| Alloy 79 | 77.65 | — | 8.29 | 3.50 | 7.80 | — | — | — | — | — | — | — | — | 2.76 | — |
| Alloy 80 | 74.87 | 2.18 | 8.29 | 5.30 | 6.60 | — | — | — | — | — | — | — | — | 2.76 | — |
| Alloy 81 | 74.27 | 2.18 | 8.29 | 4.70 | 7.80 | — | — | — | — | — | — | — | — | 2.76 | — |
| Alloy 82 | 61.30 | 18.90 | 6.80 | 5.50 | 6.60 | — | | | | — | | | | 0.90 | — |
| Alloy 83 | 60.69 | 18.71 | 6.73 | 5.45 | 6.53 | — | — | — | — | — | — | — | — | 0.89 | 1.00 |
| Alloy 84 | 60.08 | 18.52 | 6.66 | 5.39 | 6.47 | — | — | — | — | — | — | — | — | 0.88 | 2.00 |
| Alloy 85 | 61.85 | 18.90 | 6.80 | 5.40 | 6.60 | — | — | — | — | — | — | — | — | 0.45 | — |
| Alloy 86 | 62.30 | 18.90 | 6.80 | 5.40 | 6.60 | — | — | — | — | — | — | — | — | — | — |

TABLE 2-continued

| Chemical Composition of the Alloys (atomic %) | | | | | | | | | | | | | | | |
|---|---|---|---|---|---|---|---|---|---|---|---|---|---|---|---|
| Alloy | Fe | Cr | Ni | B | Si | W | Mo | Nb | Ti | Al | Cu | V | Zr | Mn | C |
| Alloy 87 | 61.00 | 18.90 | 6.80 | 5.80 | 6.60 | — | — | — | — | — | — | — | — | 0.90 | — |
| Alloy 88 | 74.45 | — | 8.29 | 4.70 | 7.80 | — | — | — | — | — | — | — | — | 4.76 | — |
| Alloy 89 | 75.05 | — | 8.29 | 4.10 | 7.80 | — | — | — | — | — | — | — | — | 4.76 | — |
| Alloy 90 | 75.65 | — | 8.29 | 3.50 | 7.80 | — | — | — | — | — | — | — | — | 4.76 | — |
| Alloy 91 | 73.05 | — | 8.29 | 4.10 | 7.80 | — | — | — | — | — | — | — | — | 6.76 | — |
| Alloy 92 | 73.65 | — | 8.29 | 3.50 | 7.80 | — | — | — | — | — | — | — | — | 6.76 | — |
| Alloy 93 | 74.85 | — | 8.29 | 3.50 | 6.60 | — | — | — | — | — | — | — | — | 6.76 | — |
| Alloy 94 | 72.15 | — | 8.59 | 4.70 | 7.80 | — | — | — | — | — | — | — | — | 6.76 | — |
| Alloy 95 | 72.75 | — | 8.59 | 4.10 | 7.80 | — | — | — | — | — | — | — | — | 6.76 | — |
| Alloy 96 | 73.35 | — | 8.59 | 3.50 | 7.80 | — | — | — | — | — | — | — | — | 6.76 | — |
| Alloy 97 | 72.75 | — | 7.99 | 4.70 | 7.80 | — | — | — | — | — | — | — | — | 6.76 | — |
| Alloy 98 | 73.35 | — | 7.99 | 4.10 | 7.80 | — | — | — | — | — | — | — | — | 6.76 | — |
| Alloy 99 | 73.95 | — | 7.99 | 3.50 | 7.80 | — | — | — | — | — | — | — | — | 6.76 | — |
| Alloy 100 | 73.25 | — | 8.29 | 4.70 | 7.00 | — | — | — | — | — | — | — | — | 6.76 | — |
| Alloy 101 | 71.65 | — | 8.29 | 4.70 | 8.60 | — | — | — | — | — | — | — | — | 6.76 | — |
| Alloy 102 | 72.45 | — | 8.29 | 4.70 | 7.80 | — | — | — | — | — | — | — | — | 6.76 | — |
| Alloy 103 | 72.45 | — | 9.79 | 4.70 | 7.80 | — | — | — | — | — | — | — | — | 5.26 | — |
| Alloy 104 | 76.45 | — | 8.29 | 4.70 | 7.80 | — | — | — | — | — | — | — | — | 2.76 | — |
| Alloy 105 | 77.05 | — | 8.29 | 5.30 | 6.60 | — | — | — | — | — | — | — | — | 2.76 | — |
| Alloy 106 | 77.65 | — | 8.29 | 3.50 | 7.80 | — | — | — | — | — | — | — | — | 2.76 | — |
| Alloy 107 | 74.87 | 2.18 | 8.29 | 5.30 | 6.60 | — | — | — | — | — | — | — | — | 2.76 | — |
| Alloy 108 | 74.27 | 2.18 | 8.29 | 4.70 | 7.80 | — | — | — | — | — | — | — | — | 2.76 | — |
| Alloy 109 | 71.75 | — | 8.59 | 4.70 | 7.80 | — | — | — | — | — | — | — | — | 7.16 | — |
| Alloy 110 | 71.35 | — | 8.59 | 4.70 | 7.80 | — | — | — | — | — | — | — | — | 7.56 | — |
| Alloy 111 | 70.95 | — | 8.59 | 4.70 | 7.80 | — | — | — | — | — | — | — | — | 7.96 | — |
| Alloy 112 | 72.15 | — | 8.19 | 4.70 | 7.80 | — | — | — | — | — | — | — | — | 7.16 | — |
| Alloy 113 | 72.15 | — | 7.79 | 4.70 | 7.80 | — | — | — | — | — | — | — | — | 7.56 | — |
| Alloy 114 | 72.15 | — | 7.39 | 4.70 | 7.80 | — | — | — | — | — | — | — | — | 7.96 | — |
| Alloy 115 | 72.55 | — | 8.59 | 4.70 | 7.40 | — | — | — | — | — | — | — | — | 6.76 | — |
| Alloy 116 | 71.75 | — | 8.59 | 5.10 | 7.80 | — | — | — | — | — | — | — | — | 6.76 | — |
| Alloy 117 | 72.15 | — | 8.59 | 5.10 | 7.40 | — | — | — | — | — | — | — | — | 6.76 | — |
| Alloy 118 | 73.15 | — | 8.59 | 4.10 | 7.40 | — | — | — | — | — | — | — | — | 6.76 | — |
| Alloy 119 | 69.52 | 1.79 | 5.28 | 4.78 | 7.35 | — | — | — | — | — | — | — | — | 11.28 | — |
| Alloy 120 | 67.59 | 1.78 | 3.51 | 4.77 | 7.34 | — | — | — | — | — | — | — | — | 15.01 | — |
| Alloy 121 | 65.64 | 1.78 | 1.75 | 4.76 | 7.33 | — | — | — | — | — | — | — | — | 18.74 | — |
| Alloy 122 | 69.85 | 3.37 | 5.27 | 4.77 | 7.35 | — | — | — | — | — | — | — | — | 9.39 | — |
| Alloy 123 | 67.88 | 3.37 | 3.51 | 4.77 | 7.34 | — | — | — | — | — | — | — | — | 13.13 | — |
| Alloy 124 | 65.95 | 3.36 | 1.75 | 4.76 | 7.33 | — | — | — | — | — | — | — | — | 16.85 | — |
| Alloy 125 | 70.15 | 4.96 | 5.27 | 4.77 | 7.34 | — | — | — | — | — | — | — | — | 7.51 | — |
| Alloy 126 | 68.21 | 4.95 | 3.51 | 4.76 | 7.33 | — | — | — | — | — | — | — | — | 11.24 | — |
| Alloy 127 | 66.27 | 4.94 | 1.75 | 4.75 | 7.32 | — | — | — | — | — | — | — | — | 14.97 | — |
| Alloy 128 | 70.46 | 6.54 | 5.27 | 4.76 | 7.34 | — | — | — | — | — | — | — | — | 5.63 | — |
| Alloy 129 | 68.51 | 6.53 | 3.51 | 4.76 | 7.33 | — | — | — | — | — | — | — | — | 9.36 | — |
| Alloy 130 | 66.58 | 6.52 | 1.75 | 4.75 | 7.31 | — | — | — | — | — | — | — | — | 13.09 | — |
| Alloy 131 | 70.78 | 8.12 | 5.26 | 4.76 | 7.33 | — | — | — | — | — | — | — | — | 3.75 | — |
| Alloy 132 | 68.85 | 8.10 | 3.50 | 4.75 | 7.32 | — | — | — | — | — | — | — | — | 7.48 | — |
| Alloy 133 | 66.89 | 8.09 | 1.75 | 4.75 | 7.31 | — | — | — | — | — | — | — | — | 11.21 | — |
| Alloy 134 | 65.86 | 6.93 | 4.82 | 4.76 | 7.33 | — | — | — | — | — | — | — | — | 10.30 | — |
| Alloy 135 | 64.41 | 6.92 | 3.50 | 4.75 | 7.32 | — | — | — | — | — | — | — | — | 13.10 | — |
| Alloy 136 | 62.96 | 6.91 | 2.19 | 4.75 | 7.31 | — | — | — | — | — | — | — | — | 15.88 | — |
| Alloy 137 | 68.70 | 5.94 | 4.83 | 4.76 | 7.33 | — | — | — | — | — | — | — | — | 8.44 | — |
| Alloy 138 | 67.22 | 5.94 | 3.51 | 4.76 | 7.33 | — | — | — | — | — | — | — | — | 11.24 | — |
| Alloy 139 | 65.78 | 5.93 | 2.19 | 4.75 | 7.32 | — | — | — | — | — | — | — | — | 14.03 | — |
| Alloy 140 | 66.77 | 7.91 | 4.82 | 4.76 | 7.32 | — | — | — | — | — | — | — | — | 8.42 | — |
| Alloy 141 | 65.31 | 7.90 | 3.50 | 4.75 | 7.32 | — | — | — | — | — | — | — | — | 11.22 | — |
| Alloy 142 | 63.85 | 7.89 | 2.19 | 4.75 | 7.31 | — | — | — | — | — | — | — | — | 14.01 | — |
| Alloy 143 | 71.53 | 4.96 | 4.83 | 4.77 | 7.34 | — | — | — | — | — | — | — | — | 6.57 | — |
| Alloy 144 | 70.08 | 4.95 | 3.51 | 4.76 | 7.33 | — | — | — | — | — | — | — | — | 9.37 | — |
| Alloy 145 | 68.61 | 4.95 | 2.19 | 4.76 | 7.32 | — | — | — | — | — | — | — | — | 12.17 | — |
| Alloy 146 | 69.60 | 6.93 | 4.82 | 4.76 | 7.33 | — | — | — | — | — | — | — | — | 6.56 | — |
| Alloy 147 | 68.14 | 6.92 | 3.50 | 4.76 | 7.32 | — | — | — | — | — | — | — | — | 9.36 | — |
| Alloy 148 | 66.69 | 6.91 | 2.19 | 4.75 | 7.31 | — | — | — | — | — | — | — | — | 12.15 | — |
| Alloy 149 | 67.65 | 8.90 | 4.82 | 4.76 | 7.32 | — | — | — | — | — | — | — | — | 6.55 | — |
| Alloy 150 | 66.20 | 8.89 | 3.50 | 4.75 | 7.31 | — | — | — | — | — | — | — | — | 9.35 | — |
| Alloy 151 | 64.76 | 8.88 | 2.18 | 4.74 | 7.30 | — | — | — | — | — | — | — | — | 12.14 | — |
| Alloy 152 | 72.42 | 5.95 | 4.83 | 4.77 | 7.34 | — | — | — | — | — | — | — | — | 4.69 | — |
| Alloy 153 | 70.97 | 5.94 | 3.51 | 4.76 | 7.33 | — | — | — | — | — | — | — | — | 7.49 | — |
| Alloy 154 | 69.51 | 5.93 | 2.19 | 4.76 | 7.32 | — | — | — | — | — | — | — | — | 10.29 | — |
| Alloy 155 | 73.33 | 6.93 | 4.83 | 4.76 | 7.34 | — | — | — | — | — | — | — | — | 2.81 | — |
| Alloy 156 | 71.85 | 6.93 | 3.51 | 4.76 | 7.33 | — | — | — | — | — | — | — | — | 5.62 | |
| Alloy 157 | 70.40 | 6.92 | 2.19 | 4.75 | 7.32 | — | — | — | — | — | — | — | — | 8.42 | — |
| Alloy 158 | 59.35 | 18.87 | 5.06 | 5.51 | 6.60 | — | — | — | — | — | — | — | — | 4.61 | — |
| Alloy 159 | 57.45 | 18.84 | 3.32 | 5.50 | 6.59 | — | — | — | — | — | — | — | — | 8.30 | — |
| Alloy 160 | 55.56 | 18.81 | 1.58 | 5.49 | 6.58 | — | — | — | — | — | — | — | — | 11.98 | — |
| Alloy 161 | 60.70 | 12.70 | 4.94 | 5.39 | 11.77 | — | — | — | — | — | — | — | — | 4.50 | — |
| Alloy 162 | 58.84 | 12.68 | 3.24 | 5.38 | 11.75 | — | — | — | — | — | — | — | — | 8.11 | — |

TABLE 2-continued

| Chemical Composition of the Alloys (atomic %) | | | | | | | | | | | | | | | |
|---|---|---|---|---|---|---|---|---|---|---|---|---|---|---|---|
| Alloy | Fe | Cr | Ni | B | Si | W | Mo | Nb | Ti | Al | Cu | V | Zr | Mn | C |
| Alloy 163 | 56.98 | 12.66 | 1.55 | 5.37 | 11.73 | — | — | — | — | — | — | — | — | 11.71 | — |
| Alloy 164 | 65.10 | 13.05 | 5.08 | 5.53 | 6.62 | — | — | — | — | — | — | — | — | 4.62 | — |
| Alloy 165 | 63.18 | 13.03 | 3.33 | 5.52 | 6.61 | — | — | — | — | — | — | — | — | 8.33 | — |
| Alloy 166 | 61.24 | 13.01 | 1.59 | 5.52 | 6.61 | — | — | — | — | — | — | — | — | 12.03 | — |
| Alloy 167 | 67.21 | 4.95 | 3.51 | 5.76 | 7.33 | — | — | — | — | — | — | — | — | 11.24 | — |
| Alloy 168 | 69.21 | 4.95 | 3.51 | 3.76 | 7.33 | — | — | — | — | — | — | — | — | 11.24 | — |
| Alloy 169 | 69.21 | 4.95 | 3.51 | 4.76 | 6.33 | — | — | — | — | — | — | — | — | 11.24 | — |
| Alloy 170 | 70.21 | 4.95 | 3.51 | 3.76 | 6.33 | — | — | — | — | — | — | — | — | 11.24 | — |
| Alloy 171 | 69.66 | 3.50 | 3.51 | 4.76 | 7.33 | — | — | — | — | — | — | — | — | 11.24 | — |
| Alloy 172 | 66.21 | 4.95 | 3.51 | 4.76 | 7.33 | — | — | — | — | — | 2.00 | — | — | 11.24 | — |
| Alloy 173 | 66.71 | 4.95 | 3.51 | 4.76 | 7.33 | — | — | — | — | — | — | — | — | 11.24 | 1.50 |
| Alloy 174 | 66.65 | 8.90 | 4.82 | 5.76 | 7.32 | — | — | — | — | — | — | — | — | 6.55 | — |
| Alloy 175 | 68.65 | 8.90 | 4.82 | 3.76 | 7.32 | — | — | — | — | — | — | — | — | 6.55 | — |
| Alloy 176 | 68.65 | 8.90 | 4.82 | 4.76 | 6.32 | — | — | — | — | — | — | — | — | 6.55 | — |
| Alloy 177 | 69.65 | 8.90 | 4.82 | 3.76 | 6.32 | — | — | — | — | — | — | — | — | 6.55 | — |
| Alloy 178 | 71.60 | 4.95 | 4.82 | 4.76 | 7.32 | — | — | — | — | — | — | — | — | 6.55 | — |
| Alloy 179 | 73.05 | 3.50 | 4.82 | 4.76 | 7.32 | — | — | — | — | — | — | — | — | 6.55 | — |
| Alloy 180 | 65.65 | 8.90 | 4.82 | 4.76 | 7.32 | — | — | — | — | — | 2.00 | — | — | 6.55 | — |
| Alloy 181 | 66.15 | 8.90 | 4.82 | 4.76 | 7.32 | — | — | — | — | — | — | — | — | 6.55 | 1.50 |
| Alloy 182 | 67.73 | 4.95 | 3.51 | 4.76 | 7.33 | — | — | — | — | — | 2.00 | — | — | 9.72 | — |
| Alloy 183 | 65.21 | 4.95 | 3.51 | 4.76 | 7.33 | — | — | — | — | — | 3.00 | — | — | 11.24 | — |
| Alloy 184 | 67.49 | 4.95 | 3.51 | 4.76 | 7.33 | — | — | — | — | — | 3.00 | — | — | 8.96 | — |
| Alloy 185 | 70.32 | 4.95 | 4.10 | 4.76 | 7.32 | — | — | — | — | — | 2.00 | — | — | 6.55 | — |
| Alloy 186 | 68.60 | 4.95 | 4.82 | 4.76 | 7.32 | — | — | — | — | — | 3.00 | — | — | 6.55 | — |
| Alloy 187 | 69.68 | 4.95 | 3.74 | 4.76 | 7.32 | — | — | — | — | — | 3.00 | — | — | 6.55 | — |
| Alloy 188 | 68.73 | 4.95 | 3.51 | 3.76 | 7.33 | — | — | — | — | — | 2.00 | — | — | 9.72 | — |
| Alloy 189 | 66.21 | 4.95 | 3.51 | 3.76 | 7.33 | — | — | — | — | — | 3.00 | — | — | 11.24 | — |
| Alloy 190 | 68.49 | 4.95 | 3.51 | 3.76 | 7.33 | — | — | — | — | — | 3.00 | — | — | 8.96 | — |
| Alloy 191 | 71.32 | 4.95 | 4.10 | 3.76 | 7.32 | — | — | — | — | — | 2.00 | — | — | 6.55 | — |
| Alloy 192 | 69.60 | 4.95 | 4.82 | 3.76 | 7.32 | — | — | — | — | — | 3.00 | — | — | 6.55 | — |
| Alloy 193 | 70.68 | 4.95 | 3.74 | 3.76 | 7.32 | — | — | — | — | — | 3.00 | — | — | 6.55 | — |
| Alloy 194 | 67.21 | 4.95 | 3.51 | 3.76 | 7.33 | — | — | — | — | — | 2.00 | — | — | 11.24 | — |
| Alloy 195 | 71.32 | 4.95 | 4.10 | 3.76 | 7.32 | — | — | — | — | — | 2.00 | — | — | 6.55 | — |
| Alloy 196 | 69.60 | 4.95 | 4.82 | 3.76 | 7.32 | — | — | — | — | — | 3.00 | — | — | 6.55 | — |
| Alloy 197 | 70.68 | 4.95 | 3.74 | 3.76 | 7.32 | — | — | — | — | — | 3.00 | — | — | 6.55 | — |
| Alloy 198 | 71.82 | 4.95 | 4.10 | 3.26 | 7.32 | — | — | — | — | — | 2.00 | — | — | 6.55 | — |
| Alloy 199 | 70.10 | 4.95 | 4.82 | 3.26 | 7.32 | — | — | — | — | — | 3.00 | — | — | 6.55 | — |
| Alloy 200 | 71.18 | 4.95 | 3.74 | 3.26 | 7.32 | — | — | — | — | — | 3.00 | — | — | 6.55 | — |
| Alloy 201 | 72.32 | 4.95 | 4.10 | 2.76 | 7.32 | — | — | — | — | — | 2.00 | — | — | 6.55 | — |
| Alloy 202 | 70.60 | 4.95 | 4.82 | 2.76 | 7.32 | — | — | — | — | — | 3.00 | — | — | 6.55 | — |
| Alloy 203 | 71.68 | 4.95 | 3.74 | 2.76 | 7.32 | — | — | — | — | — | 3.00 | — | — | 6.55 | — |
| Alloy 204 | 72.82 | 3.45 | 4.10 | 3.76 | 7.32 | — | — | — | — | — | 2.00 | — | — | 6.55 | — |
| Alloy 205 | 71.10 | 3.45 | 4.82 | 3.76 | 7.32 | — | — | — | — | — | 3.00 | — | — | 6.55 | — |
| Alloy 206 | 72.18 | 3.45 | 3.74 | 3.76 | 7.32 | — | — | — | — | — | 3.00 | — | — | 6.55 | — |
| Alloy 207 | 70.32 | 4.95 | 4.10 | 3.76 | 7.32 | — | — | — | — | — | 3.00 | — | — | 6.55 | — |
| Alloy 208 | 71.82 | 4.95 | 4.10 | 3.76 | 7.32 | — | — | — | — | — | 1.50 | — | — | 6.55 | — |
| Alloy 209 | 71.10 | 4.95 | 4.82 | 3.76 | 7.32 | — | — | — | — | — | 1.50 | — | — | 6.55 | — |
| Alloy 210 | 72.18 | 4.95 | 3.74 | 3.76 | 7.32 | — | — | — | — | — | 1.50 | — | — | 6.55 | — |
| Alloy 211 | 71.82 | 4.95 | 4.10 | 3.76 | 7.32 | — | — | — | — | — | 2.00 | — | — | 6.05 | — |
| Alloy 212 | 72.32 | 4.95 | 4.10 | 3.76 | 7.32 | — | — | — | — | — | 2.00 | — | — | 5.55 | — |
| Alloy 213 | 71.62 | 4.95 | 4.10 | 3.76 | 7.02 | — | — | — | — | — | 2.00 | — | — | 6.55 | — |
| Alloy 214 | 71.92 | 4.95 | 4.10 | 3.76 | 6.72 | — | — | — | — | — | 2.00 | — | — | 6.55 | — |
| Alloy 215 | 72.12 | 4.95 | 4.10 | 3.76 | 7.02 | — | — | — | — | — | 2.00 | — | — | 6.05 | — |
| Alloy 216 | 60.47 | 19.43 | 6.60 | 5.29 | 6.60 | — | — | — | — | — | 0.28 | — | — | 1.33 | — |
| Alloy 217 | 69.62 | 4.95 | 2.10 | 3.76 | 7.02 | — | — | — | — | — | 2.00 | — | — | 10.55 | — |
| Alloy 218 | 70.62 | 4.95 | 2.10 | 3.76 | 7.02 | — | — | — | — | — | 2.00 | — | — | 9.55 | — |
| Alloy 219 | 71.62 | 4.95 | 2.10 | 3.76 | 7.02 | — | — | — | — | — | 2.00 | — | — | 8.55 | — |
| Alloy 220 | 72.62 | 4.95 | 2.10 | 3.76 | 7.02 | — | — | — | — | — | 2.00 | — | — | 7.55 | — |
| Alloy 221 | 69.62 | 4.95 | 2.10 | 3.76 | 7.02 | — | — | — | — | — | 6.00 | — | — | 6.55 | — |
| Alloy 222 | 70.62 | 4.95 | 2.10 | 3.76 | 7.02 | — | — | — | — | — | 5.00 | — | — | 6.55 | — |
| Alloy 223 | 71.62 | 4.95 | 2.10 | 3.76 | 7.02 | — | — | — | — | — | 4.00 | — | — | 6.55 | — |
| Alloy 224 | 72.62 | 4.95 | 2.10 | 3.76 | 7.02 | — | — | — | — | — | 3.00 | — | — | 6.55 | — |
| Alloy 225 | 69.62 | 6.95 | 2.10 | 3.76 | 7.02 | — | — | — | — | — | 2.00 | — | — | 8.55 | — |
| Alloy 226 | 73.62 | 2.95 | 2.10 | 3.76 | 7.02 | — | — | — | — | — | 2.00 | — | — | 8.55 | — |
| Alloy 227 | 71.12 | 4.95 | 2.60 | 3.76 | 7.02 | — | — | — | — | — | 2.00 | — | — | 8.55 | — |
| Alloy 228 | 72.12 | 4.95 | 1.60 | 3.76 | 7.02 | — | — | — | — | — | 2.00 | — | — | 8.55 | — |
| Alloy 229 | 71.12 | 4.95 | 2.10 | 4.26 | 7.02 | — | — | — | — | — | 2.00 | — | — | 8.55 | — |
| Alloy 230 | 72.12 | 4.95 | 2.10 | 3.26 | 7.02 | — | — | — | — | — | 2.00 | — | — | 8.55 | — |
| Alloy 231 | 70.92 | 4.95 | 2.10 | 3.76 | 7.72 | — | — | — | — | — | 2.00 | — | — | 8.55 | — |
| Alloy 232 | 72.32 | 4.95 | 2.10 | 3.76 | 6.32 | — | — | — | — | — | 2.00 | — | — | 8.55 | — |
| Alloy 233 | 71.12 | 4.95 | 2.10 | 3.76 | 7.02 | — | — | — | — | — | 2.50 | — | — | 8.55 | — |
| Alloy 234 | 72.12 | 4.95 | 2.10 | 3.76 | 7.02 | — | — | — | — | — | 1.50 | — | — | 8.55 | — |
| Alloy 235 | 70.12 | 4.95 | 1.60 | 3.76 | 7.02 | — | — | — | — | — | 2.00 | — | — | 10.55 | — |
| Alloy 236 | 70.62 | 4.95 | 1.10 | 3.76 | 7.02 | — | — | — | — | — | 2.00 | — | — | 10.55 | — |
| Alloy 237 | 66.62 | 7.95 | 2.10 | 3.76 | 7.02 | — | — | — | — | — | 2.00 | — | — | 10.55 | — |
| Alloy 238 | 68.12 | 6.45 | 2.10 | 3.76 | 7.02 | — | — | — | — | — | 2.00 | — | — | 10.55 | — |

TABLE 2-continued

| Chemical Composition of the Alloys (atomic %) | | | | | | | | | | | | | | | |
|---|---|---|---|---|---|---|---|---|---|---|---|---|---|---|---|
| Alloy | Fe | Cr | Ni | B | Si | W | Mo | Nb | Ti | Al | Cu | V | Zr | Mn | C |
| Alloy 239 | 68.22 | 4.95 | 2.10 | 3.76 | 8.42 | — | — | — | — | — | 2.00 | — | — | 10.55 | — |
| Alloy 240 | 68.92 | 4.95 | 2.10 | 3.76 | 7.72 | — | — | — | — | — | 2.00 | — | — | 10.55 | — |
| Alloy 241 | 68.62 | 4.95 | 2.10 | 3.76 | 7.02 | — | — | — | — | — | 3.00 | — | — | 10.55 | — |
| Alloy 242 | 70.62 | 4.95 | 2.10 | 3.76 | 7.02 | — | — | — | — | — | 1.00 | — | — | 10.55 | — |
| Alloy 243 | 69.12 | 4.95 | 1.60 | 3.76 | 7.02 | — | — | — | — | — | 3.00 | — | — | 10.55 | — |
| Alloy 244 | 69.62 | 4.95 | 1.10 | 3.76 | 7.02 | — | — | — | — | — | 3.00 | — | — | 10.55 | — |
| Alloy 245 | 59.97 | 7.36 | — | 5.43 | 6.80 | — | — | — | — | — | | — | — | 20.44 | — |
| Alloy 246 | 60.80 | 3.63 | — | 5.35 | 10.07 | — | — | — | — | — | | — | — | 20.15 | — |
| Alloy 247 | 61.60 | 0.00 | — | 5.28 | 13.25 | — | — | — | — | — | | — | — | 19.87 | — |
| Alloy 248 | 61.87 | 5.41 | — | 5.44 | 6.81 | — | — | — | — | — | | — | — | 20.47 | — |
| Alloy 249 | 62.48 | 2.67 | — | 5.38 | 9.22 | — | — | — | — | — | | — | — | 20.25 | — |
| Alloy 250 | 63.02 | 0.00 | — | 5.32 | 11.62 | — | — | — | — | — | — | — | — | 20.04 | — |
| Alloy 251 | 63.79 | 3.45 | — | 5.44 | 6.82 | — | — | — | — | — | — | — | — | 20.50 | — |
| Alloy 252 | 64.19 | 1.71 | — | 5.41 | 8.33 | — | — | — | — | — | — | — | — | 20.36 | — |
| Alloy 253 | 64.49 | 0.00 | — | 5.37 | 9.92 | — | — | — | — | — | — | — | — | 20.22 | — |
| Alloy 254 | 63.67 | 7.37 | — | 5.43 | 6.80 | — | — | — | — | — | — | — | — | 16.73 | — |
| Alloy 255 | 64.44 | 3.63 | — | 5.36 | 10.07 | — | — | — | — | — | — | — | — | 16.50 | — |
| Alloy 256 | 65.20 | 0.00 | — | 5.28 | 13.26 | — | — | — | — | — | — | — | — | 16.26 | — |
| Alloy 257 | 65.58 | 5.41 | — | 5.44 | 6.81 | — | — | — | — | — | — | — | — | 16.76 | — |
| Alloy 258 | 66.13 | 2.68 | — | 5.38 | 9.23 | — | — | — | — | — | — | — | — | 16.58 | — |
| Alloy 259 | 66.64 | — | — | 5.33 | 11.62 | — | — | — | — | — | — | — | — | 16.41 | — |
| Alloy 260 | 67.50 | 3.45 | — | 5.45 | 6.82 | — | — | — | — | — | — | — | — | 16.78 | — |
| Alloy 261 | 67.88 | 1.71 | — | 5.41 | 8.33 | — | — | — | — | — | — | — | — | 16.67 | — |
| Alloy 262 | 68.15 | — | — | 5.37 | 9.93 | — | — | — | — | — | — | — | — | 16.55 | — |
| Alloy 263 | 67.36 | 7.37 | — | 5.44 | 6.81 | — | — | — | — | — | — | — | — | 13.02 | — |
| Alloy 264 | 68.09 | 3.63 | — | 5.36 | 10.08 | — | — | — | — | — | — | — | — | 12.84 | — |
| Alloy 265 | 68.80 | — | — | 5.28 | 13.26 | — | — | — | — | — | — | — | — | 12.66 | — |
| Alloy 266 | 69.30 | 5.41 | — | 5.44 | 6.81 | — | — | — | — | — | — | — | — | 13.04 | — |
| Alloy 267 | 69.80 | 2.68 | — | 5.39 | 9.23 | — | — | — | — | — | — | — | — | 12.90 | — |
| Alloy 268 | 70.27 | — | — | 5.33 | 11.63 | — | — | — | — | — | — | — | — | 12.77 | — |
| Alloy 269 | 71.22 | 3.45 | — | 5.45 | 6.82 | — | — | — | — | — | — | — | — | 13.06 | — |
| Alloy 270 | 71.56 | 1.71 | — | 5.42 | 8.34 | — | — | — | — | — | — | — | — | 12.97 | — |
| Alloy 271 | 71.81 | — | — | 5.38 | 9.93 | — | — | — | — | — | — | — | — | 12.88 | — |
| Alloy 272 | 59.70 | 18.00 | 6.80 | 5.50 | 6.60 | — | 2.50 | — | — | — | — | — | — | 0.90 | — |
| Alloy 273 | 57.20 | 21.00 | 6.80 | 5.50 | 6.60 | — | 2.00 | — | — | — | — | — | — | 0.90 | — |
| Alloy 274 | 55.20 | 23.50 | 6.80 | 5.50 | 6.60 | — | 1.50 | — | — | — | — | — | — | 0.90 | — |
| Alloy 275 | 53.20 | 26.00 | 6.80 | 5.50 | 6.60 | — | 1.00 | — | — | — | — | — | — | 0.90 | — |
| Alloy 276 | 50.70 | 29.00 | 6.80 | 5.50 | 6.60 | — | 0.50 | — | — | — | — | — | — | 0.90 | — |
| Alloy 277 | 48.20 | 32.00 | 6.80 | 5.50 | 6.60 | — | — | — | — | — | — | — | — | 0.90 | — |
| Alloy 278 | 67.36 | 10.70 | 1.25 | 5.00 | 4.13 | — | — | — | — | — | 1.00 | — | — | 10.56 | — |
| Alloy 279 | 67.90 | 10.80 | 0.80 | 5.00 | 4.13 | — | — | — | — | — | 1.25 | — | — | 10.12 | — |
| Alloy 280 | 78.06 | — | 1.25 | 5.00 | 4.13 | — | — | — | — | — | 1.00 | — | — | 10.56 | — |
| Alloy 281 | 78.31 | — | 1.00 | 5.00 | 4.13 | — | — | — | — | — | 1.00 | — | — | 10.56 | — |
| Alloy 282 | 78.56 | — | 0.75 | 5.00 | 4.13 | — | — | — | — | — | 1.00 | — | — | 10.56 | — |
| Alloy 283 | 78.81 | — | 0.50 | 5.00 | 4.13 | — | — | — | — | — | 1.00 | — | — | 10.56 | — |
| Alloy 284 | 77.69 | — | — | 5.00 | 4.13 | — | — | — | — | — | — | — | — | 13.18 | — |
| Alloy 285 | 78.07 | — | — | 5.00 | 4.13 | — | — | — | — | — | — | — | — | 12.80 | — |
| Alloy 286 | 78.43 | — | — | 5.00 | 4.13 | — | — | — | — | — | — | — | — | 12.44 | — |
| Alloy 287 | 78.81 | — | — | 5.00 | 4.13 | — | — | — | — | — | — | — | — | 12.06 | — |
| Alloy 288 | 74.69 | 3.00 | — | 5.00 | 4.13 | — | — | — | — | — | — | — | — | 13.18 | — |
| Alloy 289 | 75.07 | 3.00 | — | 5.00 | 4.13 | — | — | — | — | — | — | — | — | 12.80 | |
| Alloy 290 | 75.43 | 3.00 | — | 5.00 | 4.13 | — | — | — | — | — | — | — | — | 12.44 | |
| Alloy 291 | 75.81 | 3.00 | — | 5.00 | 4.13 | — | — | — | — | — | — | — | — | 12.06 | |
| Alloy 292 | 68.36 | 10.70 | 1.25 | 4.00 | 4.13 | — | — | — | — | — | 1.00 | — | — | 10.56 | |
| Alloy 293 | 69.36 | 10.70 | 1.25 | 3.00 | 4.13 | — | — | — | — | — | 1.00 | — | — | 10.56 | |
| Alloy 294 | 67.36 | 10.70 | 1.25 | 4.00 | 5.13 | — | — | — | — | — | 1.00 | — | — | 10.56 | |
| Alloy 295 | 67.36 | 10.70 | 1.25 | 3.00 | 6.13 | — | — | — | — | — | 1.00 | — | — | 10.56 | |
| Alloy 296 | 76.06 | — | 1.25 | 5.00 | 4.13 | — | — | — | — | — | 1.00 | — | — | 12.56 | |
| Alloy 297 | 75.69 | — | — | 5.00 | 4.13 | — | — | — | — | — | — | — | — | 15.18 | |
| Alloy 298 | 73.69 | 3.00 | — | 5.00 | 5.13 | — | — | — | — | — | — | — | — | 13.18 | |
| Alloy 299 | 74.69 | 3.00 | — | 4.00 | 5.13 | — | — | — | — | — | — | — | — | 13.18 | |
| Alloy 300 | 73.69 | 3.00 | — | 4.00 | 6.13 | — | — | — | — | — | — | — | — | 13.18 | |
| Alloy 301 | 74.69 | 3.00 | — | 3.00 | 6.13 | — | — | — | — | — | — | — | — | 13.18 | |
| Alloy 302 | 80.07 | — | — | 3.00 | 4.13 | — | — | — | — | — | — | — | — | 12.80 | |
| Alloy 303 | 78.07 | — | — | 3.00 | 6.13 | — | — | — | — | — | — | — | — | 12.80 | |
| Alloy 304 | 73.06 | 7.00 | 1.25 | 3.00 | 4.13 | — | — | — | — | — | 1.00 | — | — | 10.56 | |
| Alloy 305 | 76.56 | 3.50 | 1.25 | 3.00 | 4.13 | — | — | — | — | — | 1.00 | — | — | 10.56 | |
| Alloy 306 | 80.06 | — | 1.25 | 3.00 | 4.13 | — | — | — | — | — | 1.00 | — | — | 10.56 | |
| Alloy 307 | 83.02 | — | 1.22 | 1.55 | 4.13 | — | — | — | — | — | 0.75 | — | — | 9.33 | — |
| Alloy 308 | 73.25 | — | 2.27 | 3.67 | 8.55 | — | — | — | — | — | 1.30 | — | — | 10.24 | 0.72 |
| Alloy 309 | 74.99 | 2.13 | 4.38 | 1.94 | 2.13 | — | — | — | — | — | 1.55 | — | — | 11.84 | 1.04 |
| Alloy 310 | 67.63 | 6.22 | 8.55 | 2.52 | 4.13 | — | — | — | — | — | 0.90 | — | — | 6.49 | 3.56 |
| Alloy 311 | 66.90 | 7.88 | 5.52 | 5.65 | 4.13 | — | — | — | — | — | 2.56 | — | — | 4.76 | 2.60 |
| Alloy 312 | 66.00 | 11.30 | 0.77 | 7.88 | 1.20 | — | — | — | — | — | 3.55 | — | — | 9.30 | — |
| Alloy 313 | 87.05 | — | 4.58 | 3.05 | 3.07 | — | — | — | — | — | 0.25 | — | — | 1.74 | 0.26 |
| Alloy 314 | 76.19 | 3.00 | — | 3.00 | 4.13 | — | — | — | — | — | — | — | — | 13.68 | — |

TABLE 2-continued

| Chemical Composition of the Alloys (atomic %) | | | | | | | | | | | | | | | |
|---|---|---|---|---|---|---|---|---|---|---|---|---|---|---|---|
| Alloy | Fe | Cr | Ni | B | Si | W | Mo | Nb | Ti | Al | Cu | V | Zr | Mn | C |
| Alloy 315 | 75.69 | 3.00 | — | 3.00 | 4.13 | — | — | — | — | — | — | — | — | 14.18 | — |
| Alloy 316 | 75.19 | 3.00 | — | 3.00 | 4.13 | — | — | — | — | — | — | — | — | 14.68 | — |
| Alloy 317 | 76.03 | 2.13 | 4.38 | 1.94 | 2.13 | — | — | — | — | — | 1.55 | — | — | 11.84 | — |
| Alloy 318 | 73.95 | 2.13 | 4.38 | 1.94 | 2.13 | — | — | — | — | — | 1.55 | — | — | 11.84 | 2.08 |
| Alloy 319 | 76.99 | 2.13 | 2.38 | 1.94 | 2.13 | — | — | — | — | — | 1.55 | — | — | 11.84 | 1.04 |
| Alloy 320 | 79.37 | 2.13 | 0.00 | 1.94 | 2.13 | — | — | — | — | — | 1.55 | — | — | 11.84 | 1.04 |
| Alloy 321 | 72.99 | 2.13 | 4.38 | 1.94 | 4.13 | — | — | — | — | — | 1.55 | — | — | 11.84 | 1.04 |
| Alloy 322 | 70.99 | 2.13 | 4.38 | 1.94 | 6.13 | — | — | — | — | — | 1.55 | — | — | 11.84 | 1.04 |
| Alloy 323 | 77.12 | — | 4.38 | 1.94 | 2.13 | — | — | — | — | — | 1.55 | — | — | 11.84 | 1.04 |
| Alloy 324 | 74.96 | — | — | 1.94 | 2.13 | — | — | — | — | — | 1.55 | — | — | 18.38 | 1.04 |
| Alloy 325 | 80.69 | 3.00 | — | 2.00 | 2.13 | — | — | — | — | — | — | — | — | 11.18 | 1.00 |
| Alloy 326 | 77.39 | 2.13 | 2.38 | 1.54 | 2.13 | — | — | — | — | — | 1.55 | — | — | 11.84 | 1.04 |
| Alloy 327 | 72.61 | 4.95 | 4.10 | 3.76 | 7.02 | — | — | — | — | — | 2.00 | — | — | 5.56 | — |
| Alloy 328 | 76.23 | 3.00 | 1.00 | 3.00 | 4.13 | — | — | — | — | — | 1.00 | — | — | 11.64 | |
| Alloy 329 | 75.49 | 2.13 | 2.38 | 1.94 | 3.63 | — | — | — | — | — | 1.55 | — | — | 1.12 | — |
| Alloy 330 | 73.99 | 2.13 | 2.38 | 1.94 | 5.13 | — | — | — | — | — | 1.55 | — | — | 2.25 | — |
| Alloy 331 | 76.39 | 2.13 | 2.38 | 1.94 | 2.13 | — | — | — | — | — | 1.55 | — | — | 4.50 | — |
| Alloy 332 | 74.89 | 2.13 | 2.38 | 1.94 | 3.63 | — | — | — | — | — | 1.55 | — | — | 2.25 | — |
| Alloy 333 | 73.39 | 2.13 | 2.38 | 1.94 | 5.13 | — | — | — | — | — | 1.55 | — | — | 1.12 | — |
| Alloy 334 | 77.39 | 2.13 | 2.38 | 1.54 | 2.13 | — | — | — | — | — | 1.55 | — | — | 2.25 | — |
| Alloy 335 | 75.89 | 2.13 | 2.38 | 1.54 | 3.63 | — | — | — | — | — | 1.55 | — | — | 0.90 | — |
| Alloy 336 | 74.39 | 2.13 | 2.38 | 1.54 | 5.13 | — | — | — | — | — | 1.55 | — | — | 6.55 | — |
| Alloy 337 | 76.79 | 2.13 | 2.38 | 1.54 | 2.13 | — | — | — | — | — | 1.55 | — | — | 11.84 | 1.04 |
| Alloy 338 | 75.29 | 2.13 | 2.38 | 1.54 | 3.63 | — | — | — | — | — | 1.55 | — | — | 11.84 | 1.04 |
| Alloy 339 | 73.79 | 2.13 | 2.38 | 1.54 | 5.13 | — | — | — | — | — | 1.55 | — | — | 11.84 | 1.04 |
| Alloy 340 | 76.49 | 2.13 | 2.38 | 2.44 | 2.13 | — | — | — | — | — | 1.55 | — | — | 12.44 | 1.04 |
| Alloy 341 | 74.99 | 2.13 | 2.38 | 2.44 | 3.63 | — | — | — | — | — | 1.55 | — | — | 12.44 | 1.04 |
| Alloy 342 | 73.49 | 2.13 | 2.38 | 2.44 | 5.13 | — | — | — | — | — | 1.55 | — | — | 12.44 | 1.04 |
| Alloy 343 | 75.89 | 2.13 | 2.38 | 2.44 | 2.13 | — | — | — | — | — | 1.55 | — | — | 11.84 | 1.04 |
| Alloy 344 | 74.39 | 2.13 | 2.38 | 2.44 | 3.63 | — | — | — | — | — | 1.55 | — | — | 11.84 | 1.04 |
| Alloy 345 | 72.89 | 2.13 | 2.38 | 2.44 | 5.13 | — | — | — | — | — | 1.55 | — | — | 11.84 | 1.04 |

From the above, it can be seen that the targeted composition ranges (atomic percent) include Fe present at 48.00 to 88.00, Cr 0 to 32.00, Ni 0 to 16.00, Mn 0 to 21.00, B at 1.00 to 8.00 and Si at 1.00 to 14.00 atomic percent. The alloys maybe employed to provide a relatively wide range of strength and ductility depending upon whether or not such alloys form Class 1, 2 or 3 Steel as noted herein. The alloys may be used to form seamless tubular components by various methods, such as centrifugal casting.

After processing through centrifugal casting it is expected that the resulting pipe, tube, or tubular component may need to be post heat treated. The heat treatments can be one stage (such as 700 to 1200° C. for 5 minutes to 24 hours) or multiple stage (such as 850 to 1200° C. for 5 minutes to 24 hours, followed by a 200 to 1000° C. heat treatment for 5 minutes to 48 hours) depending on the property targets and the specific alloy response to the thermal exposure.

Alloy Properties

In the new alloys, melting occurs in one or multiple stages with initial melting from ~1000° C. depending on alloy chemistry and final melting temperature might be up to ~1500° C. Variations in melting behavior reflect a complex phase formation at chill surface processing of the alloys depending on their chemistry. The density of the alloys varies from 7.2 g/cm$^3$ to 8.2 g/cm$^3$. The mechanical characteristic values in the alloys from each Class will depend on alloy chemistry and processing/treatment condition. For Class 1 Steels, the ultimate tensile strength values may vary from 700 to 1500 MPa with tensile elongation from 5 to 40%. The yield stress is in a range from 400 to 1300 MPa. For Class 2 Steels, the ultimate tensile strength values may vary from 800 to 1800 MPa with tensile elongation from 5 to 40%. The yield stress is in a range from 400 to 1700 MPa. For Class 3 Steels, the ultimate tensile strength values may vary from 1000 to 2000 MPa with tensile elongation from 0.5 to 15%. The yield stress is in a range from 500 to 1800 MPa. Additional classes of steel are anticipated with possible yield strengths, tensile strengths, and elongation values outside of the limits listed above.

CASE EXAMPLES

Case Example #1: Comparison with Thin Wall Pipe Grades Utilized for Centrifugal Casting for Oil and Gas Industry In the oil and gas industry there are four steel grades used for drill pipe and five common steel grades for casing and tubing whose properties are shown in Table 3 and Table 4. Properties for a selected Class 2 steel alloy, Alloy 82 (Table 2), from present application are included for comparison. Alloy 82 was cast in a copper die as a plate with thickness of 1.8 mm with subsequent thermal mechanical treatment.

TABLE 3

| Tensile Properties of Drill Pipe Steel Grades | | | | | | |
|---|---|---|---|---|---|---|
| | Yield Strength | | | | Tensile Strength | |
| | Min | | Max | | Min | |
| | MPa | PSI | MPa | PSI | MPa | PSI |
| E75 | 517 | 75,000 | 724 | 105,000 | 689 | 100,000 |
| X97 | 655 | 95,000 | 862 | 125,000 | 724 | 105,000 |
| G105 | 724 | 105,000 | 931 | 135,000 | 793 | 115,000 |

TABLE 3-continued

Tensile Properties of Drill Pipe Steel Grades

| | Yield Strength | | | | Tensile Strength | |
|---|---|---|---|---|---|---|
| | Min | | Max | | Min | |
| | MPa | PSI | MPa | PSI | MPa | PSI |
| S135 | 931 | 135,000 | 1138 | 165,000 | 1000 | 145,000 |
| Alloy 82 | 460 | 66,717 | 480 | 69,618 | 1200 | 174,045 |

TABLE 4

Tensile Properties of Casing and Tubing Pipe Steel Grades

| | Yield Strength | | | | Tensile Strength | |
|---|---|---|---|---|---|---|
| | Min | | Max | | Min | |
| | MPa | PSI | MPa | PSI | MPa | PSI |
| J55 | 379 | 55,000 | 552 | 80,000 | 517 | 75,000 |
| L80 | 552 | 80,000 | 655 | 95,000 | 655 | 95,000 |
| N80 | 552 | 80,000 | 758 | 110,000 | 689 | 100,000 |
| C90 | 620 | 90,000 | 723 | 105,000 | 689 | 100,000 |
| P110 | 758 | 110,000 | 965 | 140,000 | 862 | 125,000 |
| Alloy 82 | 460 | 66,717 | 480 | 69,618 | 1200 | 174,045 |

Based on the data in Tables 3 and 4, Alloy 82 is close to being comparable to E75 drill pipe in yield strength yet is nearly twice as strong and would easily be comparable to J55 casing pipe and yet is over twice as strong. A stainless steel Alloy 82 is likely to have an additional advantage over both drill pipe and casing pipe grades in terms of higher corrosion resistance.

Because these tensile properties would be achievable in a pipe with a wall thickness of 2.1 mm (0.083 inch) there would be a significant weight savings for the different pipes as shown in Tables 5 and 6. Note that the largest outer diameter (OD) drill pipe from Alloy 82 would have lower in mass per unit length of the smallest diameter API spec drill pipe and a pipe from Alloy 82 would be nearly two and half to ten times lighter than any casing pipe in API spec. There would be a significant cost savings to drilling operations if the pipes used were substantially lighter. Additionally, much lighter pipe weight might be achieved by utilizing high strength Class 3 alloys or new classes of steel.

TABLE 5

Drill Pipe Weight Comparison

| Drill Pipe OD in. | API-5D Spec lbs./ft. | Alloy 82 lbs./ft. | Weight Difference lbs./ft. |
|---|---|---|---|
| 2.375 | 6.65 | 1.96 | −4.69 |
| 2.875 | 10.4 | 2.38 | −8.02 |
| 3.5 | 13.3 | 2.91 | −10.39 |
| 3.5 | 15.5 | 2.91 | −12.59 |
| 4 | 14 | 3.34 | −10.66 |
| 4 | 15.7 | 3.34 | −12.36 |
| 4.5 | 16.6 | 3.77 | −12.83 |
| 4.5 | 20 | 3.77 | −16.23 |
| 5 | 19.5 | 4.2 | −15.3 |
| 5 | 25.6 | 4.2 | −21.4 |
| 5.5 | 21.9 | 4.62 | −17.28 |
| 5.5 | 24.7 | 4.62 | −20.08 |
| 6.625 | 25.2 | 5.58 | −19.62 |
| 6.625 | 27.7 | 5.58 | −22.12 |

TABLE 6

Seamless Casing J55 Grade Pipe Weight Comparison

| Casing Pipe OD in. | API-5CT Spec lbs./ft. | Alloy 82 lbs./ft. | Weight Difference lbs./ft. |
|---|---|---|---|
| 4.5 | 9.5 | 3.77 | −5.73 |
| 4.5 | 10.5 | 3.77 | −6.73 |
| 4.5 | 11.5 | 3.77 | −7.73 |
| 5 | 11.5 | 4.2 | −7.3 |
| 5 | 13 | 4.2 | −8.8 |
| 5 | 15 | 4.2 | −10.8 |
| 5.5 | 14 | 4.62 | −9.38 |
| 5.5 | 15.5 | 4.62 | −10.88 |
| 5.5 | 17 | 4.62 | −12.38 |
| 6.625 | 20 | 5.58 | −14.42 |
| 6.625 | 24 | 5.58 | −18.42 |
| 7 | 20 | 5.9 | −14.1 |
| 7 | 23 | 5.9 | −17.1 |
| 7 | 26 | 5.9 | −20.1 |

Case Example #2: Prototype Pipe Centrifugal Casting

Figure 11:
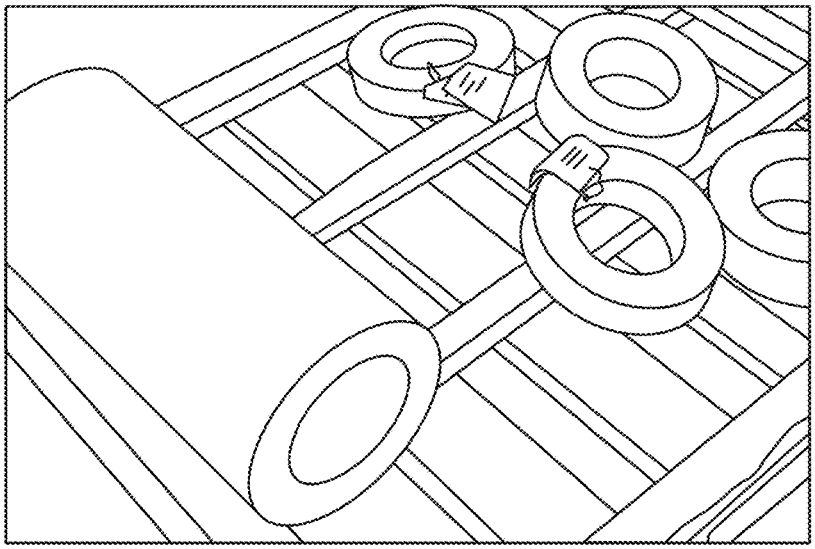
FIG. 11 illustrates a prototype pipe from Alloy 82 produced by centrifugal casting.

Raw feedstock material prepared in accordance with atomic ratios for Alloy 82 (Table 2) was heated in a furnace until melting. Upon homogenization, the molten liquid metal was transferred to a tundish that was moved to the mold location. The permanent mold was rotated continuously about its axis at a fixed speed as the molten metal was poured from the tundish. The molten metal was centrifugally thrown towards the inside mold wall where it solidified during cooling forming a pipe. The view of the cast pipe is shown in FIG. 11. Outer diameter (OD) of the as-cast pipe was 25.6 cm with a total length of 66 cm. Pipe wall thickness was 5.5 cm with the total weight in as-cast state of 172 kg. From the centrifugally cast pipe, 5 cm thick rings were cut from the pipe for testing and microstructural studies as shown in FIG. 11.

Case Example #3: Density of the Prototype Pipe Produced by Centrifugal Casting The density of the pipe produced by centrifugal casting from Alloy 82 (Table 2) was measured using the Archimedes method in a specially constructed balance allowing weighing in both air and distilled water. Experimental results have revealed that the accuracy of this technique is ±0.01 g/cm$^3$. The samples were cut by EDM from the pipe ring close to the outer diameter (OD) surface, close to the inner diameter (ID) surface and from the middle of the pipe wall. The density data are listed in Table 7 for each sample. As it can be seen, the density of the pipe is uniform through the volume.

TABLE 7

Density Data

| Samples | Cut Off Position | Density (g/cm$^3$) |
|---|---|---|
| 1 | Close to outer surface | 7.55 |
| 2 | Middle of the piper wall | 7.55 |
| 3 | Close to inner surface | 7.57 |
| | Overage | 7.56 |

Figure 12:
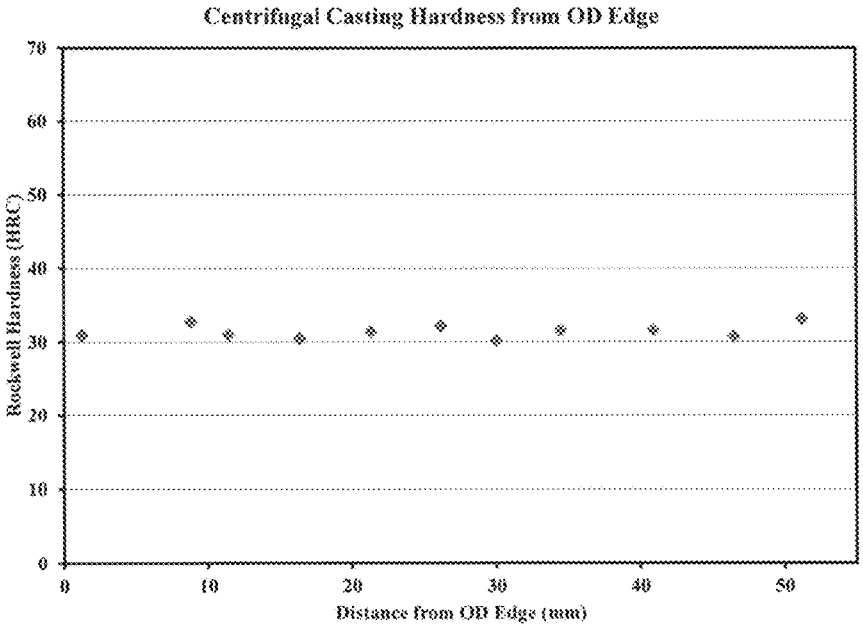
FIG. 12 illustrates a chart of the Rockwell hardness as a function of distance from the OD edge towards the ID.

Case Example #3: Hardness of the Prototype Pipe Produced by Centrifugal Casting Rockwell C hardness was measured on a cross sectional sample cut from the pipe produced by centrifugal casting from Alloy 82 (Table 2). Measurements were done by using a Newage Versitron manual Rockwell hardness tester and are listed in Table 8 and displayed as a function of distance in FIG. 12. The hardness ranges from 31.0 HRC near the outer diameter (OD) surface and 33.1 HRC near the inner diameter (ID) surface.

TABLE 8

Hardness Results for Prototype Pipe

| Distance from OD (mm) | Rockwell Hardness (HRc) |
|---|---|
| 1.3 | 31.0 |
| 8.8 | 32.8 |
| 11.4 | 31.0 |
| 16.4 | 30.5 |
| 21.3 | 31.5 |
| 26.2 | 32.2 |
| 30.0 | 30.3 |
| 34.5 | 31.6 |
| 40.9 | 31.6 |
| 46.6 | 30.8 |
| 51.2 | 33.1 |

Figure 13:
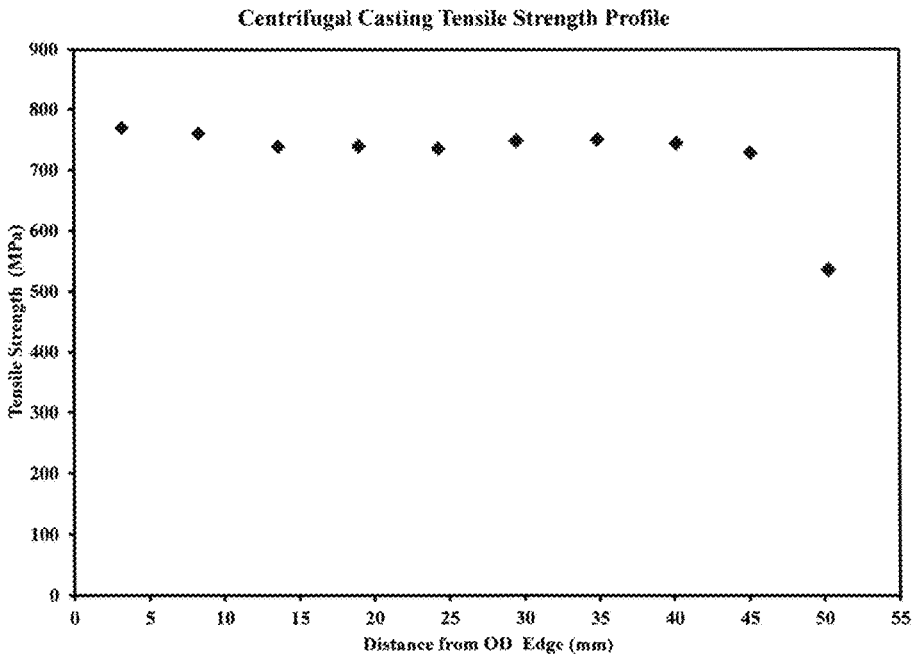
FIG. 13 illustrates a chart of the centrifugal casting tensile strength profile along cross sectional distance from the OD.
Figure 14:
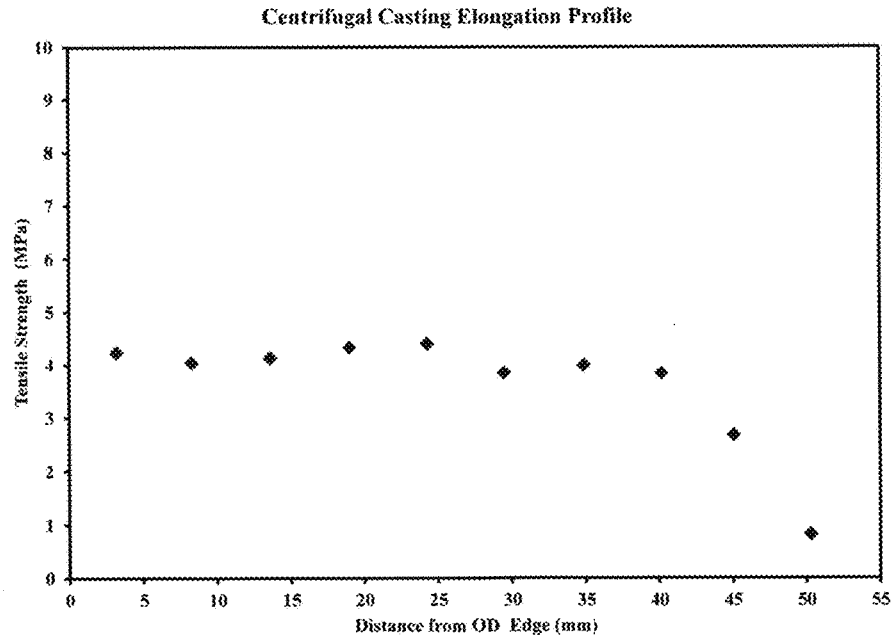
FIG. 14 illustrates a chart of the centrifugal casting elongation profile along cross sectional distance from the OD.

Case Example #4: Tensile Properties of the Prototype Pipe Produced by Centrifugal Casting Cross section plates with about 2 mm thickness were cut from the pipe produced by centrifugal casting from Alloy 82 (Table 2). The tensile specimens were cut from cross sectional plates using wire electrical discharge machining (EDM). The tensile properties were measured on an Instron mechanical testing frame (Model 3369), utilizing Instron's Bluehill control and analysis software. All tests were run at room temperature in displacement control with the bottom fixture held ridged and the top fixture moving; the load cell is attached to the top fixture. The tensile test results for the as cast pipe as a function of distance from the outer diameter (OD) surface are shown Table 9 with the tensile strength profile shown in FIG. 13 and the elongation profile shown in FIG. 14. The maximum tensile strength occurred near the outer surface and dropped slightly but remained constant until very close to the inner surface. The elongation showed a similar trend in that the elongation was constant through most of the pipe until near the inner surface where it dropped substantially. Typically the centrifugal cast pipe is cast with a greater wall thickness because the inner diameter (ID) of the pipe is bored out. This will remove the otherwise deleterious layer in order for the tensile properties to be uniform. From the tensile data the ID should be bored with a minimum of 10 mm of thickness removed.

TABLE 9

Tensile Test Results for As Cast Centrifugal Casting

| Sample | Distance from OD (mm) | Tensile Strength (MPa) | Tensile Elongation (%) |
|---|---|---|---|
| 1 | 3.2 | 770 | 4.2 |
| 2 | 8.3 | 760 | 4.0 |
| 3 | 13.6 | 738 | 4.1 |
| 4 | 19.0 | 739 | 4.3 |
| 5 | 24.3 | 735 | 4.4 |
| 6 | 29.5 | 748 | 3.8 |
| 7 | 34.9 | 750 | 4.0 |

TABLE 9-continued

Tensile Test Results for As Cast Centrifugal Casting

| Sample | Distance from OD (mm) | Tensile Strength (MPa) | Tensile Elongation (%) |
|---|---|---|---|
| 8 | 40.2 | 744 | 3.8 |
| 9 | 45.1 | 728 | 2.7 |
| 10 | 50.3 | 536 | 0.8 |

Figure 15:
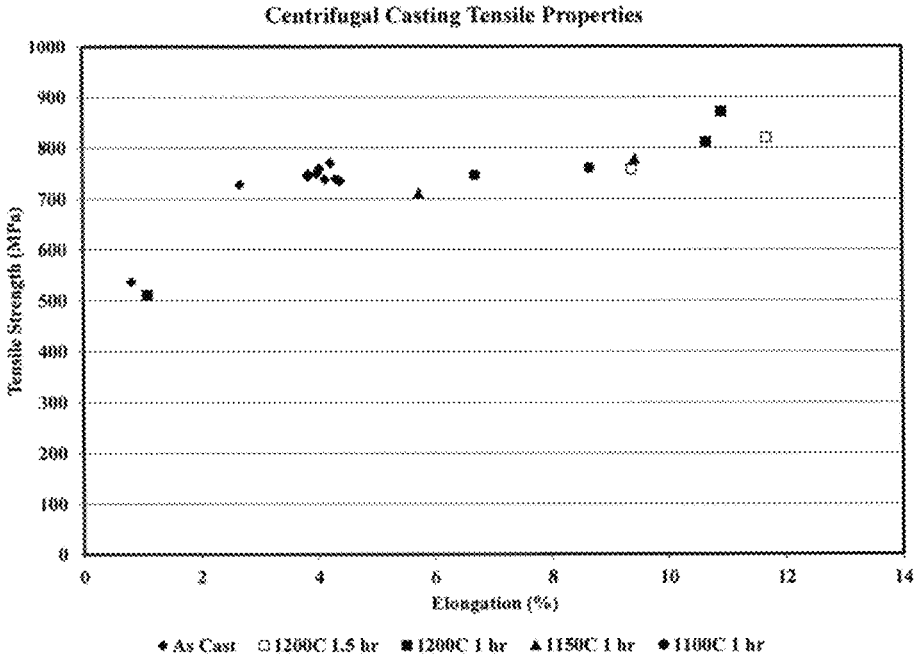
FIG. 15 illustrates a chart of the centrifugal casting tensile properties for as cast and heat treated specimens.

Tensile specimens cut from cross sectional plates of the pipe were heat treated from 1100° C. to 1200° C. for 1 hour and another set were subsequently heat treated at 1200° C. for 1.5 hours to see if the tensile properties improved. The as cast and heat treated tensile results are listed in Table 10 and shown in FIG. 15. With higher temperature there was an improvement in elongation (it increased by a factor of 3) but not a significant improvement in tensile strength.

TABLE 10

Tensile Test Results for Heat Treated Centrifugal Casting

| Temperature (° C.) | Annealing Time (hr) | Tensile Strength (MPa) | Tensile Elongation (%) |
|---|---|---|---|
| 1200 | 1.5 | 820 | 11.7 |
| 1200 | 1.5 | 758 | 9.4 |
| 1200 | 1 | 812 | 10.7 |
| 1200 | 1 | 872 | 10.9 |
| 1200 | 1 | 511 | 1.1 |
| 1150 | 1 | 779 | 9.4 |
| 1150 | 1 | 711 | 5.7 |
| 1100 | 1 | 761 | 8.7 |
| 1100 | 1 | 747 | 6.7 |

Figure 16:
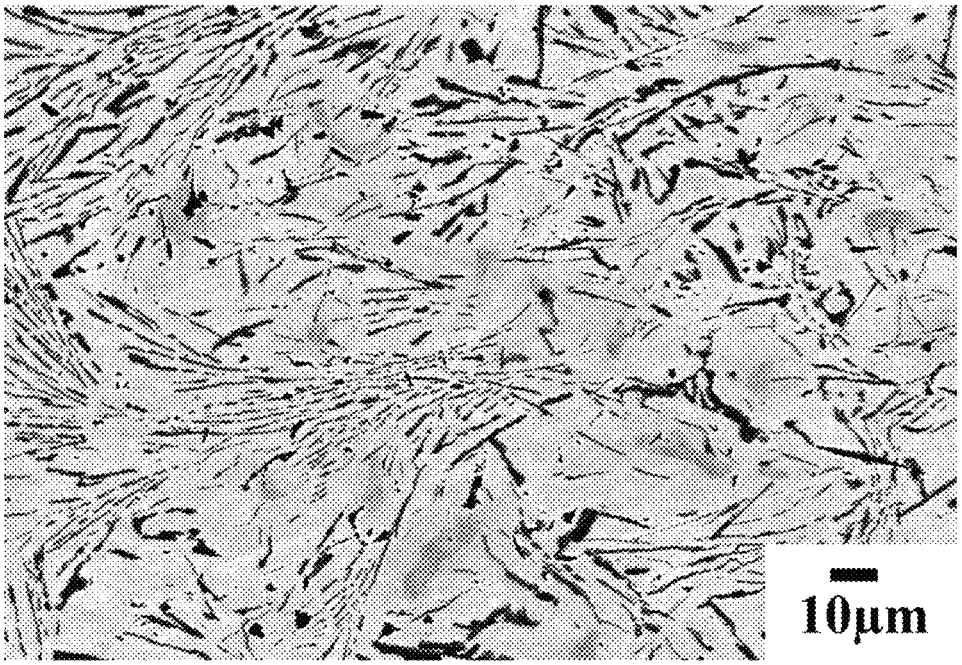
FIG. 16 illustrates a microstructure in the OD region of the pipe produced by centrifugal casting.
Figure 17:
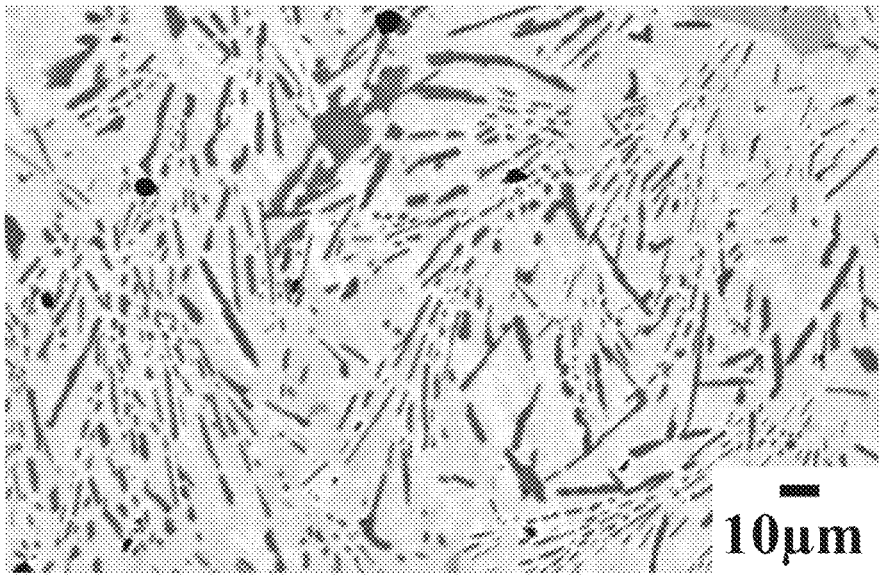
FIG. 17 illustrates a microstructure in the OD region of the pipe produced by centrifugal casting after heat treatment at 1200° C. for 1 hour.

Case Example #5: Microstructure of the Prototype Pipe Produced by Centrifugal Casting SEM samples from the outer diameter (OD) region were cut from the pipe produced by centrifugal casting from Alloy 82 (Table 2). Samples were mechanically polished to a mirror finish and examined with a Zeiss Scanning Electron Microscope that has a maximum of 30 kV accelerating voltage. The microstructure of the OD region is shown in FIG. 16. The microstructure was characterized as an iron matrix in which boride pinning phase had formed that had a needle like morphology. The needles clustered together for which the needles pointed in the same direction. It was observed that the center microstructure could be converted through heat treatment into Modal Structure. The microstructure of the pipe specimen heat treated at 1200° C. for 1 hour is shown in FIG. 17. The boride pinning phases in the cluster regions appeared to be broken up into smaller structures and more closely resembling a Modal Structure.

Case Example #6: Prototype Pipe Produced by Hot Extrusion

A prototype pipe was produced from Alloy 82 (Table 2) by hot extrusion of the billet consolidated from alloy powder by Hot Isostatic Pressing (HIP). Powder was produced by atomization process from the melt using industrial centrifugal atomizer. Raw feedstock material prepared in accordance with atomic ratios for Alloy 82 was inductively heated until melting in an inert atmosphere. Upon homogenization, the molten liquid metal was transferred to the reservoir of an industrial centrifugal atomizer. The molten liquid metal was poured continuously onto a rapidly rotating disc from which the liquid was aspirated into droplets that were rapidly cooled by an inert gas. The produced powder was collected in a chamber and processed through an air classifier that separated the powder at minus 180 μm (~80 mesh). The alloy has good processability by powder atomization resulted in high quality powder with regular shape with yield of 60% under 180 μm in size.

Figure 18:
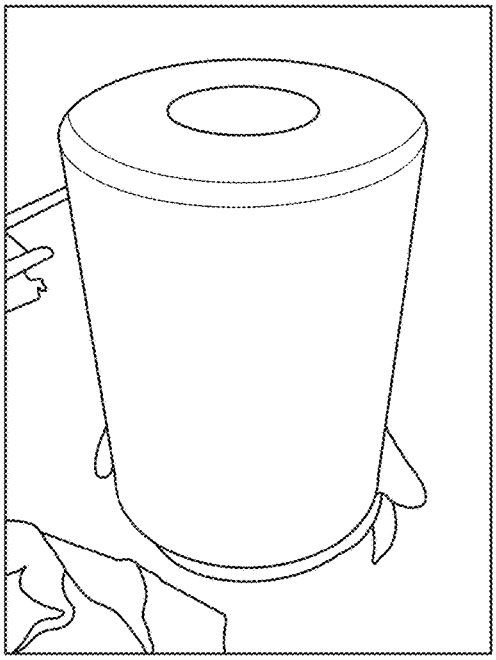
FIG. 18 illustrates a billet with 4 in. hole machined through the center and protective glass coating applied to the surface

The produced powder from Alloy 82 representing Class 2 steel was compacted by Hot Isostatic Pressing (HIP) method into a cylindrical billet using high pressure inert gas at elevated temperatures in order to consolidate encapsulated powders to give fully dense materials. The billet in a form of a cylinder with 10 inches in diameter and 13.5 inches in length was prepared for extrusion by boring a 4 in. dia. hole in the center. Additionally, a protective glass lubricant was applied to the surface to aid in extrusion and to prevent oxidation during soak in atmosphere at 1193° C. for 4 hr. The as-prepared billet is shown in FIG. 18.

Figure 19:
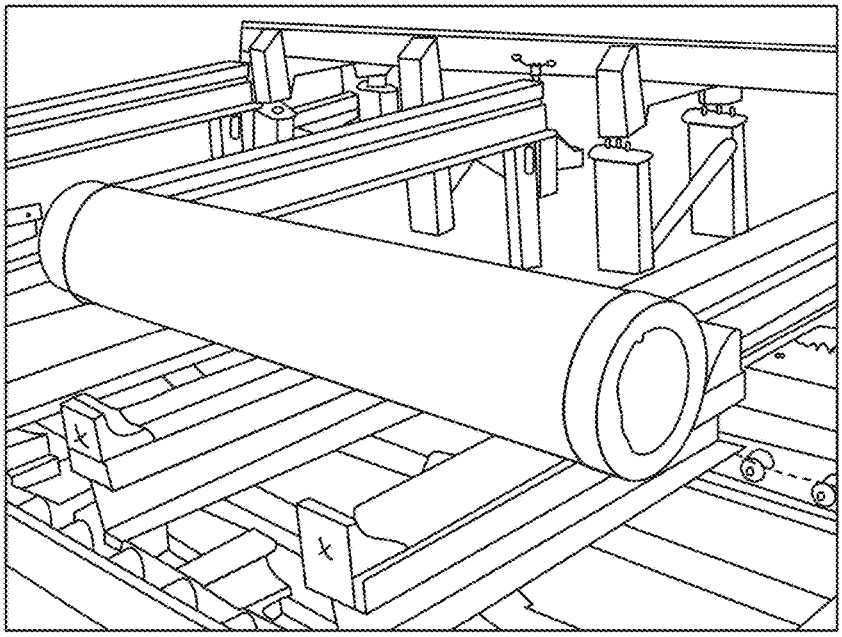
FIG. 19 illustrates a prototype pipe produced from Alloy 82 by hot extrusion of the billet consolidated from alloy powder.

After soaking, the billet was removed from the oven and rolled across a woven glass cloth which adheres to the surface for additional lubrication. It was then moved to a lift which positions the billet between the hydraulic ram and the mandrel and extrusion die. During extrusion, the billet was forced through a die which reduces the outer diameter (OD) and holds the inner diameter (ID) constant by using a stationary 4 in. dia. mandrel. The material experienced an acceleration as it is forced through the die and was stretched longitudinally, reducing the cross sectional area and increasing the length. Both the die and the mandrel are preheated to 371° C. The extrusion process is illustrated in FIG. 2. An extruded prototype pipe was approximately 38 in. long with a 6¾ in. OD and a wall thickness of 1⅜ in. as shown in FIG. 19.

Case Example #7: Density of the Prototype Pipe Produced by Hot Extrusion

The density of the pipe produced by hot extrusion from Alloy 82 (Table 2) was measured using the Archimedes method in a specially constructed balance allowing weighing in both air and distilled water. Experimental results have revealed that the accuracy of this technique is ±0.01 g/cm$^3$. The density of the extruded pipe is 7.55 g/cm$^3$ as an average of 5 measurements.

Case Example #8: Hardness of the Prototype Pipe Produced by Hot Extrusion

Rockwell C hardness was measured on a cross sectional sample cut from the pipe produced by hot extrusion of HIP consolidated billet from Alloy 82 powder. Measurements were done by using a Newage Versitron manual Rockwell hardness tester and are listed in Table 12. The hardness has similar values through cross section and ranges from 29.7 HRC to 33.1 HRC.

TABLE 12

Hardness Results for Prototype Pipe

| Distance from OD (mm) | Rockwell Hardness (HRc) |
|---|---|
| 1.3 | 31.5 |
| 8.8 | 30.5 |

TABLE 12-continued

Hardness Results for Prototype Pipe

| Distance from OD (mm) | Rockwell Hardness (HRc) |
|---|---|
| 16.4 | 33.1 |
| 21.3 | 29.7 |
| 30.0 | 30.3 |

Case Example #9: Tensile Properties of the Prototype Pipe Produced by Hot Extrusion Cross section plates with about 2 mm thickness were cut from the pipe produced by hot extrusion from Alloy 82 (Table 2). The tensile specimens were cut from cross sectional plates using wire electrical discharge machining (EDM). The tensile properties were measured on an Instron mechanical testing frame (Model 3369), utilizing Instron's Bluehill control and analysis software. All tests were run at room temperature in displacement control with the bottom fixture held ridged and the top fixture moving; the load cell is attached to the top fixture.

Figure 20:
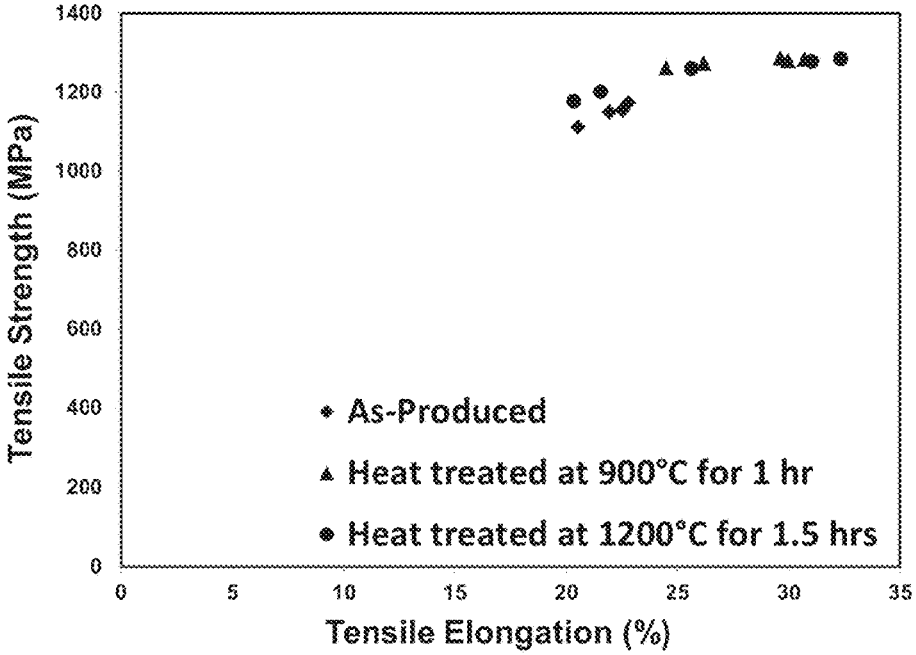
FIG. 20 illustrates tensile properties of the extruded pipe in as-received and heat treated states.
Figure 21:
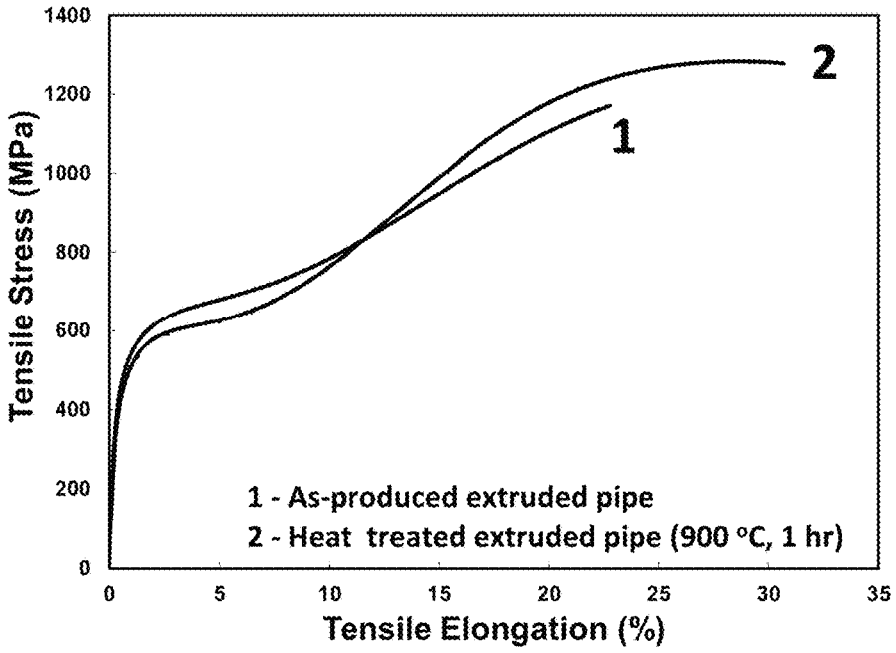
FIG. 21 illustrates stress-strain curves for extruded pipe in as-produced and heat treated conditions.

The pipe properties have been tested in the as-produced state, as well as after heat treatments at 900 for 1 hr and 1200° C. for 1.5 hours. Additionally, a study on the property values through the pipe thickness going from the internal diameter to the outer diameter has been undertaken. Tensile properties of the pipe material in different states are shown in FIG. 20. The pipe material is clearly demonstrated Class 2 behavior with high strength/high ductility combination (FIG. 21).

Figure 22:
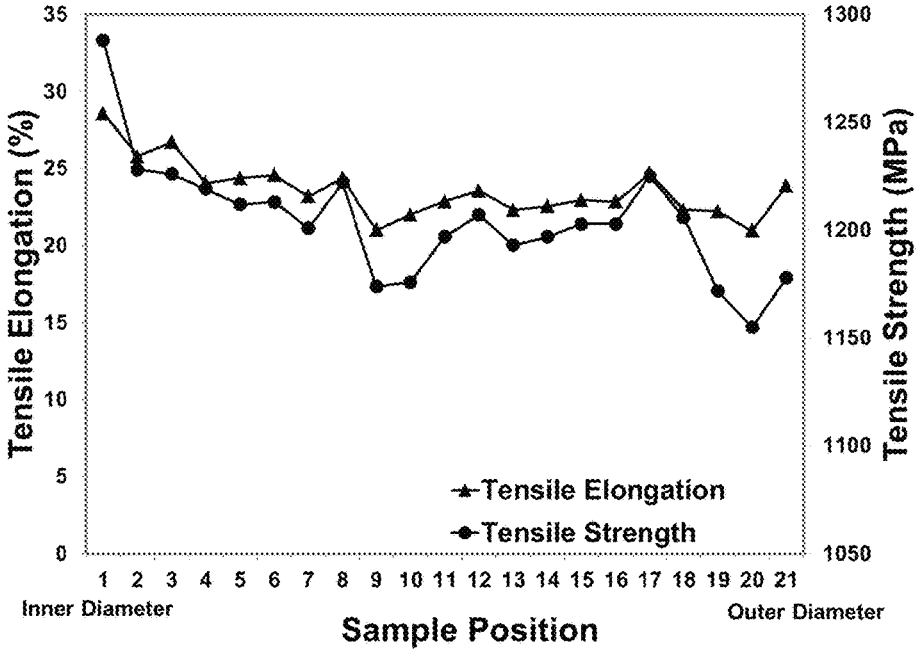
FIG. 22 illustrates tensile properties through the thickness of extruded pipe wall from inner diameter surface towards outer diameter surface.

To evaluate a uniformity of the pipe properties through the volume, a series of tensile specimens was cut from a profile section of the extruded pipe, and then tested to determine if there is any variation in tensile properties through the pipe wall thickness from the inner diameter (ID) to the outer diameter (OD) of the pipe. All samples were heat treated at 900° C. for 1 hour. Despite some variation in property values, the properties are shown to be consistent through the thickness with most measurements above tensile strength of 1200 MPa and ductility more that 20% (FIG. 22). Slightly better properties were measured for the samples that were cut close to ID surface.

Figure 23:
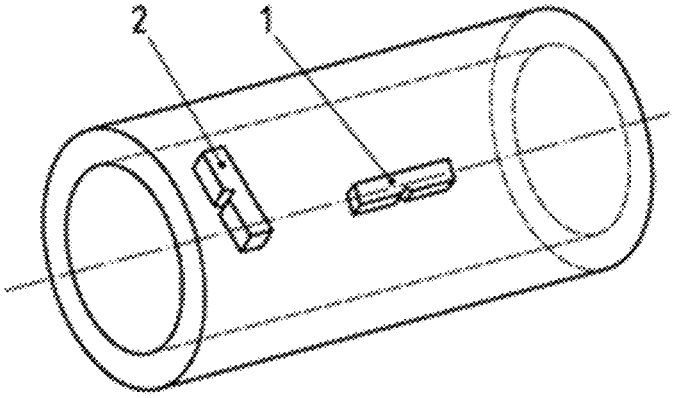
FIG. 23 illustrates Charpy specimens cut from the extruded pipe with longitudinal (1) orientation and transverse (2) orientation.

Case Example #10: Impact Properties of the Prototype Pipe Produced by Hot Extrusion Charpy specimens were cut out from a pipe produced by hot extrusion of the billet compacted from Alloy 82 powder. Specimens were cut using wire electrical discharge machining (EDM) with two different orientations relative to the centerline axis of the pipe, which were identified as longitudinal and transverse as shown in FIG. 23. For both longitudinal and transverse orientations un-notched specimens were cut by EDM according to ASTM E23-07a protocols for Charpy impact test specimens type A. The Charpy specimens were tested on a Tinius Olsen Model 74 Charpy impact tester by an A2LA accredited independent laboratory following the protocols of ASTM E23-07a and the Charpy results are listed in Table 13. The Charpy impact energy for the un-notched specimens with longitudinal orientation ranged from 222 to 248 ft·lb. while in transverse orientation, the energy was measured from 130 to 217 ft·lb.

Slight difference in Charpy impact energy in longitudinal and transverse direction might be related to structural texture formed during extrusion.

TABLE 13

Charpy Results for Extruded Pipe

| Sample | Longitudinal Un-notched Charpy Energy (ft. lb.) | Transverse Un-notched Charpy Energy (ft. lb.) |
|---|---|---|
| 1 | 222 | 130 |
| 2 | 248 | 192 |
| 3 | 224 | 217 |
| 4 | 250 | 203 |
| 5 | 232 | 172 |
| Average | 235 | 183 |

Figure 24:
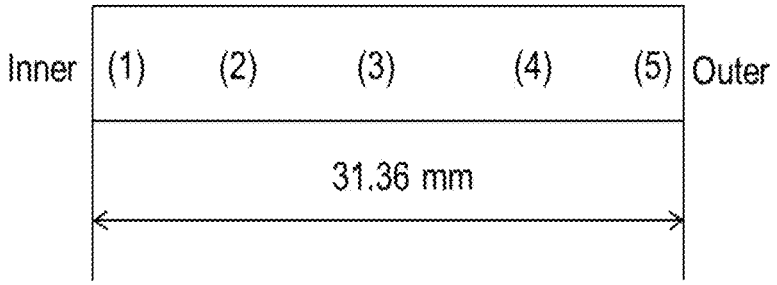
FIG. 24 shows schematic illustration of SEM sample locations through the extruded pipe wall thickness.

Case Example #11: SEM Analysis of Microstructure in the Prototype Pipe Produced by Hot Extrusion Samples for scanning electron microscopy (SEM) analysis were cut from as-extruded pipe at different locations through wall thickness. To ensure smooth surface, SEM samples were metallographically polished in stages down to 0.02 μm Grit. SEM was done using a Zeiss EVO-MA10 model with the maximum operating voltage of 30 kV manufactured by Carl Zeiss SMT Inc. As shown in FIG. 24, five locations were examined by SEM moving from inner diameter (ID) to outer diameter (OD).

Figure 25:
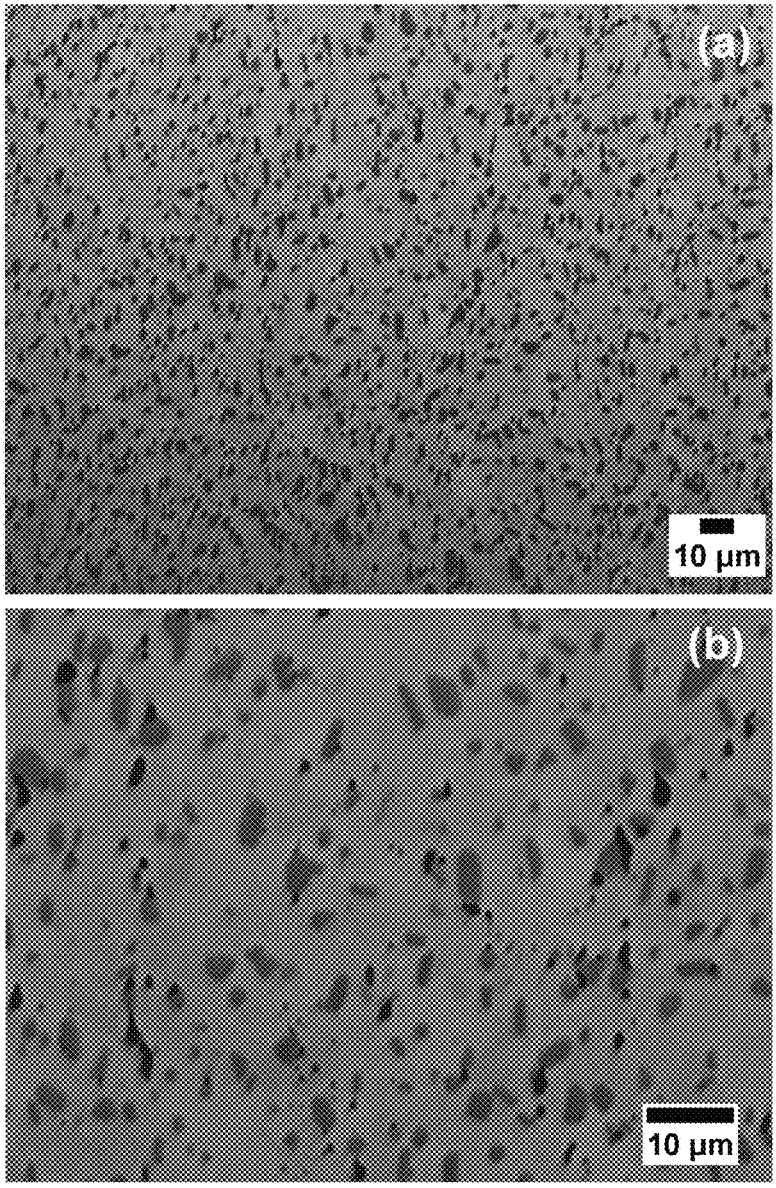
FIG. 25 illustrates backscattered SEM images of the microstructure in as-extruded pipe close to inner diameter.
Figure 26:
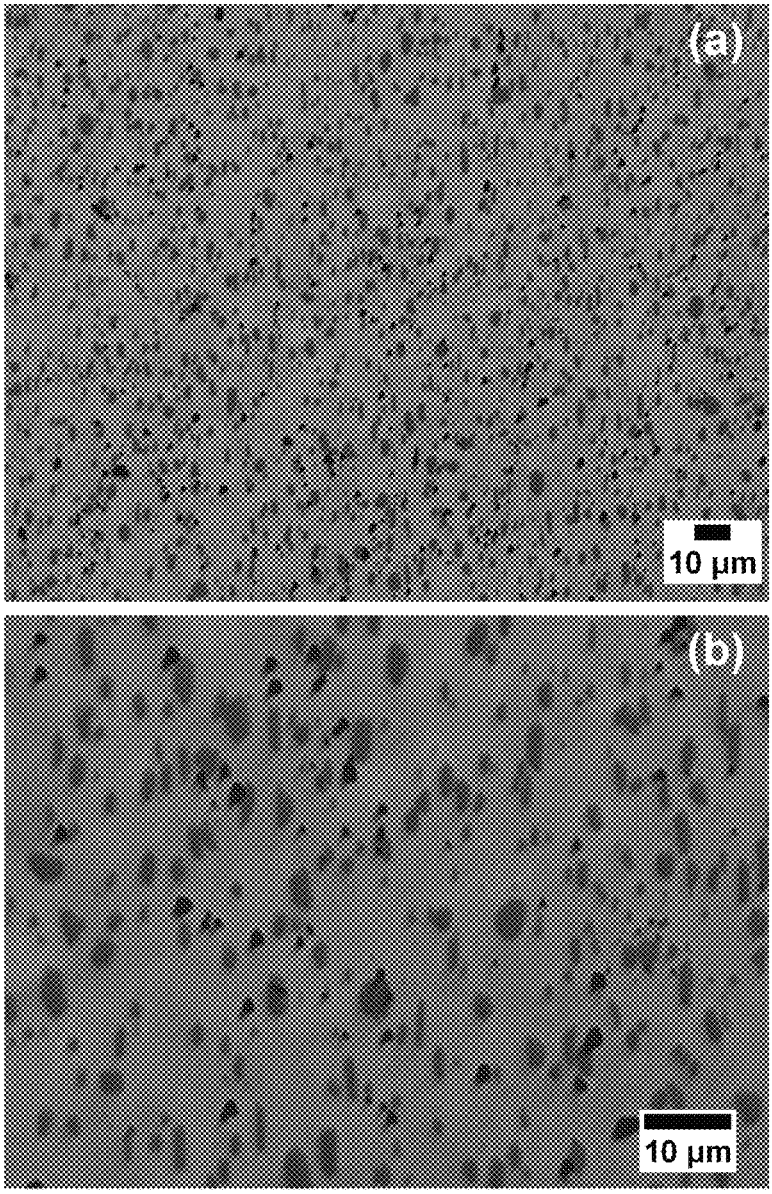
FIG. 26 illustrates backscattered SEM images of the microstructure in the center of the as-extruded pipe wall.
Figure 27:
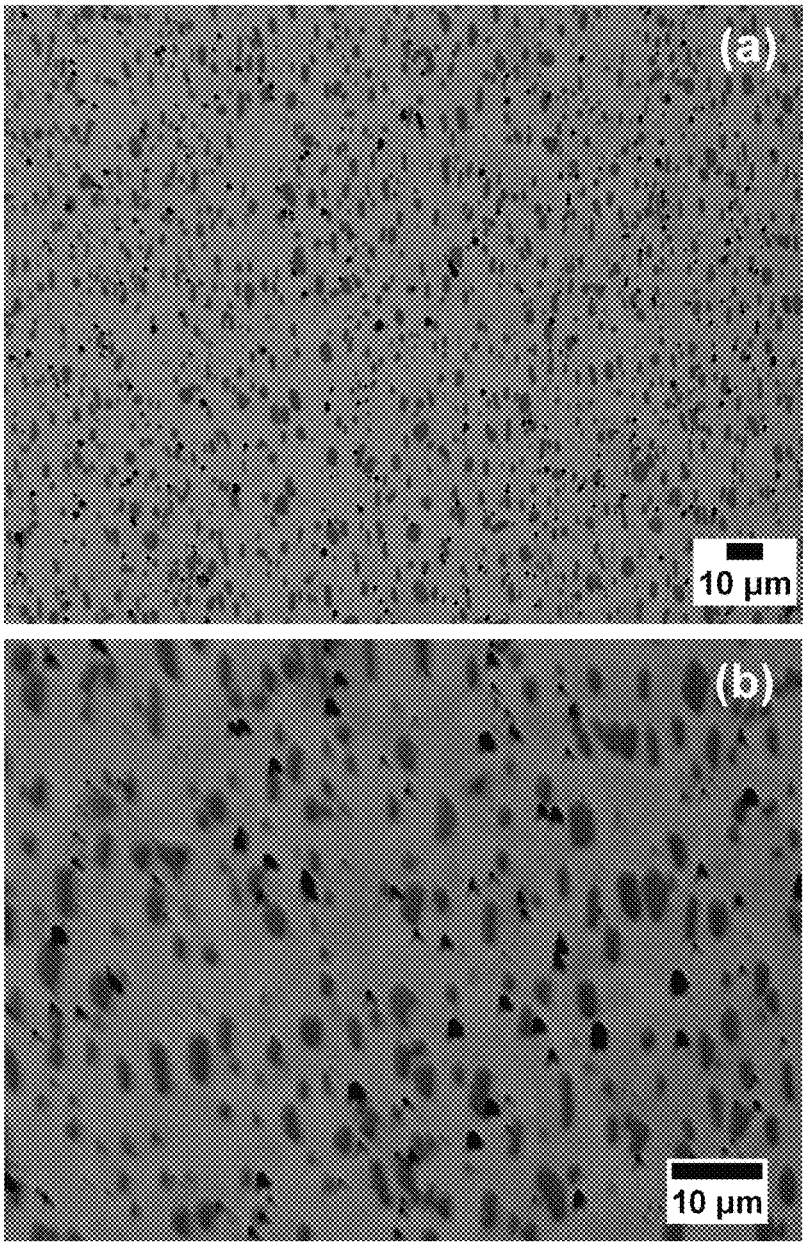
FIG. 27 illustrates backscattered SEM images of the microstructure in as-extruded pipe close to outer diameter.

Example SEM backscattered electron micrographs of the as-extruded samples are shown in FIG. 25 through FIG. 27. The microstructure in general is homogeneous with high density of boride precipitate phase in the matrix. The boride precipitate phase (dark phase) shows relatively uniform size, with most of the particles less than 5 μm. In addition, the microstructure from inner diameter to outer diameter appears similar, in terms of both the size and distribution. It suggests that the microstructure is homogeneous throughout the pipe and is the targeted NanoModal structure.

To evaluate heat treatment effect on pipe microstructure, samples for SEM analysis were cut from heat treated pipe close to inner diameter, from the wall center and close to outer diameter of the pipe. Two heat treatments were applied to the pipe material: at 900° C. for 1 hour and at 1200° C. for 1.5 hrs. To ensure smooth surface, SEM samples were metallographically polished in stages down to 0.02 μm Grit. SEM was done using a Zeiss EVO-MA10 model with the maximum operating, voltage of 30 kV manufactured by Carl Zeiss SMT Inc.

Figure 28:
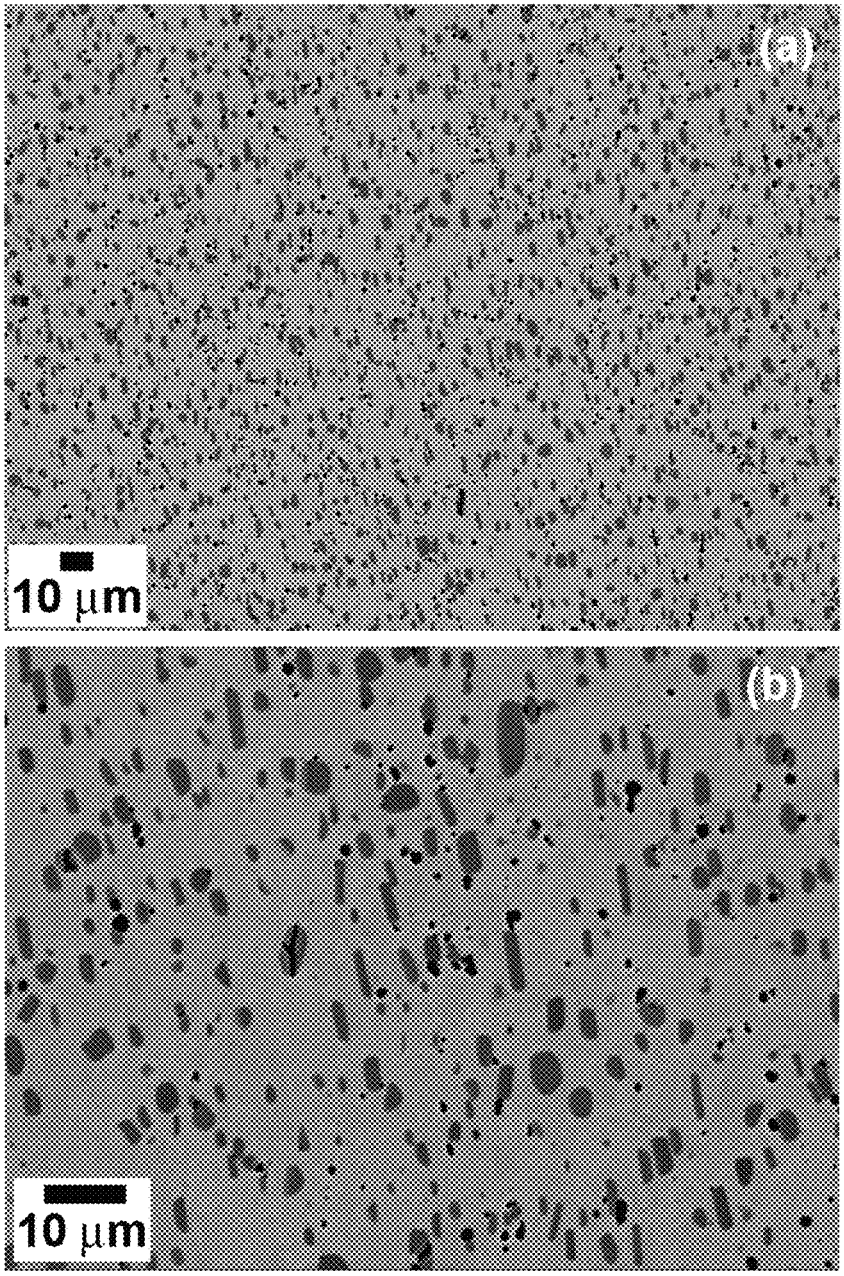
FIG. 28 illustrates backscattered SEM images of microstructure in the extruded pipe close to inner diameter after heat treatment at 900° C. for 1 hr.
Figure 29:
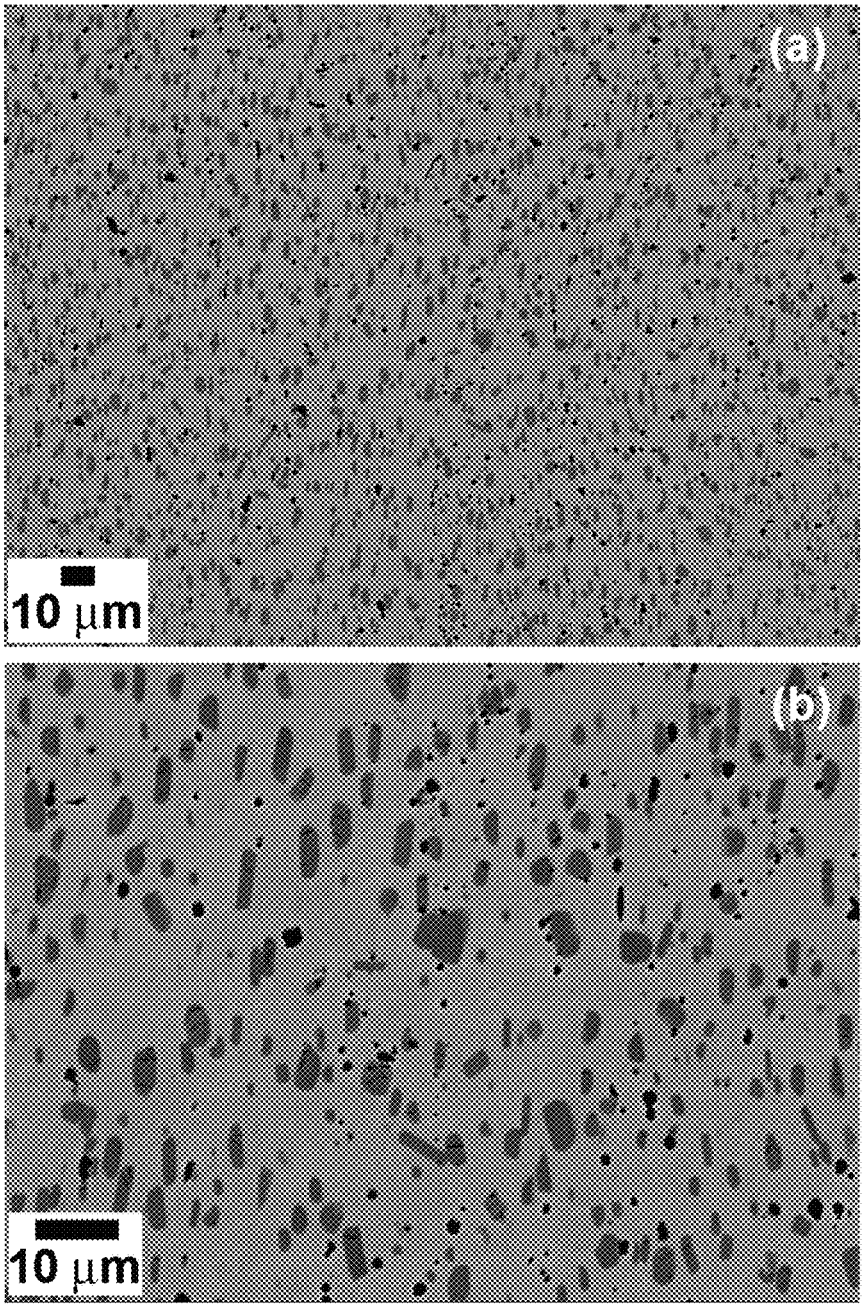
FIG. 29 illustrates backscattered SEM images of microstructure in the center of the extruded pipe wall after heat treatment at 900° C. for 1 hr.
Figure 30:
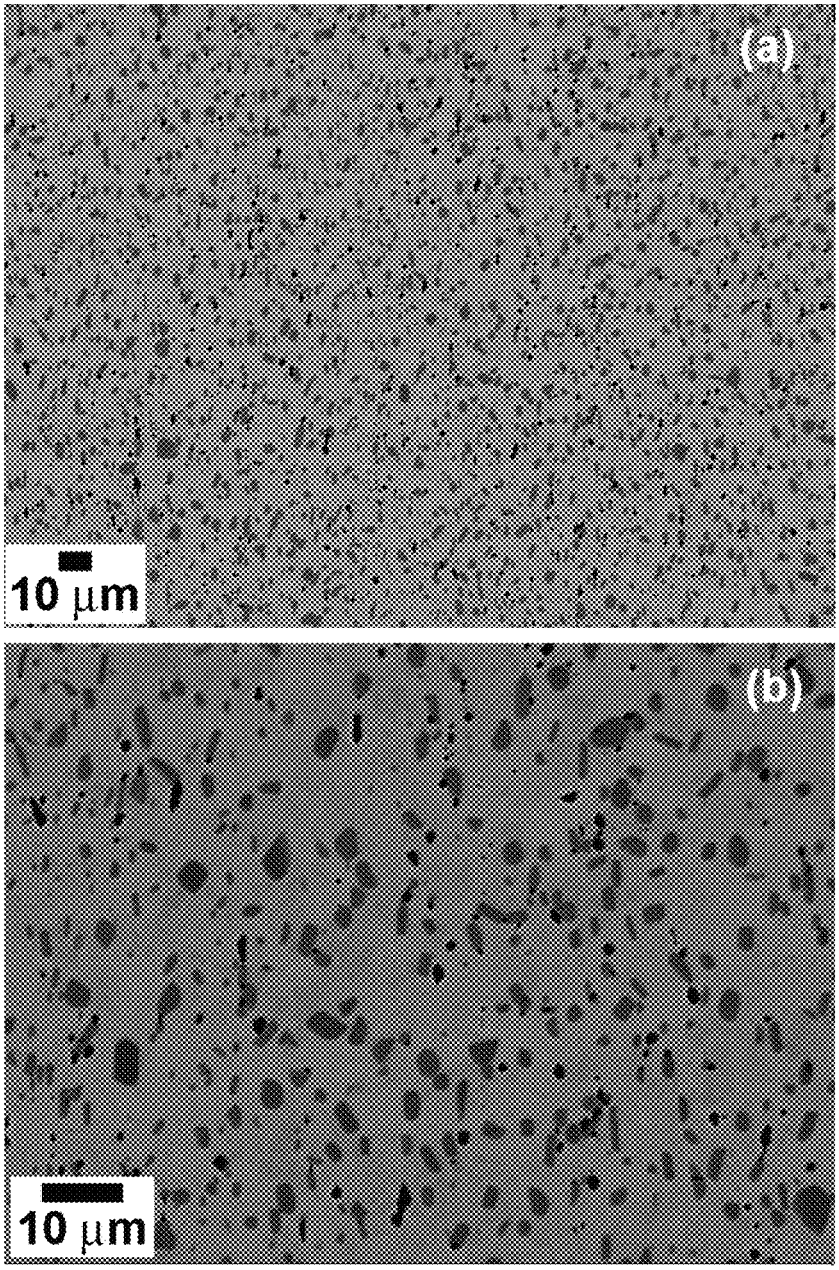
FIG. 30 illustrates backscattered SEM images of microstructure in the extruded pipe close to outer diameter after heat treatment at 900° C. for 1 hr.
Figure 31:
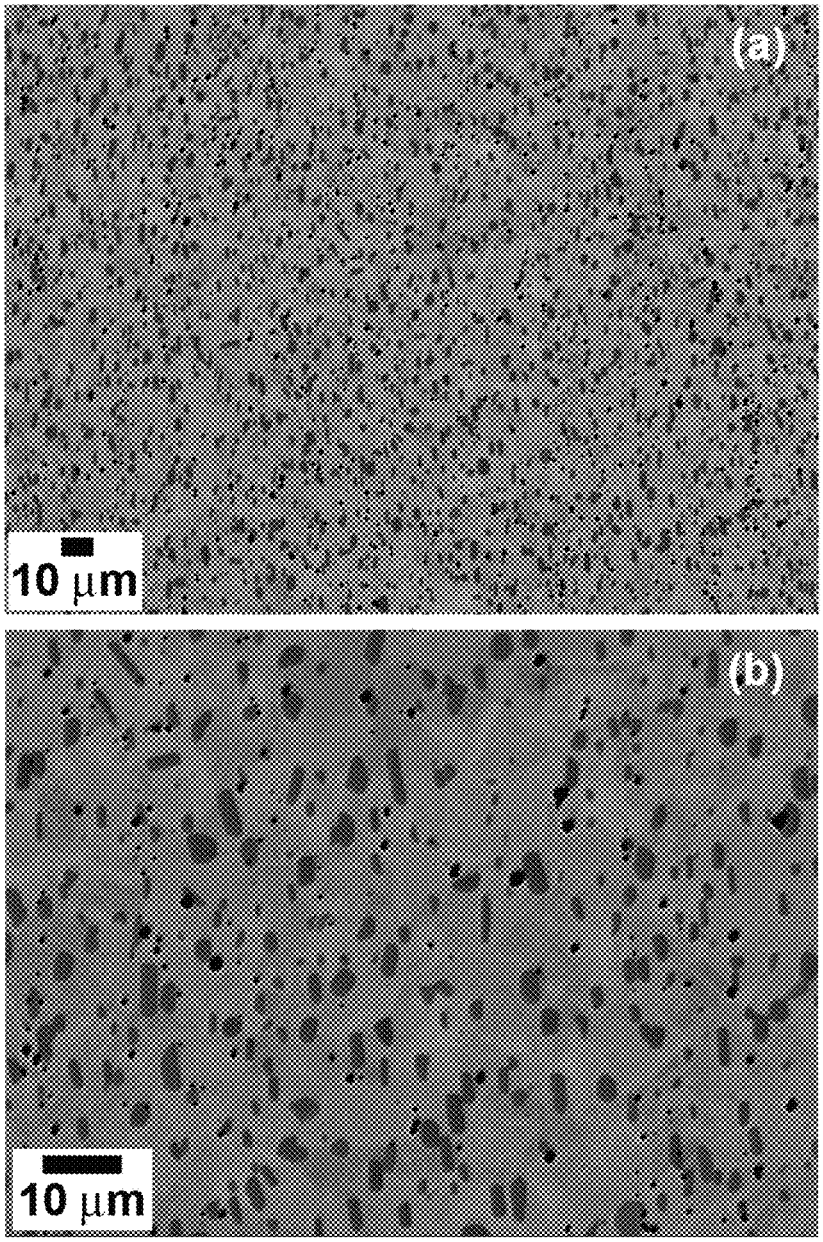
FIG. 31 illustrates backscattered SEM images of microstructure in the extruded pipe close to inner diameter after heat treatment at 1200° C. for 1.5 hrs.
Figure 32:
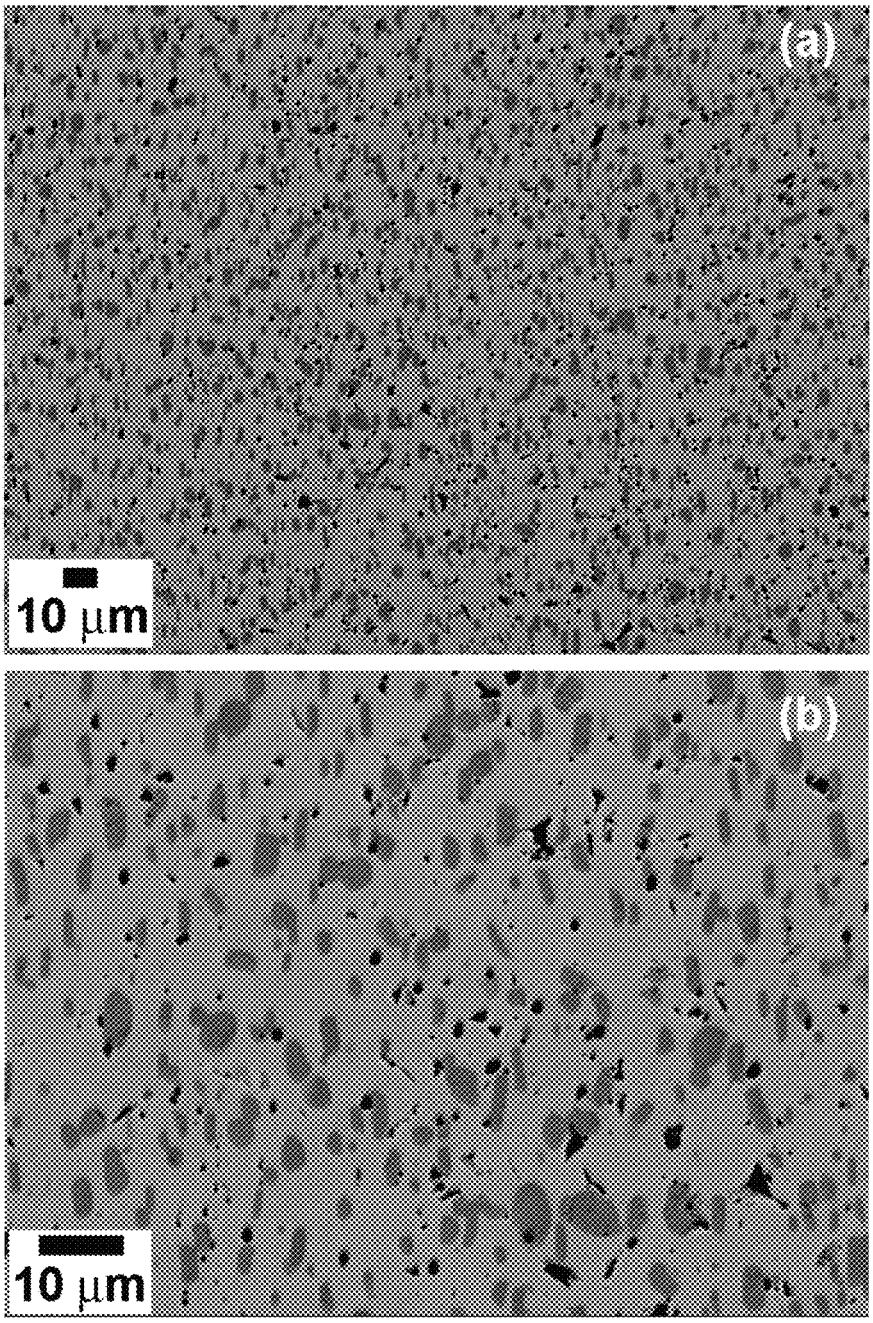
FIG. 32 illustrates backscattered SEM images of microstructure in the center of the extruded pipe wall after heat treatment at 1200° C. for 1.5 hrs.
Figure 33:
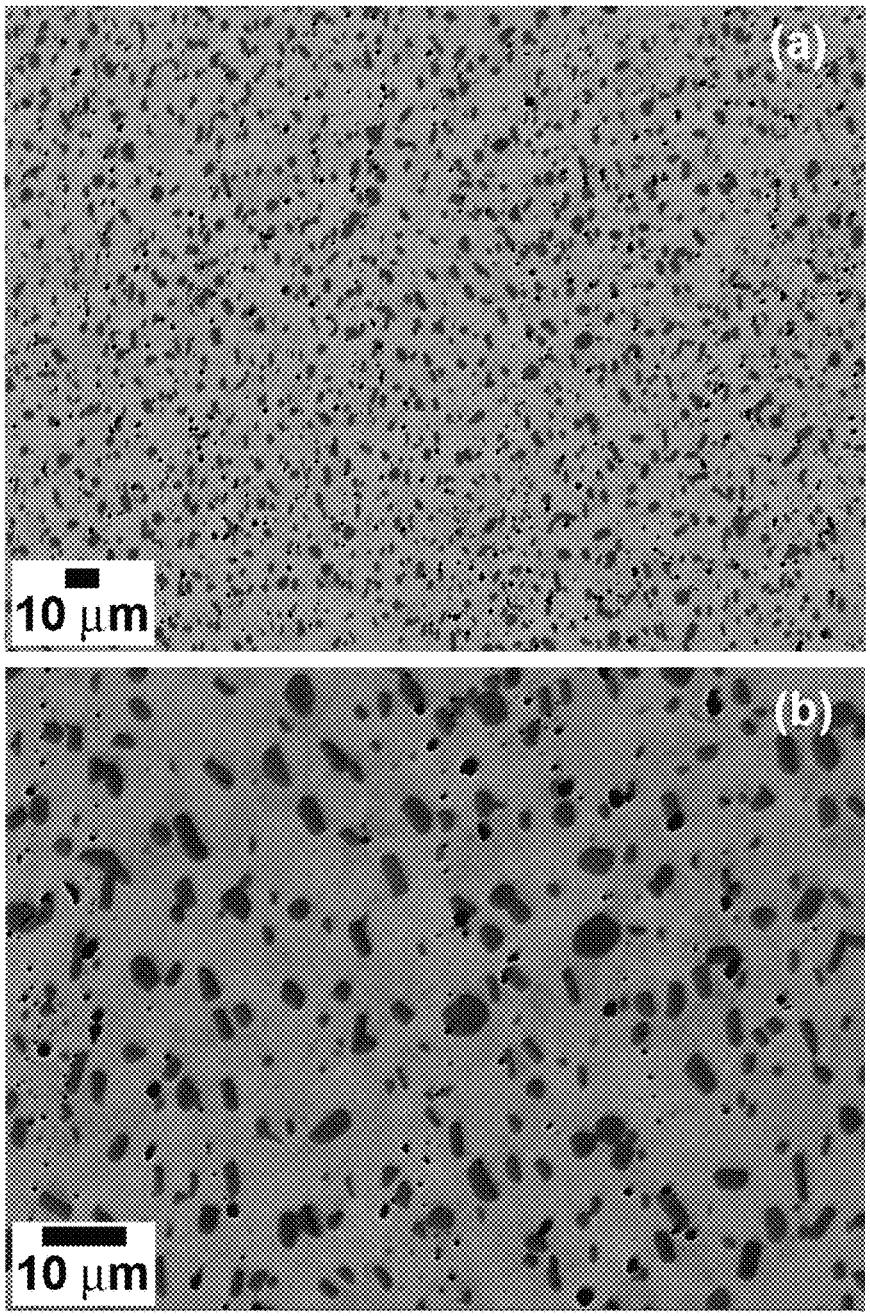
FIG. 33 illustrates backscattered SEM images of microstructure in the extruded pipe close to outer diameter after heat treatment at 1200° C. for 1.5 hrs.

FIGS. 28 through 30 show the backscattered SEM micrographs of the as-extruded samples close to inner diameter, in the center and close to outer diameter of the pipe after heat treatment at 900° C. for 1 hr. Microstructure remains homogenous after the heat treatment, and the boride precipitate phase does not show obvious growth. After heat treatment at 1200° C. for 1 hr, as shown in FIGS. 31 through 33, the microstructure continues to show homogeneous distribution of the boride precipitate phase with no obvious change of size. The similar microstructure at different locations indicates that the microstructure is homogenous throughout the whole pipe wall thickness. The extruded pipe shows the Class 2 Nanomodal Structure after heat treatment with resistance to grain coarsening since boride phase does not show significant growth as compared to the as-extruded state.

Case Example #12: TEM Analysis of Microstructure in the HIP Consolidate Billet for Prototype Pipe Production by Hot Extrusion To examine the structural details, high resolution transmission electron microscopy (TEM) was utilized. To prepare TEM specimens, samples were cut from the HIPed billet that was used to make the extruded pipe. Samples cut from the billet after high temperature heat treatment was also prepared for TEM studies. The samples were first ground and polished to a thickness of 50~80 μm. Discs of 3 mm in diameter were then punched from these thin samples, and the final thinning was done by twin-jet electropolishing using a 30% $HNO_3$ in methanol base. The prepared specimens were examined in a JEOL JEM-2100 HR Analytical Transmission Electron Microscope (TEM) operated at 200 kV.

Figure 34:
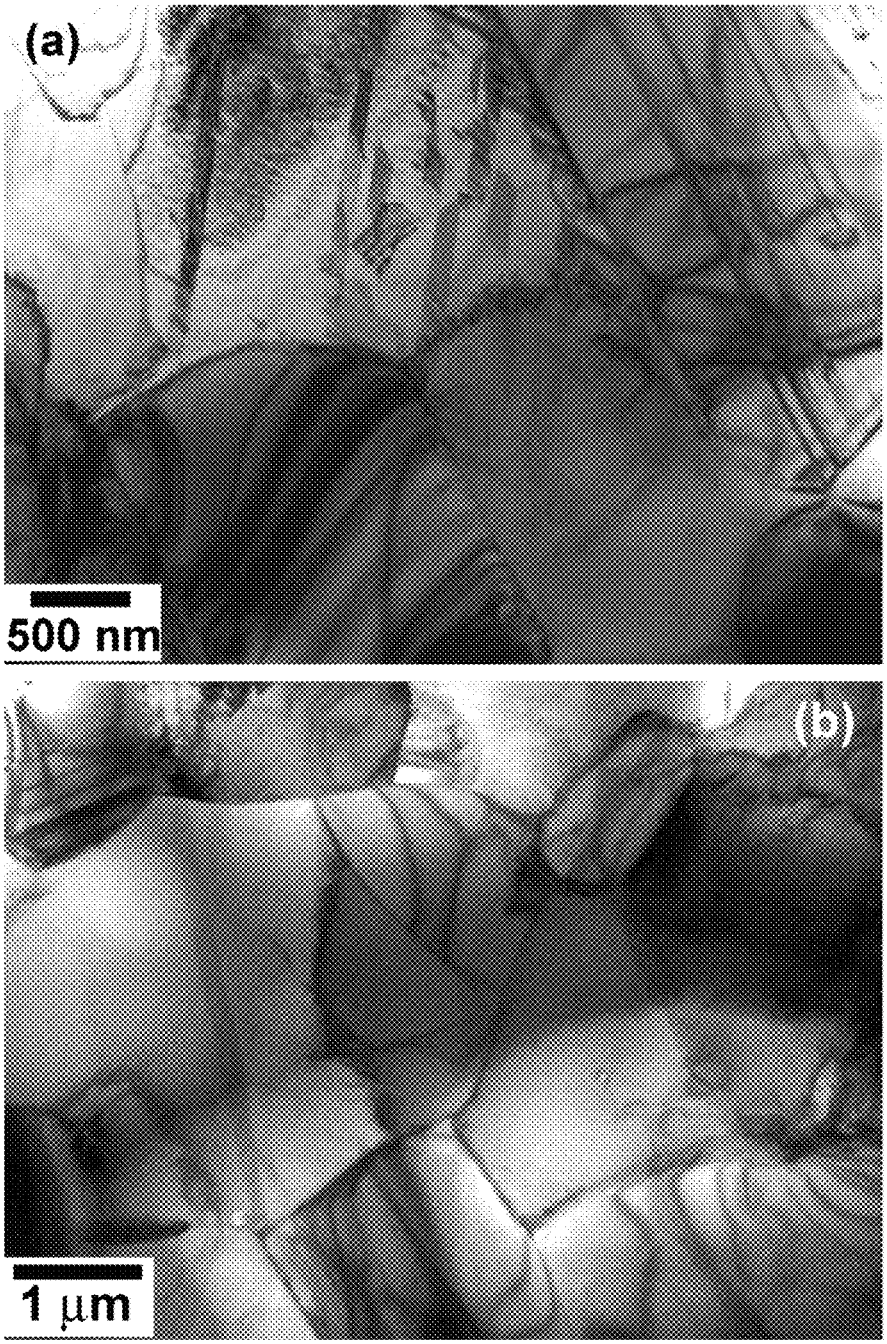
FIG. 34 illustrates TEM microstructure of the HIP consolidated billet from Alloy 82 utilized for the pipe hot extrusion.
Figure 35:
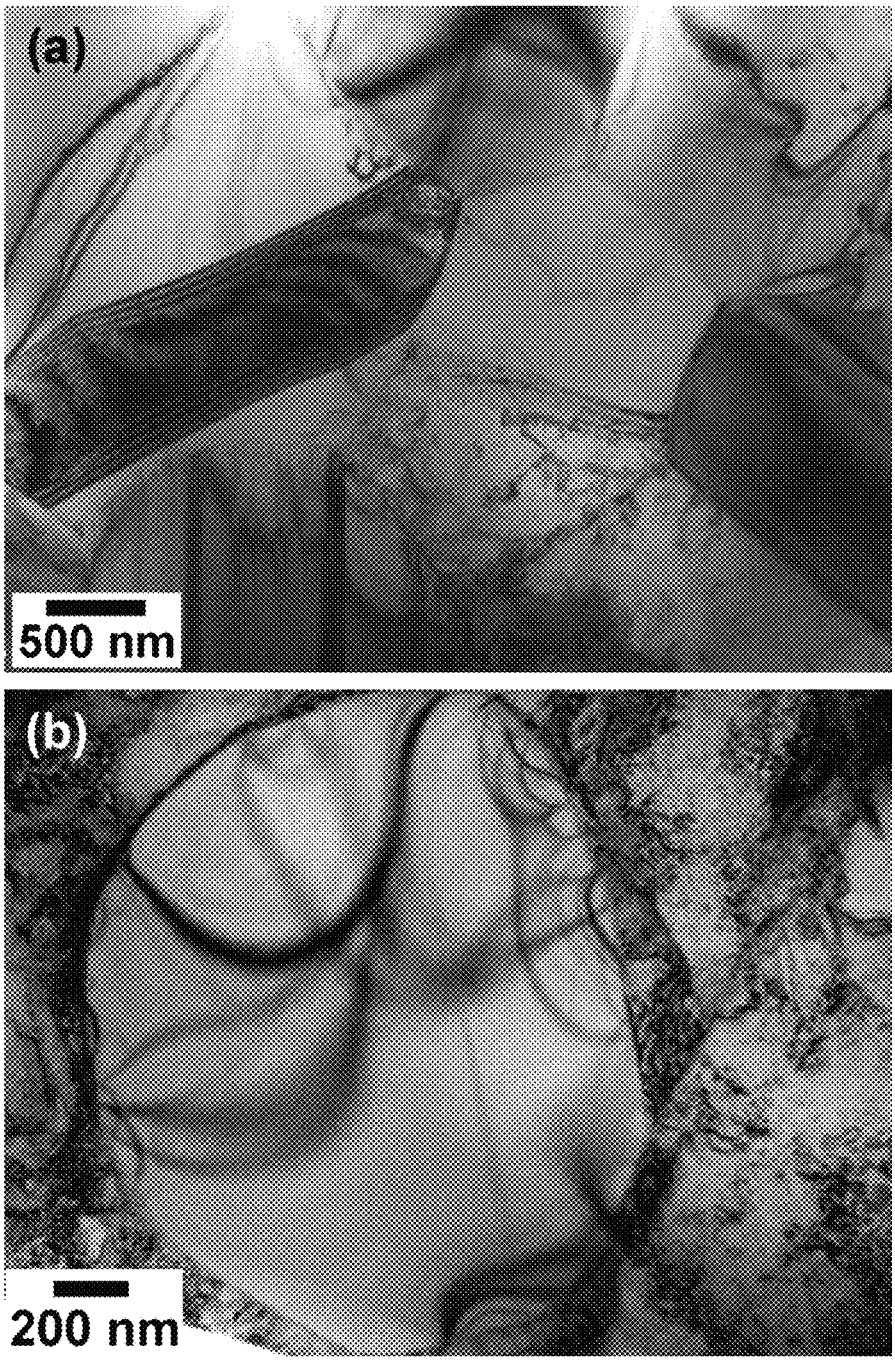
FIG. 35 illustrates TEM microstructure of the HIP consolidated billet from Alloy 82 after heat treatment at 1200° C. for 1 hr utilized for the pipe hot extrusion.

TEM study suggests that the matrix is composed mostly of austenite phase (γ-Fe), and the grain size of the austenite is 1 to several microns in the as-HIPed billet. Finer grains produced through Static NanoPhase Refinement are sometimes seen in the as-HIPed billet, but their volume fraction is relatively small (FIG. 34). The austenite grains are generally clean and well defined, giving plenty of room for the deformation in extrusion. After heat treatment at 1200° C. for 1 hr, most of the austenite grains remain the size and geometry as in the as-HIPed billet, and become even better defined with the sharp grain boundaries as shown in FIG. 35*a*. However, Nanomodal Structure can still be found particularly in areas close to boride precipitate phase through Static Nanophase Refinement, as shown in FIG. 35*b*, although the micron-size austenite grains are in the majority. It suggests that the Static NanoPhase refinement mechanism in this particular case was not completed during the HIP process but based on the tensile properties (FIG. 21), it is clear that the additional temperature plus stress caused the Static NanoPhase Refinement mechanism to completely finish.

Case Example #13: Representative Stress-Strain Curves for Selected Alloys

Figure 36:
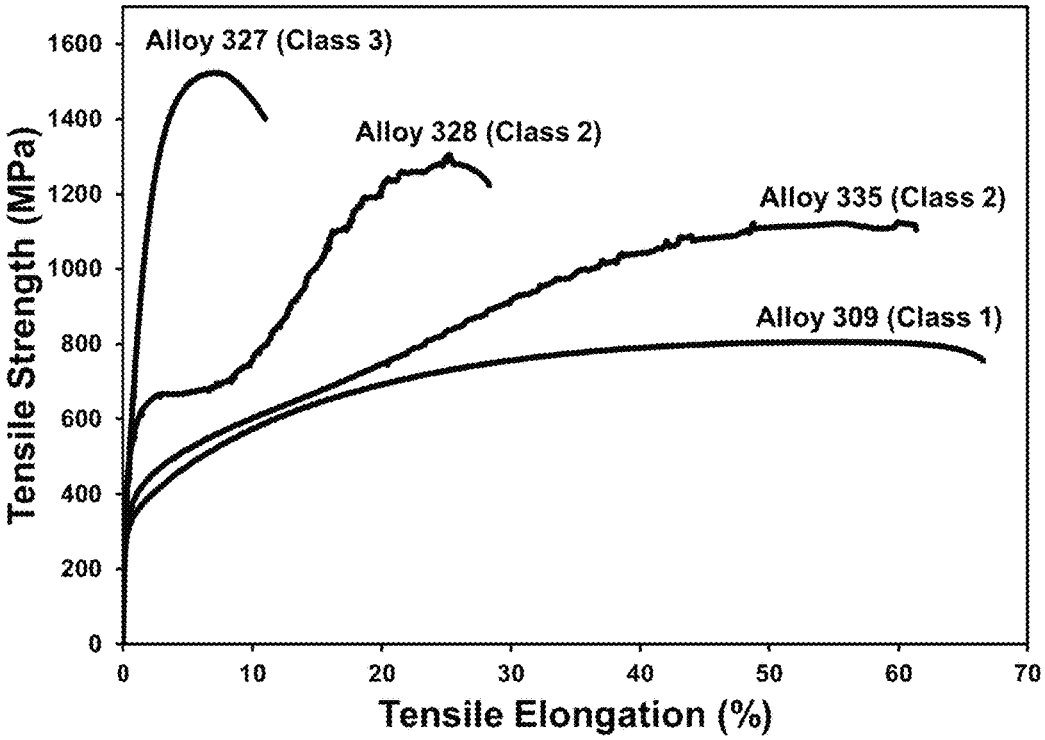
FIG. 36 illustrates representative stress-strain curves for selected alloys demonstrating property range for alloys herein.

A potential level of properties and property combination range for alloys herein is shown in FIG. 36 demonstrated by representative stress-strain curves for selected alloys.

Using commercial purity feedstock, charges of different masses were weighed out for Alloy 309, Alloy 327, Alloy 328, and Alloy 335 according to the atomic ratios provided in Table 2. The elemental constituents were weighed and charges were cast at 50 mm thickness using a Indutherm VTC 800 V Tilt Vacuum Caster. The feedstock was melted using RF induction and then poured into a water cooled copper die corresponding to cast process at commercial production. Subsequent hot rolling was applied using a Fenn Model 061 Rolling Mill and a Lucifer 7-R24 Atmosphere Controlled Box Furnace. The samples were hot rolled to ~96% reduction in thickness via several rolling passes following a 40 minute soak at 50° C. below each alloy's solidus temperature. Alloy 309 and Alloy 327 were heat treated at 850° C. for 6 hr. Alloy 335 was heat treated at 850° C. for 6 hr. Alloy 328 was tested in hot rolled condition.

It should also be noted that the alloys formed herein may be employed in other configurations, such as in the form of sheet. Such sheet may have a thickness from 0.3 mm to 150 mm and from 100 mm to 5000 mm in width. The alloys herein in either forms as Class 2 or Class 3 Steel therefore have a variety of applications. These include but are not limited to structural components in vehicles, including but not limited to parts and components in the vehicular frame, front end structures, floor panels, body side interior, body side outer, rear structures, as well as roof and side rails. While not all encompassing, specific parts and components would include B-pillar major reinforcement, B-pillar belt reinforcement, front rails, rear rails, front roof header, rear roof header, A-pillar, roof rail, C-pillar, roof panel inners, and roof bow. The Class 2 and/or Class 3 steel will therefore be particular useful in optimizing crash worthiness management in vehicular design and allow for optimization of key energy management zones, including engine compartment, passenger and/or trunk regions where the strength and ductility of the disclosed steels will be particular advantageous.

The alloys herein may also provide for use in additional non-vehicular applications, such as for drilling applications, which therefore may include use as a drill collars (a component that provides weight on a bit for drilling), drill pipe (hollow wall pipe used on drilling rigs to facilitate drilling), pipe casing, tool joints (i.e. the threaded ends of drill pipe) and wellheads (i.e. the component of a surface or an oil or gas well that provides the structural and pressure-containing interface for drilling and production equipment) including but not limited to ultra-deep and ultra-deep water and extended reach (ERD) well exploration. The alloys herein may also be used for a compressed gas storage tank and liquefied natural gas canisters.

What is claimed is:

1. A method for forming a seamless tubular component comprising:

supplying a metal alloy comprising Fe at a level of 48.00 to 88.00 atomic percent, Ni at 0 to 16.00 atomic percent, Cr at 0 to 32.00 atomic percent, Mn at 0 to 21.00 atomic percent, B at 1.0 to 8.00 atomic percent, Si at 1.00 to 14.00 atomic percent;

melting said alloy and solidifying by 1) centrifugal casting or 2) atomization and billet formation to provide an alloy including a matrix grain size of 500 nm to 20,000 nm and a boride grain size of 25 nm to 500 nm;

mechanical stressing said alloy and heating said alloy and forming a seamless tubular component by 1) one or more of the following methods if solidified by centrifugal casting: hot extrusion and hot pilgering, or 2) one or more of the following methods if solidified by atomization and billet formation: piercing, pierce and roll, hot extrusion, cold extrusion, hot pilgering and cold pilgering, said seamless tubular component having at least one of the following grain size distributions and mechanical property profiles, wherein said boride grains provide pinning phases that resist coarsening of said matrix grains:

(a) matrix grain size of 500 nm to 20,000 nm, boride grain size of 25 nm to 500 nm, precipitation grain size of 1 nm to 200 nm wherein said alloy indicates a yield strength of 400 MPa to 1300 MPa, tensile strength of 700 MPa to 1400 MPa and tensile elongation of 10 to 70%; or (b) refined matrix grain size of 100 nm to 2000 nm, precipitation grain size of 1 nm to 200 nm, boride grain size of 200 nm to 2,500 nm where the alloy has a yield strength of 300 MPa to 800 MPa.

2. The method of claim 1 wherein said melting is achieved at temperatures in the range of 1100° C. to 2000° C. and solidification is achieved by cooling in the range of $11\times10^{3}$ to $4\times10^{-2}$ K/s.

3. The method of claim 1 wherein said seamless tubular component is positioned in a vehicle.

4. The method of claim 1 wherein said alloy having said grain size distribution (b) is exposed to a stress that exceeds said yield strength of 300 MPa to 800 MPa wherein said refined grain size remains at 100 nm to 2000 nm, said boride grain size remains at 200 nm to 2500 nm, said precipitation grains remain at 1 nm to 200 nm, wherein said alloy indicates a yield strength of 400 MPa to 1700 MPa, tensile strength of 800 MPa to 1800 MPa and an elongation of 5% to 65%.

5. The method of claim 4 wherein said alloy indicates a strain hardening coefficient of 0.2 to 1.0.

6. The method of claim 4 wherein said seamless tubular component is positioned in a vehicle.

7. The method of claim 1, wherein said Mn is present in the range of 5.25 to 21.0 atomic percent.

8. The method of claim 1, wherein said hot extrusion after either 1) centrifugal casting or 2) atomization and billet formation is performed at a temperature in the range of 0.7 Tm to 0.9 Tm, where Tm is the melt temperature of said alloy.

9. A method for forming a seamless tubular component comprising:

(a) supplying a metal alloy comprising Fe at a level of 48.0 to 88.0 atomic percent, Ni at 0.0 to 16.0 atomic percent, Cr at 0.0 to 32.0 atomic percent, Mn at 5.25 to 21.0 atomic percent, B at 1.0 to 8.0 atomic percent, Si at 1.0 to 14.0 atomic percent;

(b) melting said alloy and solidifying to provide an alloy including a matrix grain size of 500 nm to 20,000 nm and a boride grain size of 25 nm to 500 nm; and (c) mechanical stressing said alloy and heating said alloy, forming a seamless tubular component by 1) one or more of the following methods if solidified by centrifugal casting: hot extrusion and hot pilgering, or 2) one or more of the following methods if solidified by atomization and billet formation: hot extrusion and hot pilgering, wherein in heating said alloy, said alloy is heated a temperature in the range of 700° C. to 1200° C. and pressure is applied to said alloy and forming lath structure including grains of 100 nm to 10,000 nm and boride grain size of 100 nm to 2500 nm and said alloy has a yield strength of 300 MPa to 1400 MPa, tensile strength of 350 MPa to 1600 MPa and elongation of 0 to 12%.

10. The method of claim 9 wherein said melting is achieved at temperatures in the range of 1100° C. to 2000° C. and solidification is achieved by cooling in the range of $11\times10^{3}$ to $4\times10^{-2}$ K/s.

11. The method of claim 9 including heating the alloy after step (c) and forming lamellae grains 100 nm to 10,000 nm thick, 0.1-5.0 microns in length and 100 nm to 1000 nm in width along with boride grains of 100 nm to 2500 nm and precipitation grains of 1 nm to 100 nm, wherein said alloy indicates a yield strength of 300 MPa to 1400 MPa.

12. The method of claim 11 wherein said seamless tubular component is positioned in a vehicle.

13. The method of claim 11 wherein the alloy is stressed and forms an alloy having grains of 100 nm to 5000 nm, boride grains of 100 nm to 2500 nm, precipitation grains of 1 nm to 100 nm and said alloy has a yield strength of 500 MPa to 1800 MPa, a tensile strength of 1000 MPa to 2000 MPa and elongation of 0.5% to 15.0%.

14. The method of claim 13 wherein said alloy is positioned in a vehicle.

15. The method of claim 13 wherein said alloy indicates a strain hardening coefficient of 0.1 to 0.9.

16. The method of claim 9 wherein said seamless tubular component is positioned in a vehicle.

* * * * *